US005244776A

United States Patent [19]

Kawai

[11] Patent Number: 5,244,776

[45] Date of Patent: Sep. 14, 1993

[54] METHOD OF FORMING COLOR IMAGES

[75] Inventor: Kiyoshi Kawai, Kanagawa, Japan

[73] Assignee: Fuji Photo Film Co., Ltd., Kanagawa, Japan

[21] Appl. No.: 650,493

[22] Filed: Feb. 5, 1991

[30] Foreign Application Priority Data

Feb. 5, 1990 [JP] Japan ..... 2-25508

[51] Int. Cl.[5] ..... G03C 7/30

[52] U.S. Cl. ..... 430/363; 430/372; 430/383; 430/505; 430/506; 430/508; 430/551; 430/940; 430/963

[58] Field of Search ..... 430/363, 372, 505, 551, 430/940, 963, 508, 506, 383

[56] References Cited

U.S. PATENT DOCUMENTS

| | | | |
|---|---|---|---|
| 4,999,282 | 3/1991 | Sato et al. | 430/569 |
| 5,057,205 | 12/1991 | Inagaki et al. | 430/522 |
| 5,057,405 | 10/1991 | Shiba et al. | 430/505 |

*Primary Examiner*—Janet C. Baxter
*Attorney, Agent, or Firm*—Sughrue, Mion, Zinn, Macpeak & Seas

[57] ABSTRACT

A method of forming a color image in a silver halide color photosensitive material comprising exposing the photosensitive material in a scanning exposure system for a time period shorter than about $10^{-4}$ second per picture element, and thereafter subjecting the exposed material to development processing for a total processing time of about 90 seconds or less, inclusive of drying time, the photosensitive material comprising a support having thereon at least three silver halide emulsion layers differing in color sensitivity, at least two of which have a spectral sensitivity maximum in the wavelength region of about 670 nm or longer, wherein at least one of the silver halide emulsion layers comprises (a) at least one coupler capable of developing color upon coupling reaction with the oxidized form of an aromatic amine compound and (b) at least one compound of general formula (I) or (II):

$$R_1-(A)_n-X \quad (I)$$

$$R_2-\underset{\underset{B}{|}}{C}=Y \quad (II)$$

wherein the variables are as defined in the specification.

11 Claims, No Drawings

METHOD OF FORMING COLOR IMAGES

FIELD OF THE INVENTION

This invention relates to a photosensitive material and an image forming method for obtaining hard copies from digital image information. More particularly, it relates to a photosensitive material for color photography and an image forming method with and by which hard copies can be obtained by rapid scanning exposure and development processing using a silver halide photosensitive material. The present invention gives rise to improvements with respect to the degradation of photographic characteristics which is associated with changes in processing bath composition.

BACKGROUND OF THE INVENTION

Recent years have seen rapid advances in the technology of converting image information to electric signals, transmitting and/or storing the signals and/or regenerating the same on a cathode ray tube (CRT). Along with these advances, increasingly high levels of requirements have been set forth for hard copies reproduced from such image information, and various hard copy producing means have been proposed. However, most of the means proposed heretofore give only hard copies of inferior image quality which are not as good as prints obtained by using currently available color papers. A typical process capable of providing hard copies with high image quality is "FUJI PHOTO FILM'S PICTOGRAPHY" TM, which uses a silver halide thermal development dye diffusion system and an LED scanning exposure system. However, this process is still unsatisfactory from the viewpoints of photosensitive material cost and process stability.

On the other hand, improvements in silver halide photosensitive materials and development of compact, simple and rapid development systems (e.g. minilaboratory system) have made it possible to provide printed photographs having very high quality in a relatively simple manner, in a short time period and at low cost. Therefore, hard copy materials which are inexpensive and can give hard copies of high image quality rapidly and always stably manifesting their performance characteristics as well as an image-forming method adapted to such materials are keenly demanded.

For obtaining hard copies from electric signals, the so-called scanning exposure system is generally used in which image information data are drawn out in succession for exposure as is disclosed in EP 0,350,046. Photosensitive materials suited for use in such system are therefore required. For obtaining hard copies rapidly using silver halide photosensitive materials, it is necessary to shorten both the time required for this scanning exposure and the time required for development. For shortening this scanning exposure time, it is necessary to use a light source with high output power so that the exposure time per picture element can be as short as possible. However, it is well known that higher illuminance, and shorter time exposure of silver halide emulsion grains results in weak development activity of latent images formed upon exposure, leading to a slower rate of development and to a greater change in photographic characteristics due to changes in processing bath composition. Furthermore, when an attempt is made to shorten the development time, the changes in photographic characteristics due to changes in processing bath composition tend to be much more increased.

Accordingly, a technology is required by which latent images formed by high illuminance, and short time exposure can be developed in the shortest possible time and in a stable manner.

So far, glow lamps, xenon lamps, mercury-vapor lamps, tungsten lamps and light-emitting diodes, among others, have been used as light sources for exposure in recording devices or instruments which use the scanning exposure system. However, these light sources are disadvantageous from the practical viewpoint in that they are weak in output power and short in life. For avoiding these disadvantages, scanners are available which use coherent laser light sources, such as He-Ne lasers, argon lasers, He-Cd lasers, other gas lasers, and semiconductor lasers, as light sources for scanning exposure.

Gas lasers are high in output power but have drawbacks: they are large-sized and expensive and require modulators. On the other hand, semiconductor lasers are not only small-sized and inexpensive but also advantageous in that their emissions can be easily modulated and they have a longer life than gas lasers. Semiconductor lasers are therefore best suited for use in a system for obtaining hard copies rapidly and at low cost. This type of system is the general technical field of the present invention.

However, the wavelength of light emitted by these semiconductor lasers is in most cases in the infrared region. Therefore, photosensitive materials showing high photosensitivity in the infrared region which assure rapid and stable development following high illuminance scanning exposure, as well as an image forming method adapted to such materials, becomes necessary. However, the conventional infrared-sensitive photosensitive materials are inferior, in the stability of latent images after exposure, to photosensitive materials spectrally sensitized in the visible region, and such infrared-sensitive materials are subject to greater changes in photographic characteristics upon changes in the development process. In the case of high illuminance laser exposure, the photographic changes in such processes are further intensified. Thus, it has been impossible to put scanning exposure using such lasers to practical use.

Meanwhile, European Patent EP-0277589 discloses a color photosensitive material in which a class of compounds reactive with an aromatic amine compound are used for inhibiting staining which occurs during storage of color photographs due to the aromatic amine compound remaining in the photographs after development. When such compounds are used in photosensitive materials for ordinary printer exposure (about 1/10 to several seconds), the undesirable fluctuation in photographic characteristics due to changes in developer composition is accentuated. Improvements are therefore required.

SUMMARY OF THE INVENTION

It has now been surprisingly found that the compounds disclosed in EP-0277589 mentioned above can reduce the undesirable fluctuation in photographic characteristics due to changes in development processing when latent images formed by high illuminance scanning exposure are developed rapidly. This effect is produced only within a certain range of exposure illuminance and within a certain range of exposure time. The compounds are particularly effective in infrared sensitized photosensitive materials.

Accordingly, it is an object of the invention to provide a photosensitive material for color photography and a method of forming images by which hard copies of high picture quality can be provided rapidly and at low cost, wherein the fluctuations in photographic characteristics due to changes in development processing are reduced to a remarkable extent.

The above and other objects and advantages of the present invention are accomplished by a method of forming a color image in a silver halide color photosensitive material comprising exposing the photosensitive material is exposed in a scanning exposure system for a time period shorter than about $10^{-4}$ second per picture element, and thereafter subjection the exposed material to development processing for a total precessing time of about 90 seconds or less, inclusive of drying time, said photosensitive material comprising a support having thereon at least three silver halide emulsion layers differing in color sensitivity, at least two of which have a spectral sensitivity maximum in the wavelength region of about 670 nm or longer, wherein at least one of the silver halide emulsion layers comprises (a) at least one coupler capable of developing color upon coupling reaction with the oxidized form of an aromatic amine compound, and (b) at least one compound of general formula (I) or (II):

$$R_1-(A)_n-X \quad (I)$$

$$R_2-\underset{\underset{B}{|}}{C}=Y \quad (II)$$

wherein $R_1$ and $R_2$ each is an aliphatic, aromatic or heterocyclic group; X is a leaving group which leaves upon reaction with an aromatic amine developing agent; A is a group capable of forming a chemical bond upon reaction with the aromatic amine developing agent; n is 1 or 0; B is a hydrogen atom, an aliphatic group, an aromatic group, a heterocyclic group, an acyl group, or a sulfonyl group; Y is a group capable of accelerating the addition of an aromatic amine developing agent to the compound of general formula (II); and wherein $R_1$ and X, and/or Y and $R_2$, or Y and B, may combine with each other to form a ring structure.

DETAILED DESCRIPTION OF THE INVENTION

A more detailed description is now set forth the compounds of general formulas (I) and (II).

The compounds of general formulas (I) and (II) preferably have a second-order reaction rate constant $K_2$ (80° C.) for the reaction with p-anisidine within the range of 1.0 liter/mol·sec to $1.0\times10^{-5}$ liter/mol·sec as measured by the method described in JP-A-63-158545 (the term "JP-A" as used herein means an "unexamined published Japanese patent application").

The groups expressed by symbols in the compounds of general formulas (I) and (II) are described below in further detail.

The term "aliphatic group" as used herein for $R_1$, $R_2$ and B means a straight, branched, or cyclic alkyl, alkenyl or alkynyl group, any of which may optionally be substituted. The "aromatic group" used for $R_1$ and $R_2$ and B includes carbocyclic aromatic groups (e.g. phenyl, naphthyl) and heterocyclic aromatic groups (e.g. furyl, thienyl, pyrazolyl, pyridyl, indolyl), which, in either case, may be monocyclic or of a condensed cyclic system (e.g. benzofuryl, phenanthridinyl) and further may optionally be substituted.

The "heterocyclic group" used in defining $R_1$, $R_2$ and B preferably has a 3- to 10-membered cyclic structure comprising a carbon atom or atoms together with an oxygen, nitrogen, sulfur and/or hydrogen atom or atoms. The heterocycle itself may be saturated or unsaturated and may optionally be substituted (e.g. chromanyl, pyrrolidyl, pyrrolinyl, morpholinyl).

The "acyl group" and "sulfonyl group" used in defining B include an aliphatic acyl group and sulfonyl group and an aromatic acyl group and sulfonyl group.

The leaving group X in general formula (I) which leaves upon reaction with an aromatic amine developing agent is preferably a group bonding to A via an oxygen, sulfur or nitrogen atom (e.g. 2-pyridyloxy, 2-pyrimidiloxy, 4-pyrimidiloxy, 2-(1,2,3-triazinyl)oxy, 2-benzimidazolyl, 2-imidazolyl, 2-thiazolyl, 2-benzothiazolyl, 2-furyloxy, 2-thiophenyloxy (2-mercaptophenyloxy), 4-pyridyloxy, 3-isoxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazoline-5-oxy , aryloxy, alkoxy, alkylthio, arylthio, substituted N-oxy) or a halogen atom.

When X is a halogen atom, n is 0 (zero).

The group A capable of forming a chemical bond upon reaction with an aromatic amine developing agent contains a low electron density atom-containing group, such as $$-L-\overset{\overset{Y}{\|}}{C}-,\ -L-\overset{\overset{Y}{\|}}{S}-,\ -L-\underset{\underset{Y}{\|}}{\overset{\overset{Y}{\|}}{S}}-,\ -L-\underset{\underset{Y'}{|}}{\overset{\overset{Y}{\|}}{P}}-,\ \text{or}\ -L-\underset{\underset{R''}{|}}{\overset{\overset{R'}{|}}{Si}}-,$$

In the above, L is a single bond, an alkylene group, $$-O-,\ -S-,\ -\underset{\underset{R'''}{|}}{N}-,\ -L'-\overset{\overset{Y}{\|}}{C}-L'',$$

$$-L-\overset{\overset{Y}{\|}}{S}-L''-,\ \text{or}\ -L-\underset{\underset{Y'}{\|}}{\overset{\overset{Y}{\|}}{S}}-L''-$$

(e.g., carbonyl, sulfonyl, sulfinyl, oxycarbonyl, phosphonyl, thiocarbonyl, aminocarbonyl, silyloxy, etc.).

Y has the same meaning as Y in general formula and Y' has the same meaning as Y.

R' and R'' may be the same or different and each represents —L'''—Rl.

L', L'' and L''', each represents $$-O-,\ -S-\text{or}\ -\underset{\underset{R'''}{|}}{N}-.$$

R''' is a hydrogen atom, an aliphatic group (e.g. methyl, isobutyl, t-butyl, vinyl, benzyl, octadecyl, cyclohexyl), an aromatic group (e.g. phenyl, pyridyl, naphthyl), a heterocyclic group (e.g. piperidinyl, pyranyl, furanyl, chromanyl), an acyl group (e.g. acetyl, benzoyl) or a sulfonyl group (e.g. methanesulfonyl, benzenesulfonyl).

L''' can further mean a single bond.

Particularly preferred as A are

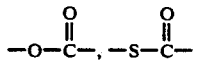

and a divalent group of the formula

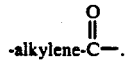

Among the compounds of general formula (I), more preferred compounds are those of the general formula (I-a), (I-b), (I-c) or (I-d) shown below which react with p-anisidine with a second-order reaction rate constant $k_2$ (80° C.) within the range of $1\times10^{-1}$ liter/mol·sec to $1\times10^{-5}$ liter/ml·sec.

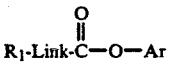

(I-a)

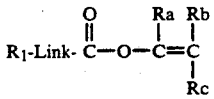

(I-b)

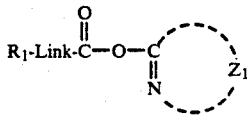

(I-c)

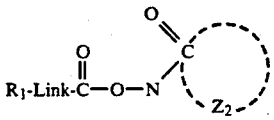

(I-d)

In the above formulas, $R_1$ has the same meaning as $R_1$ in general formula (I). Link means a single bond or —O—. Ar represents an aromatic group in the same sense as mentioned above with respect to $R_1$, $R_2$ and B. It is preferable, however, that Ar is other than those groups which, after their release upon reaction with an aromatic amine developing agent, give hydroquinone derivatives, cathecol derivatives or other derivatives which function as reducing agents for photography. $R_a$, $R_b$ and $R_c$ may be the same or different, and each may be an aliphatic, aromatic or heterocyclic group in the same sense as mentioned above with respect to $R_1$, $R_2$ and B. $R_a$, $R_b$ and $R_c$ each may further represent an alkoxy, aryloxy, heterocyclic-oxy, alkylthio, arylthio, heterocyclic-thio, amino, alkylamino, acyl, amido, sulfonamido, sulfonyl, alkoxycarbonyl, sulfo, carboxyl, hydroxy, acyloxy, ureido, urethane, carbamoyl or sulfamoyl group. $R_a$ and $R_b$, or $R_b$ and $R_c$, may combine with each other to form a 5- to 7-membered heterocyclic ring, which may optionally be substituted or involved in spiro or bicyclo ring formation or condensed with an aromatic ring. $Z_1$ and $Z_2$ each is a group of nonmetal atoms which is necessary for the formation of a 5- to 7-membered heterocyclic ring, which may optionally be substituted or involved in spiro or bicyclo ring formation or condensed with an aromatic ring.

The second-order reaction rate constant $k_2$ (80° C.) with respect to p-anisidine of a compound of general formula (I-a), which is taken as a particular example from among general formula (I-a) to (I-d), can be adjusted to a level within the range of $1\times10^{-1}$ liter/mol·sec to $1\times10^{-5}$ liter/mol·sec by substituent selection when Ar is a carbocyclic aromatic group. In that case, the total sum of Hammett's $\sigma$ values for all substituents should preferably be not less than 0.2, more preferably not less than 0.4, and most preferably not less than 0.6, although the situation may vary depending on the kind of $R_1$.

For applying the compounds of general formulas (I-a) to (I-d) in manufacturing photosensitive materials, the compounds themselves should preferably contain not less than 13 carbon atoms. Those compounds that decompose during processing for development are not preferred as the compounds to be used in the practice of the invention for achieving the objects of the invention.

It is preferable that Y in general formula (II) is an oxygen or sulfur atom, or $=N—R_{24}$ or $=C(R_{25})(R_{26})$ where $R_{24}$, $R_{25}$ and $R_{26}$ each is a hydrogen atom, an aliphatic group (e.g. methyl, isopropyl, t-butyl, vinyl, benzyl, octadecyl, cyclohexyl), an aromatic group (e.g. phenyl, pyridyl, naphthyl), a heterocyclic group (e.g. piperidyl, pyranyl, furanyl, chromanyl), an acyl group (e.g. acetyl, benzoyl) or a sulfonyl group (e.g. methanesulfonyl, benzenesulfonyl) and $R_{25}$ and $R_{26}$ may be bonded to each other to form a ring structure.

Among the compounds of general formulas (I) and (II), the compounds of general formula (I) are particularly preferred, and the compounds of general formula (I-a) and of general formula (I-c) are more preferred. In particular, the compounds of general formula (I-a) are most preferred.

Typical examples of these compounds are shown below. They are, however, by no means limitative of the scope of the present invention.

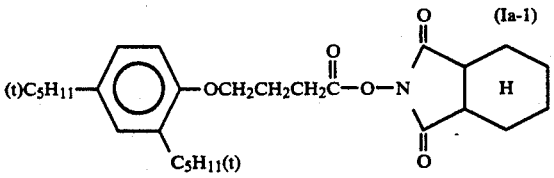

(Ia-1)

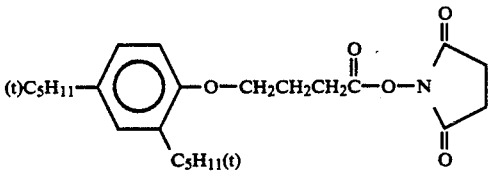

(Ia-2)

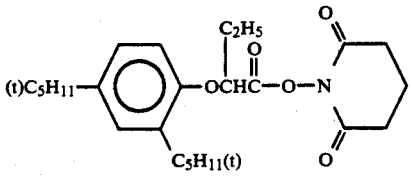

(Ia-3)

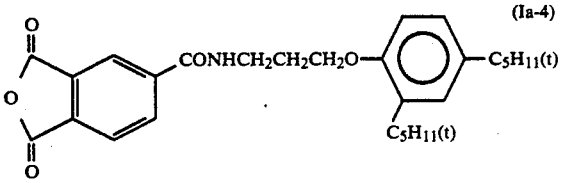

(Ia-4)

-continued
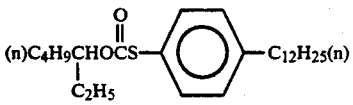
(Ia-5)
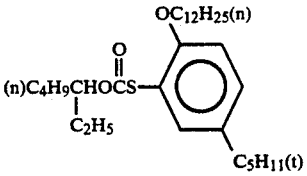
(Ia-6)
$(n)C_{18}H_{37}I$ (Ia-7)
$(n)C_{18}H_{37}Br$ (Ia-8)
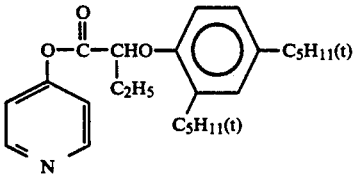
(Ia-9)
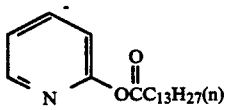
(Ia-10)
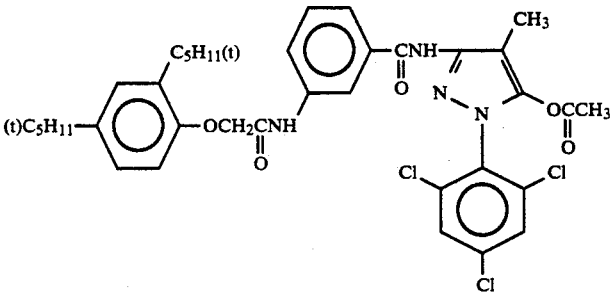
(Ia-11)
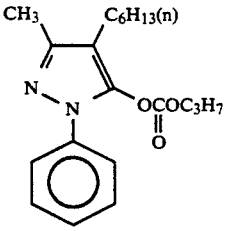
(Ia-12)
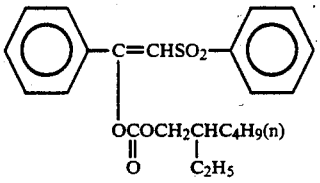
(Ia-13)
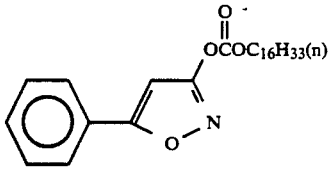
(Ia-14)
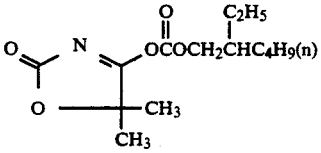
(Ia-15)
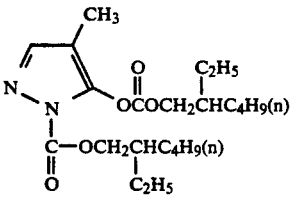
(Ia-16)
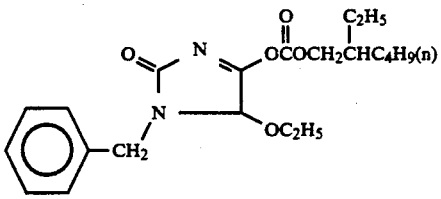
(Ia-17)
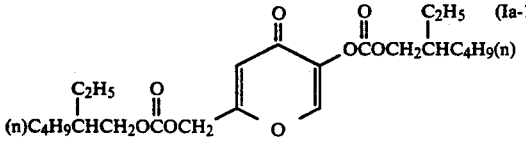
(Ia-18)
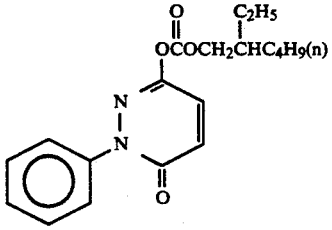
(Ia-19)

-continued
(Ia-20)
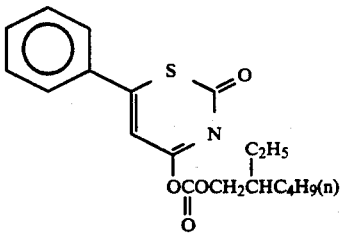
(Ia-21)
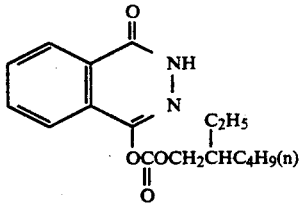
(Ia-22)
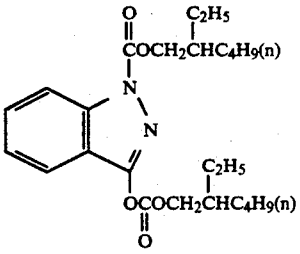
(Ia-23)
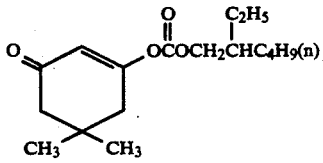
(Ia-24)
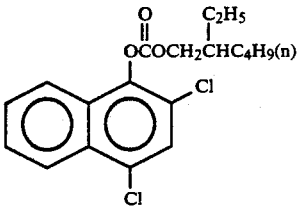
(Ia-25)
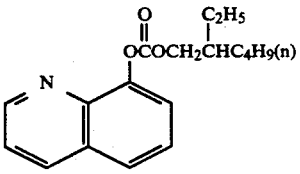
(Ia-26)
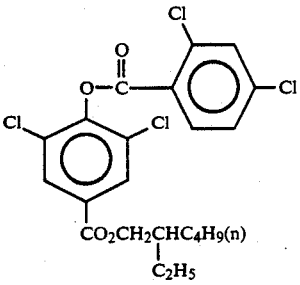
(Ia-27)
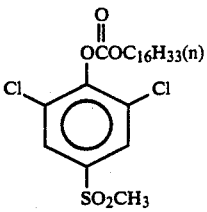
(Ia-28)
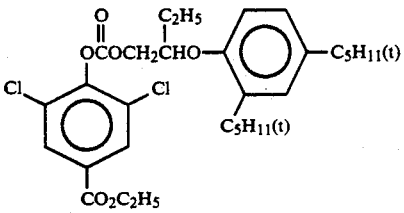
(Ia-29)
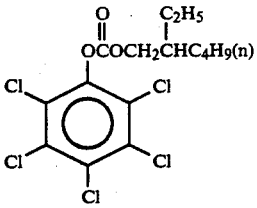
(Ia-30)
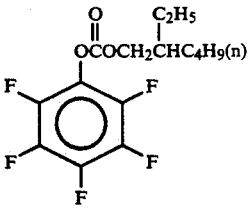
(Ia-31)
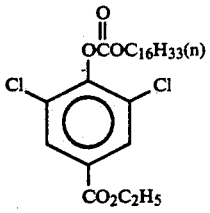
(Ia-32)
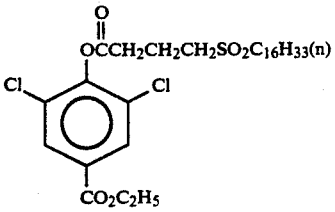
(Ia-33)
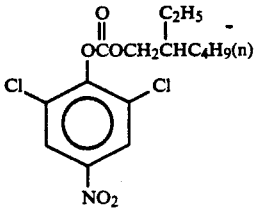

-continued
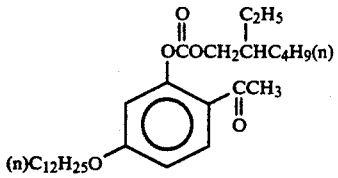
(Ia-34)
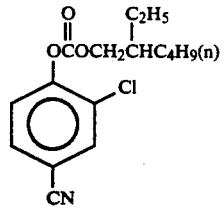
(Ia-35)
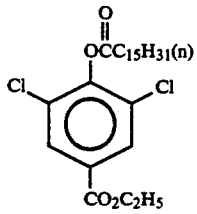
(Ia-36)
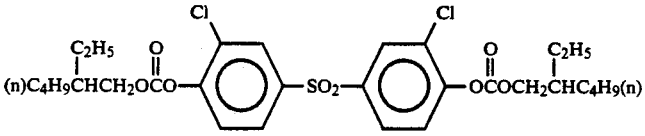
(Ia-37)
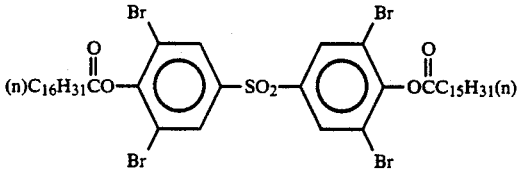
(Ia-38)
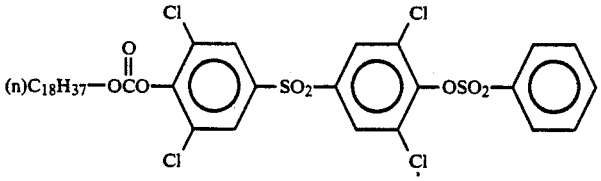
(Ia-39)
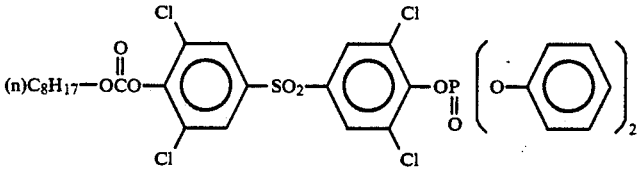
(Ia-40)
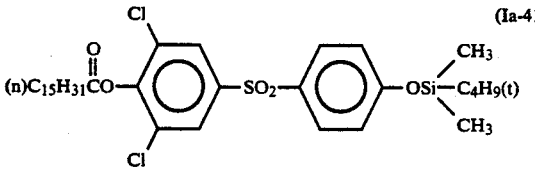
(Ia-41)
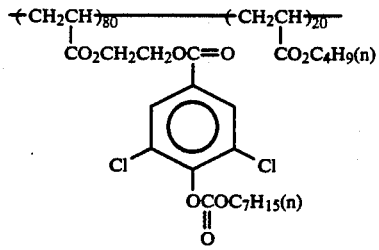
(Ia-42)
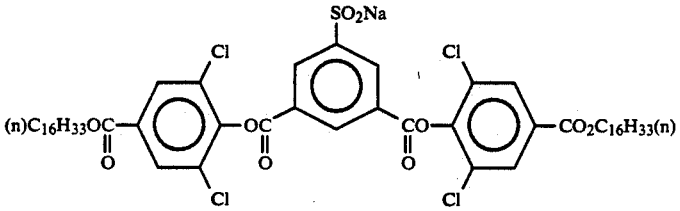
(Ia-43)

-continued
(Ia-44)
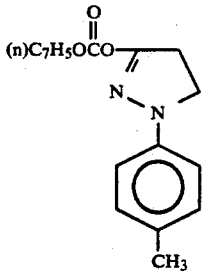
(Ia-45)
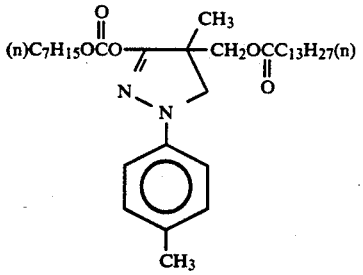
(Ia-46)
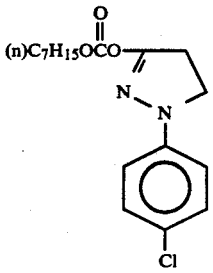
(Ia-47)
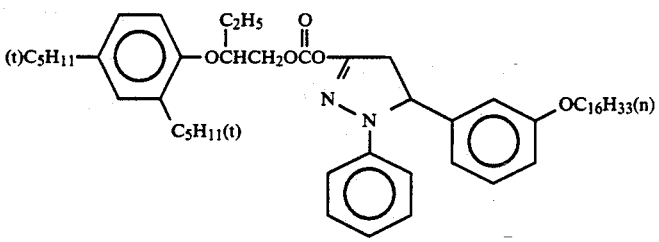
(Ia-48)
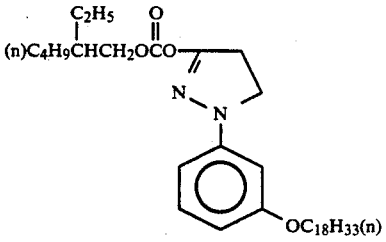
(Ia-49)
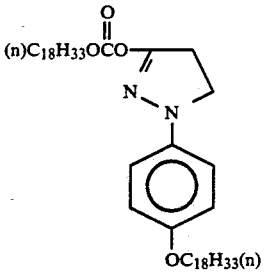
(Ia-50)
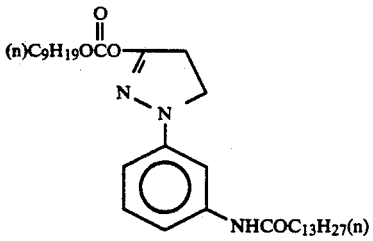
(Ia-51)
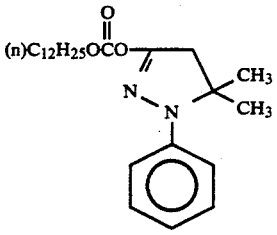
(IIa-1)
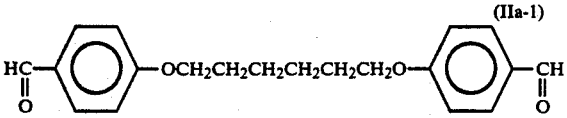
(IIa-2)
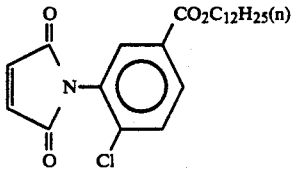

-continued $CH_2{=}CH{-}SO_2{-}C_{18}H_{37}(n)$ (IIa-3)

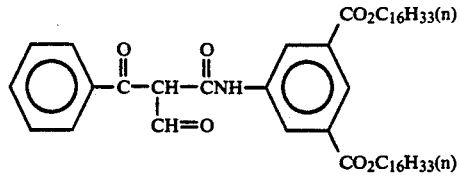

(IIa-4)

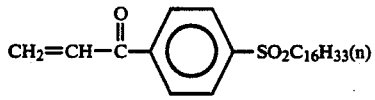

(IIa-5)

These compounds of formulas (I) and (II) can be synthesized by the methods described in JP-A-63-115866 and JP-A-63-158545 or modifications thereof.

The range of compounds of formulas (I) and (II) preferred for use in the practice of the invention includes those compounds specifically described in the above-cited patent specifications and in JP-A-62-283338.

Among the compounds of general formulas (I) and (II), those having a relatively low molecular weight or readily soluble in water may be added to processing solutions. A preferred mode of use comprises adding them to a hydrophilic colloid layer in the manufacture of photosensitive materials.

The compounds of formulas (I) and (II) are contained in a silver halide emulsion layer which contains at least one coupler capable of dye formation upon coupling reaction with the oxide form of an aromatic amine compound. In the processing of photosensitive materials for producing full-color hard copies using a scanning exposure device in accordance with the present invention, at least two silver halide emulsion layers are required to have a spectral sensitivity maximum of about 670 nm or more. It is preferable that the above compounds be present in such layers having spectral sensitivities of about 670 nm or longer. This is because while the processing stability is sacrificed particularly when silver halide emulsion grains spectrally sensitized in the infrared region are exposed at a high illuminance for a short period, the use of a compound of the above general formula (I) or (II) effectively and materially reduces the changes in photographic characteristics due to changes in processing conditions.

The compounds of general formula (I) or (II) to be used in the photosensitive material in accordance with the present invention are preferably soluble in a high-boiling organic solvent, and are preferably present in an amount of $1\times10^{-2}$ to 10 mols, more preferably $3\times10^{-2}$ to 5 mols, per mol of the coupler present in the layer to which the compounds are added. Furthermore, these compounds are preferably coemulsified with a magenta coupler.

The exposure time specified herein is now explained. The method according to the present invention involves a scanning exposure step in which an image is formed by moving a high-density light beam from a laser or LED relative to the photosensitive material. Therefore, the time over which the silver halide in the photosensitive material is exposed is the time required for exposing a certain minuscule area. For this minuscule area, the minimum unit area for which the luminous energy is controlled according to the digital data concerned is generally given the designation "picture element". Therefore, the exposure time per picture element varies with the size of the picture element. The size of picture elements depends on their density which is, for all practical purposes, within the range of 50 to 2,000 dpi. In the context of the invention, the exposure time is defined as the time for exposure of one picture element determined on the assumption that the picture element density is 400 dpi. When the exposure time per picture element is about $10^{-4}$ second or shorter, preferably $10^{-6}$ second or shorter, the compounds of general formula (I) or (II) are effective in enhancing the resistance to changes in processing conditions. When, conversely, the exposure time exceeds 1/100 second, the compounds of general formula (I) or (II) amplify rather than ameliorate the fluctuations in the photographic charactaristics due to changes in the processing steps.

The constitution of the photosensitive material processed according to the invention is now described. The photosensitive material comprises, on a support or base, at least three silver halide emulsion layers differing in sensitivity, at least one of which comprises at least one coupler capable of forming a dye upon coupling reaction with the oxidized form of an aromatic amine compound. At least two of these emulsion layers have a spectral sensitivity maximum in the wavelength region of 670 nm or longer. For use in full-color hard copying, the material preferably has, on a support, at least three silver halide emulsion layers differing in color sensitivity and respectively containing couplers capable of developing yellow, magenta and cyan colors upon coupling with the oxidized form of an aromatic amine compound. The three different spectral sensitivities can suitably be selected according to the wavelength of the light source employed for scanning exposure. From the color resolution viewpoint, it is preferable that the spectral sensitivity maxima of each emulsion layer which differs in color sensitivity is separated from its closest neighboring layer by at least 30 nm. There is no particular restriction in regard to the correspondence between the three photosensitive layers (1λ, 2λ, 3λ) differing in spectral sensitivity maximum and the dye-forming couplers (Y, M, C). Thus, 6 (3×2) combinations are possible. There is no particular restriction, either, with respect to the order of coating, relative to the support side, of the three photosensitive layers differing in spectral sensitivity maximum. Thus, there is a maximum of 36 possible combinations involving three different photosensitivities, three dye-forming couplers and three orders of layers. The present invention is applicable to any of such 36 layer arrangements.

In the practice of the invention, it . is preferable to employ a semiconductor laser as the light source for scanning exposure. As noted above, at least two of the three silver halide photosensitive layers differing in color sensitivity have spectral sensitivity maxima in the long wavelength region of about 670 nm or longer. In this instance, too, there is no particular restriction on the spectral sensitivity maxima, dye-forming couplers and coating order of layers.

Specific examples of the light source for scanning exposure, of the spectral sensitivity maxima, and of the color couplers are shown below in Table 1. They are, however, by no means limitative of the scope of the present invention.

TABLE 1

| | Light source for scanning exposure | | | |
|---|---|---|---|---|
| | Light source | Wavelength | Color | Remarks |
| 1 | He—Cd laser | 441.6 | Y | For comparison |
| | Ar laser | 514.5 | M | |
| | He—Ne laser | 632.8 | C | |
| 2 | GaAs(900) + SHG[1)] | 450 | Y | " |
| | InGaAs(1200) + SHG | 600 | M | |
| | InGaAs(1300) + SHG | 650 | C | |
| 3 | GaAs(900) + SHG | 450 | Y | " |
| | InGaAs(1200) + SHG | 600 | C | |
| | Sum frequency[2)] | 514 | M | |
| 4 | AlGaInAs(670) | 670 | C | The invention |
| | GaAlAs(750) | 750 | Y | |
| | GaAlAs(810) | 810 | M | |
| 5 | AlGaInAs(670) | 670 | Y | " |
| | GaAlAs(750) | 750 | M | |
| | GaAlAs(830) | 830 | C | |
| 6 | AlGaInAs(670) | 670 | M | " |
| | GaAlAs(780) | 780 | Y | |
| | GaAlAs(830) | 830 | C | |
| 7 | AlGaInAs(670) | 670 | C | " |
| | GaAlAs(780) | 780 | M | |
| | GaAlAs(880) | 880 | Y | |
| 8 | LED(580) | 580 | M | " |
| | LED(670) | 670 | C | |
| | LED(810) | 810 | Y | |

[1)]SHG:Second harmonic waves using a nonlinear optical element.
[2)]The two lasers (900 nm and 1,200 nm) and the non-linear optical element are used in combination to obtain the sum frequency.

The silver halide emulsion to be used in the materials processed according to the present invention preferably comprises silver chlorobromide or silver chloride and is substantially free from silver iodide.

The term "substantially free from silver iodide" means that the silver iodide content of the emulsion is 1 mol % or less, preferably 0.2 mol % or less. While the halogen composition may vary from one grain to another or be uniform, the use. of an emulsion having a uniform halogen composition makes it easy to homogenize the behaviors of the respective grains. With regard to the halogen distribution within the silver halide emulsion grain, homogenous grains, each of which is thoroughly uniform in halogen composition; laminar grains, which vary in halogen composition between the core and the surrounding shell or shells; and grains having one or more locally heterogenous regions in non-laminar fashion in the core of the grain or on the surface (when such a heterogenous region exists on the grain surface, the boundary between different phases may be present at the edge, corner or plane of the grain) can be employd, for instance. For increased sensitivity, grains of the latter two structures are preferred to homogenous grains. This is also true in terms of pressure resistance. When the silver halide grains have the above-mentioned structures, the boundary between two different phases may be discrete or obscured as the result of formation of mixed crystals. Furthermore, grains deliberately given a continuous change in structure can also be employed.

With respect to the halogen composition, such silver chlorobromide emulsion may have any silver bromide/silver chloride ratio. This ratio may be selected from within a broad range according to the purposes to be attained. Silver chloride should preferably account for at least 2%, however.

In photosensitive materials adapted to rapid processing, a silver chloride-rich emulsion having a high silver chloride content is preferably employed. The silver chloride content of such silver chloride-rich emulsion is preferably 90 mol percent or more and more preferably 95 mol percent or more.

In such a silver chloride-rich emulsion, the local silver bromide phase is preferably present in the core and/or on the surface of the grain in the above-mentioned laminar or non-laminar pattern. The halogen composition of such a localized phase preferably comprises at least 10 mol % and, more preferably over 20 mol %, of silver bromide. While such localized phase may exist in the core of the grain or at the edge, corner and/or plane of the grain surface, one preferred example is an epitaxially grown AgBr phase at a corner of the grain.

On the other hand, for the purpose of minimizing the decrease in sensitivity by a pressure applied to the photosensitive material, it is preferable to use homogenous grains with a small variation in intra-grain halogen composition even in the case of a high-chloride (90 mol % or more) silver halide emulsion.

Furthermore, for the purpose of reducing the replenishing rate of the development processing bath, it is preferable to further increase the silver chloride content of the silver halide emulsion. In such cases, a substantially pure silver chloride emulsion with an AgCl content of 98 to 100 mol % can be advantageously employed.

The average grain size (the diameter of a circle equivalent to the projected area of a grain is taken as grain size and the number average of such diameters is used) of the silver halide emulsion to be employed in the present invention is preferably 0.1 $\mu$ to 2 $\mu$.

The grain size distribution is preferably monodispersed, that is to say the coefficient of variation (the standard deviation of grain size distribution divided by the mean grain size) is not greater than 20% and, for still better results, not greater than 15%. To broaden the latitude, it may be preferable to use such monodispersed emulsions as a blend in the same layer or in superimposed layers.

The morphology of silver halide grains in the photographic emulsion may be regular, for example cubic, tetradecahedral or octahedral, or irregular, for example spherical or tabular, or combinations thereof. A mixture of various crystal forms may also be employed. In the present invention, it is preferable to employ an emulsion containing not less than 50%, more preferably not less than 70% and, most preferably, not less than 90% of said regular grains.

Aside from the foregoing, an emulsion containing more than 50%, relative to the total projected area of all grains, of tabular grains with an average aspect ratio (diameter of equivalent circle/thickness) of not less than 5, and preferably not less than 8, can be advantageously employed.

The silver chlorobromide emulsion to be employed in the present invention can be prepared by the methods described in P. Glafkides: *Chimie et Phisique Photographique* (Paul Montel, 1967), G. F. Duffin: *Photographic Emulsion Chemistry* (Focal Press, 1966), V. L. Zelikman et al: *Making and Coating Photographic Emulsion* (Focal Press, 1964) and other literature. Thus, any of the acid, neutral and ammonia processes can be employed, and in the process in which a soluble silver salt is reacted with a soluble halide, the single-jet or/and double-jet method can be employed. A method (reverse mixing method) in which grains are formed in an atmosphere of excess silver ion can also be employed. As a version of the double-jet method, the so-called controlled double-jet method in which pAg in the liquid phase giving rise to silver halide is kept constant. By this method, a silver halide emulsion of regular crystal morphology and nearly uniform grain size can be obtained.

In the silver halide emulsion to be used in the present invention, a variety of polyvalent metal ion impurities can be incorporated in the course of emulsion grain formation or in the physical ripening stage. The compounds used for this purpose include, inter alia, salts of cadmium, zinc, lead, copper, thallium, etc. and salts or complex salts of group VIII elements such as iron, ruthenium, rhodium, palladium, osmium, iridium, platinum, etc. The group VIII elements mentioned above are preferable. The level of addition of such compounds may vary widely but is preferably within the range of $10^{-9}-10^{-2}$ mols per mol of silver halide.

The silver halide emulsion to be used in the present invention is generally subjected to chemical sensitization and spectral sensitization. With regard to chemical sensitization, sulfur sensitization which is typically addition of a labile sulfur compound, noble metal sensitization which is typically gold sensitization, and reductive sensitization among others can be used independently or in combination. With respect to specific compounds used. for chemical sensitization, the compounds mentioned on page 18, bottom right col., to page 22, top right col., of the specification of JP-A-62-215272 can be employed with advantage.

Spectral sensitization is intended to provide the emulsions in the respective layers of the photosensitive material of the present invention with spectral sensitivities to the desired wavelengths of light. In the present invention, this is preferably done by adding dyes which absorb in the wavelength regions corresponding to the desired spectral sensitivities, i.e., spectral sensitizing dyes. As examples of spectral sensitizing dyes used for this purposes, the dyes mentioned in F. M. Harmer: *Heterocyclic Compounds—Cyanine dyes and related compounds* (John Wiley & Sons [New York, London], 1964) can be mentioned. As to specific examples of such compounds and the method for spectral sensitization, those described on page 22, top right col. to page 38 of the specification of the above-mentioned JP-A-62-215272 can be adopted with advantage.

In the silver halide emulsion to be used in the present invention, a variety of compounds or precursors thereof can be incorporated for preventing fogging during the manufacture and storage of the photosensitive material or in the course of processing or for stabilizing the photographic characteristics. Preferred specific examples of such compounds are described on pages 39 to 72 of the specification of JP-A-62-215272 referred to hereinbefore.

The emulsion to be used in the present invention may be a surface latent image emulsion in which the latent image is mainly formed on the grain surface, or an internal latent image emulsion in which the latent image is mainly formed in the core region of the grain.

When a semiconductor laser is used as the light source for scanning exposure in practicing the invention, efficient spectral sensitization should be achieved in the infrared region.

For spectral sensitization in the region of 720 nm or longer wavelengths, in particular, a sensitizing dye selected from among those of the general formulas (Q-I), (Q-II) and (Q-III) given below can be used. These sensitizing dyes are relatively stable from the chemical viewpoint and are characterized in that they can be adsorbed relatively firmly on the surface of silver halide grains and are resistant to desorption under the influence of coexisting dispersed substances such as the couplers.

In the following, such sensitizing dyes of general formula (Q-I), (Q-II) and (Q-III) are described in further detail.

General Formula (Q-I)

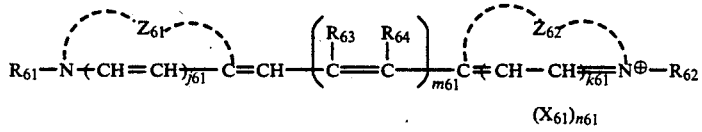

In the above formula, $Z_{61}$ and $Z_{62}$ each is a group of atoms necessary for the formation of a heterocyclic nucleus.

Preferred as the heterocyclic nucleus are 5- or 6-membered nuclei comprising, as a hetero-atom or atoms, the nitrogen atom either alone or together with one or more hetero-atom selected from among sulfur, oxygen, selenium and tellurium atoms, which nuclei may optionally be condensed with a further ring and/or substituted.

Specifically, suitable heterocyclic nuclei include, among others, thiazole, benzothiazole, naphthothiazole, selenazole, benzoselenazole, naphthoselenazole, oxazole, benzoxazole, naphthoxazole, imidazole, benzimidazole, naphthimidazole, 4-quinoline, pyrroline, pyridine, tetrazole, indolenine, benzindolenine, indole, tellurazole, benzotellurazole and naphthotellurazole nuclei.

$R_{61}$ and $R_{62}$ each is an alkyl, alkenyl, alkynyl or aralkyl group. It is to be noted that these groups and the groups mentioned later herein include not only unsubstituted but substituted groups. Thus, for instance, the alkyl group, taken as an example, includes unsubstituted and substituted alkyl groups and these may be straight, branched or cyclic. The number of carbon atoms contained in the alkyl group is preferably 1 to 8.

Specific examples of the substituent or substituents in the substitued alkyl group may include halogen atoms (e.g. chlorine, bromine, fluorine) and cyano, alkoxy, substituted or unsubstituted amino, carboxylic acid, sulfonic acid and hydroxyl groups. The substitued alkyl group may have one substitutent or two or more substituents each independently selected from among those mentioned above.

A typical example of the alkenyl group is vinylmethyl.

Specific examples of the aralkyl group are benzyl and phenethyl.

$m_{61}$ represents the positive number 1, 2 or 3.

$R_{63}$ is a hydrogen atom and $R_{64}$ is a hydrogen atom or a lower alkyl or aralkyl group and may further be connected to $R_{62}$ to form a 5-or 6-membered ring. When $R_{64}$ is a hydrogen atom, $R_{63}$ may be connected to another $R_{63}$ (when $m_{61}$ is 2 or 3) to form a carbocyclic or heterocyclic ring. These rings are preferably 5- or 6-membered. $j_{61}$ and $k_{61}$ each represents 0 or 1, $X_{61}$ is an acid anion and $n_{61}$ represents 0 or 1.

General Formula (Q-II)

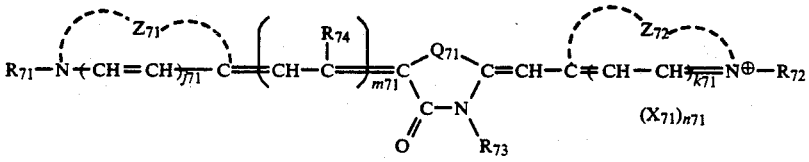

In the above formula, $Z_{71}$ and $Z_{72}$ each has the same meaning as the symbol $Z_{61}$ or $Z_{62}$ mentioned above. $R_{71}$ and $R_{72}$ each has the same meaning as $R_{61}$ or $R_{62}$, $R_{73}$ is an alkyl, alkenyl or alkynyl group or an aryl group (e.g. substituted or unsubstituted phenyl). $m_{71}$ represents 2 or 3. $R_{74}$ is a hydrogen atom or a lower alkyl or aryl group or may be connected to another $R_{74}$ to form a carbocycle or heterocycle. These rings are preferably 5- or 6-membered.

$Q_{71}$ is a sulfur, oxygen or selenium atom or $=N-R_{75}$ in which $R_{75}$ has the same meaning as $R_{73}$. $j_{71}$, $k_{61}$, $X_{61}^-$ and $n_{61}$ each has the same meaning as $j_{61}$, $k_{61}$, $X_{61}^{\ominus}$, and $n_{61}$, respectively.

General Formula (Q-III)

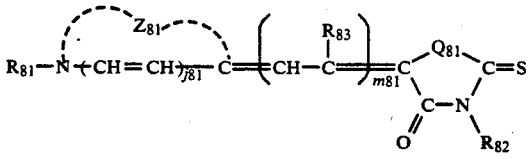

In the above formula, $Z_{81}$ is a group of atoms necessary for forming a heterocycle. Examples of the heterocycle include those examples mentioned for $Z_{61}$ and $Z_{62}$ as well as thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline and naphthimidazoline and like nuclei.

$Q_{81}$ has the same meaning as $Q_{71}$. $R_{81}$ has the same meaning as $R_{61}$ or $R_{62}$ and $R_{82}$ has the same meaning as $R_{73}$. The symbol $m_{81}$ represents 2 or 3. $R_{83}$ has the same meaning as $R_{74}$ and furthermore may be connected to another $R_{83}$ to form a carbocycle or heterocycle $j_{81}$ has the same meaning as $j_{61}$.

Among the sensitizing dyes of general formula (Q-I), those in which the heterocyclic nuclei or nucleus Z61 and/or $Z_{62}$ is the naphthothiazole, naphthoselenazole, naphthoxazole, naphthimidazole or 4-quinoline nucleus are preferred. The same applies to $Z_{71}$ and/or $Z_{72}$ in general formula (Q-II) and also to $Z_{81}$ in general formula (Q-III). Furthermore, those sensitizing dyes in which the methine chain includes a carbocycle or heterocycle are preferred.

In infrared sensitization, M band sensitization of the sensitizing dyes is used. The spectral sensitiviity distribution is broader as compared with J band sensitization. Therefore, the spectral sensitivity distribution should preferably be corrected by providing a dye-containing colored colloid layer disposed on the side of the photosensitive layer concerned which is closer to the exposure side. Such colored layer is effective in preventing color mixing through its filter effect.

Preferred as the infrared sensitizing dyes are those compounds which have a reduction potential value of −1.05 (V vs SCE) or lower, more preferably −1.10 or lower. Those sensitizing dyes having such characteristics are advantageously used for higher levels of sensitization, preferably for sensitivity stabilization or latent image stabilization.

The reduction potential can be measured by phase discriminating second harmonic AC polarography. A dropping mercury electrode is used as the working electrode, a saturated calomel electrode as the reference electrode and a platinum electrode as the counter electrode.

Another applicable method of reduction potential measurement by phase discriminating second harmonic AC voltammetry using platinum as the working electrode is described in *Journal of Imaging Science*, 30, 27–35 (1986).

Specific examples of the sensitizing dyes of general formulas (Q-I), (Q-II) and (Q-III) are shown below.

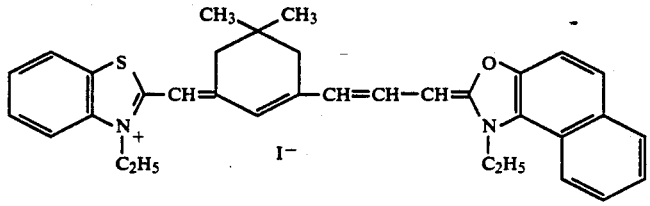

(Q-1)

-continued
(Q-2)
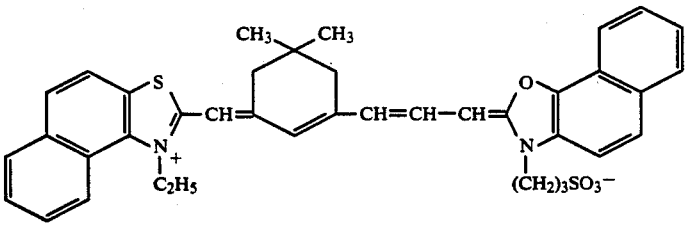
(Q-3)
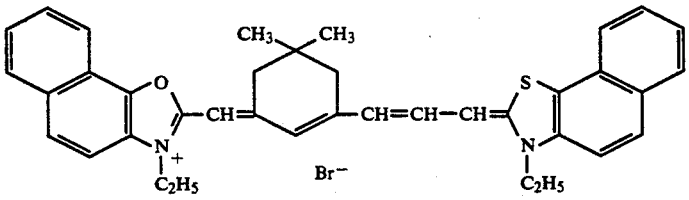
(Q-4)
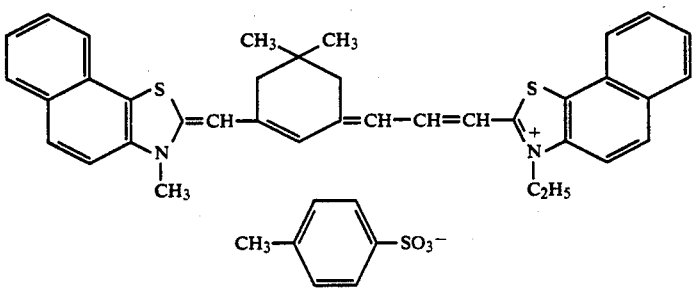
(Q-5)
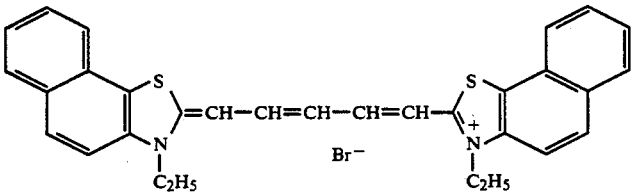
(Q-6)
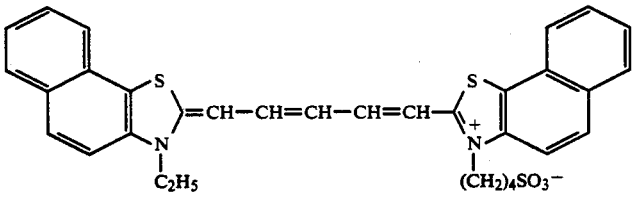
(Q-7)
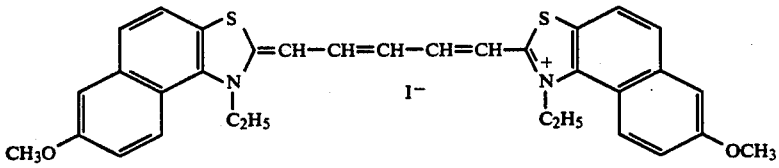
(Q-8)
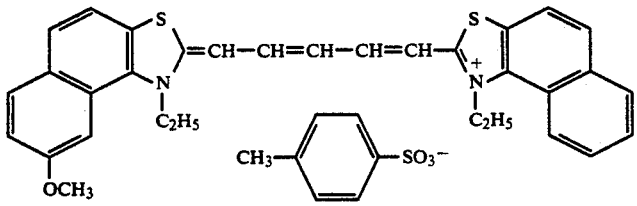

-continued
(Q-9)
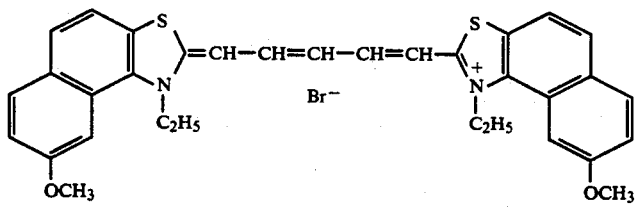
(Q-10)
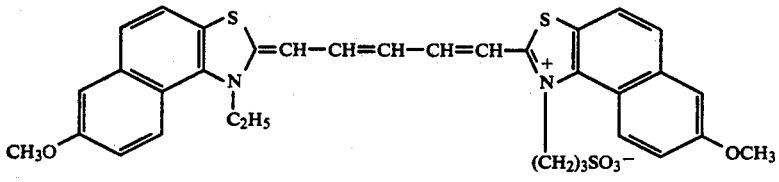
(Q-11)
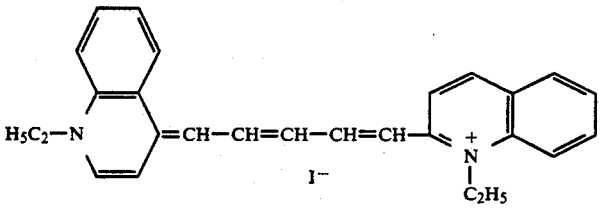
(Q-12)
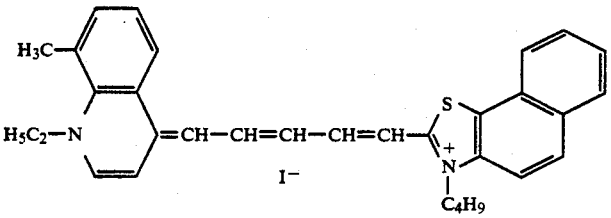
(Q-13)
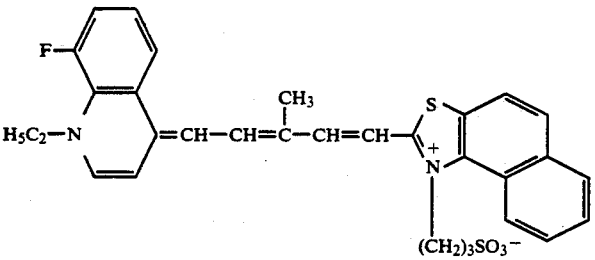
(Q-14)
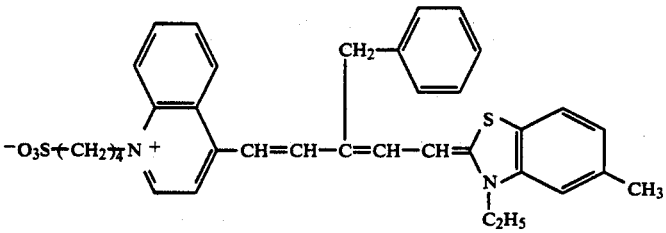
(Q-15)
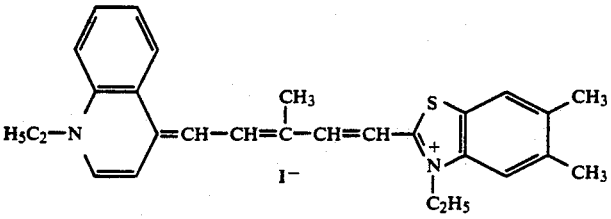

-continued
(Q-16)
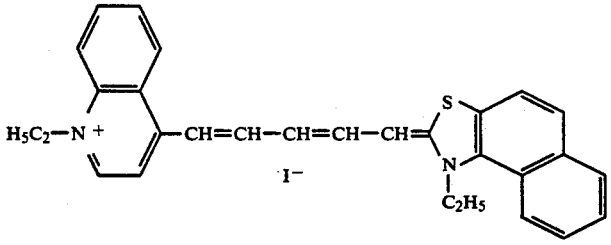
(Q-18)
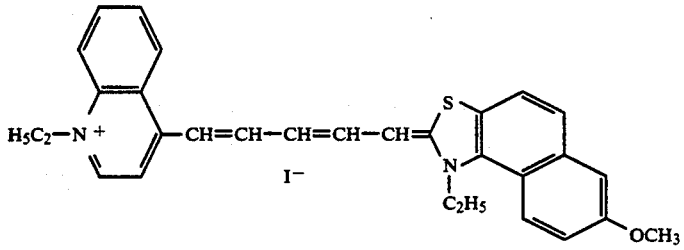
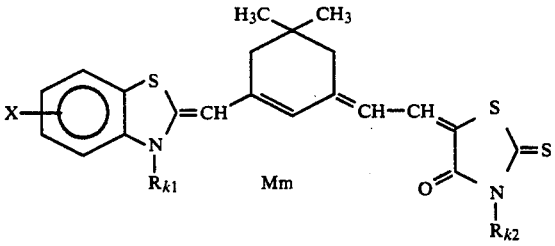
| Compound No. | $R_{k1}$ | $R_{k2}$ | X | M | m |
|---|---|---|---|---|---|
| (Q-18) | $C_2H_5$ | $C_2H_5$ | H | — | — |
| (Q-19) | $C_2H_5$ | $C_2H_5$ | 6,7-Benzo | — | — |
| (Q-20) | $C_2H_5$ | $C_2H_5$ | 4,5-Benzo | — | — |
| (Q-21) | $C_2H_5$ | $C_2H_5$ | 5,6-$(OCH_3)_2$ | — | — |
| (Q-22) | $(CH_2)_4SO_3^{\ominus}$ | $C_2H_5$ | 6,7-Benzo | $HN^{\oplus}(C_2H_5)_3$ | 1 |
| (Q-23) | $C_2H_5$ | $(CH_2)_2SO_3^{\ominus}$ | 6,7-Benzo | $HN^{\oplus}(C_2H_5)_3$ | 1 |
| (Q-24) | $(CH_2)_4CH_3$ | $C_2H_5$ | 5,6-$(CH_3)_2$ | — | — |
| (Q-25) | $(CH_2)_3CO_2H$ | $C_2H_5$ | 6-$CH_3$ | — | — |
| (Q-26) | $(CH_2)_3CH_3$ | $CH_2CO_2H$ | 6,7-Benzo | — | — |
| (Q-27) | $(CH_2)_2OCH_3$ | $C_2H_5$ | 4,5-Benzo | — | — |
(Q-28)
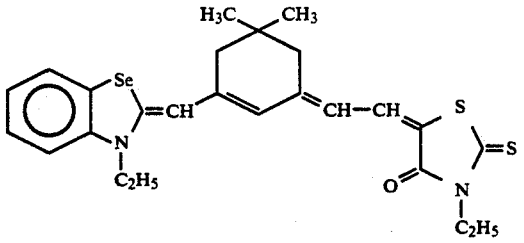
(Q-29)
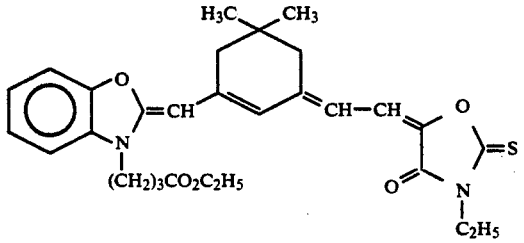

-continued
(Q-30)
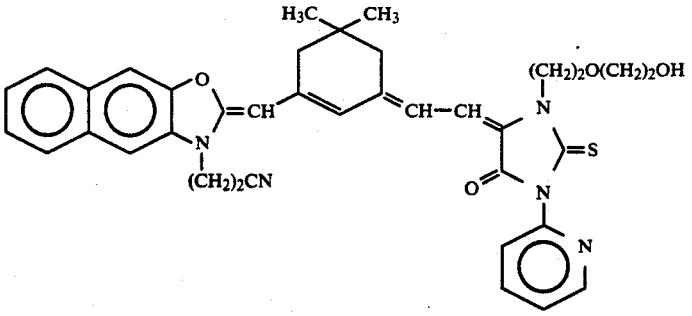
(Q-31)
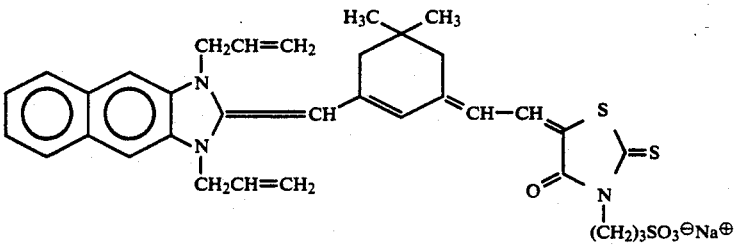
(Q-32)
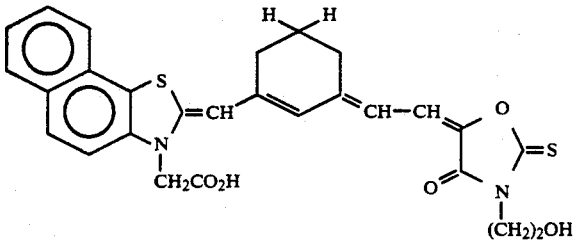
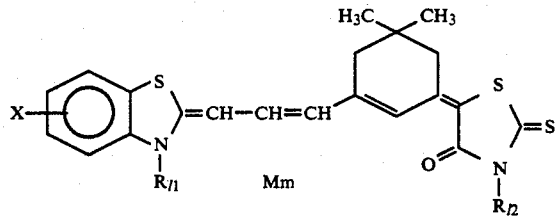
| Compound No. | $R_{l2}$ | $R_{l2}$ | X | M | m |
|---|---|---|---|---|---|
| (Q-33) | $C_2H_5$ | $C_2H_5$ | 6,7-Benzo | — | — |
| (Q-34) | $C_2H_5$ | $C_2H_5$ | 4,5-Benzo | — | — |
| (Q-35) | $C_2H_5$ | $C_2H_5$ | 5,6-$(OCH_3)_2$ | — | — |
| (Q-36) | $CH_2CO_2H$ | $(CH_2)_3CH_3$ | 5,6-$(CH_3)_2$ | — | — |
| (Q-37) | $(CH_2)_3SO_3^{\ominus}$ | $CH_3$ | H | 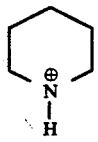 | 1 |
| (Q-38) | $(CH_2)_5CH_3$ | $(CH_2)_2SO_3^{\ominus}$ | 6,7-Benzo | $NH^{\oplus}(C_2H_5)_3$ | 1 |
| (Q-39) | $(CH_2)_3CN$ | $CH_2OCH_3$ | 4,5-Benzo | — | — |
| (Q-40) | $(CH_2)_2OC_2H_5$ | $C_2H_5$ | 6-Cl | — | — |
| (Q-41) | $SO_3^{\ominus}$ \| $(CH_2)_2CHCH_3$ | $(CH_2)_2CH_3$ | 6-$CH_3$ | $K^{\oplus}$ | 1 |
| (Q-42) | $(CH_2)_2SCH_3$ | $(CH_2)_3CO_2H$ | 6-$OCH_3$ | — | — |

(Q-43)
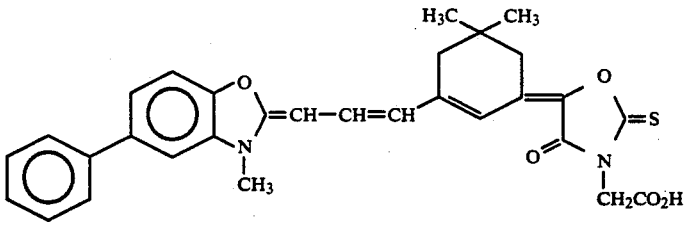
(Q-44)
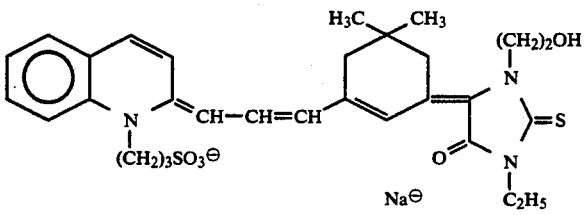
(Q-45)
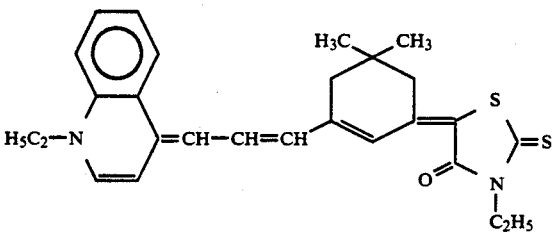
(Q-46)
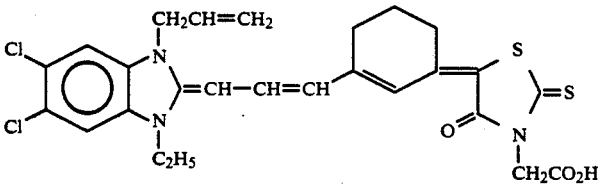
(Q-47)
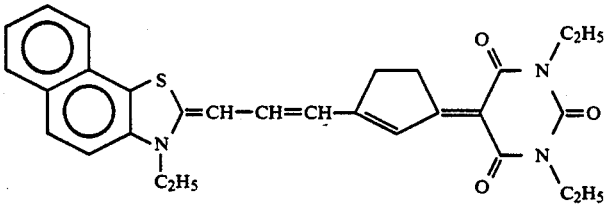
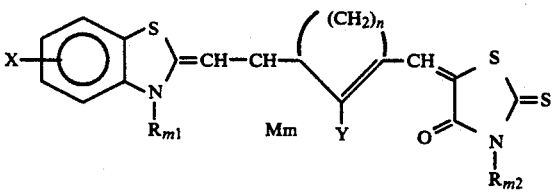
| Compound No. | $R_{m1}$ | $R_{m2}$ | Y | X | n | M | m |
|---|---|---|---|---|---|---|---|
| (Q-48) | $C_2H_5$ | $C_2H_5$ | H | 6,7-Benzo | 2 | — | — |
| (Q-49) | $C_2H_5$ | $C_2H_5$ | H | 6,7-Benzo | 3 | — | — |
| (Q-50) | $CH_2CO_2H$ | $C_2H_5$ | Cl | 6,7-Benzo | 3 | — | — |
| (Q-51) | $(CH_2)_3SO_3^{\ominus}$ | $CH_3$ | $NPh_2$ | 4,5-Benzo | 2 | $HN^{\oplus}(C_2H_5)_3$ | 1 |
| (Q-52) | $(CH_2)_2OCH_3$ | $CH_3CO_2H$ | H | 5,6-$(CH_3)_2$ | 4 | — | — |
| (Q-53) | $(CH_2)_7CH_3$ | $(CH_2)_2SO_3^{\ominus}$ | 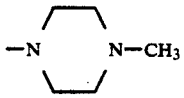 | 5,6-$(OCH_3)_2$ | 3 | $Na^{\oplus}$ | 1 |

-continued
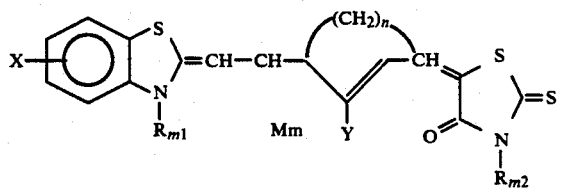
| Compound No. | $R_{m1}$ | $R_{m2}$ | Y | X | n | M | m |
|---|---|---|---|---|---|---|---|
| (Q-54) | $(CH_2)_2OH$ | $CH_3$ | 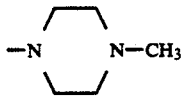 | 6-$CH_3$ | 2 | — | — |
(Q-55)
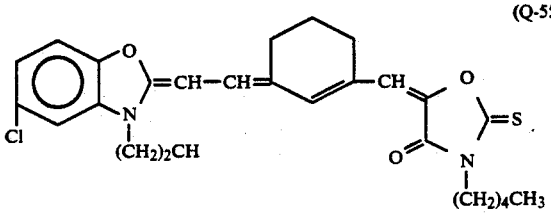
(Q-56)
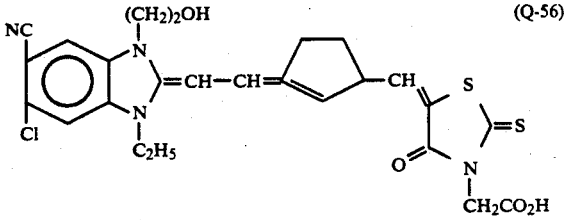
(Q-57)
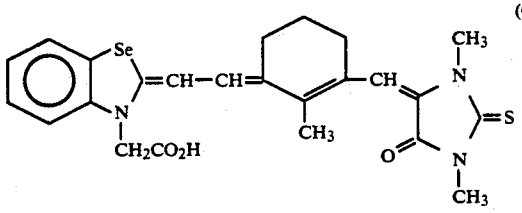
(Q-58)
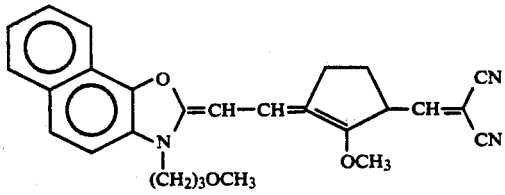
-continued
(Q-59)
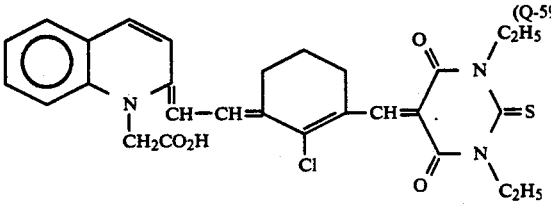
(Q-60)
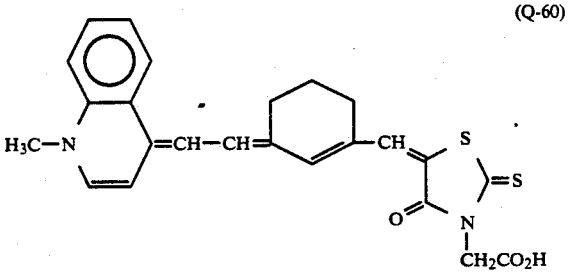
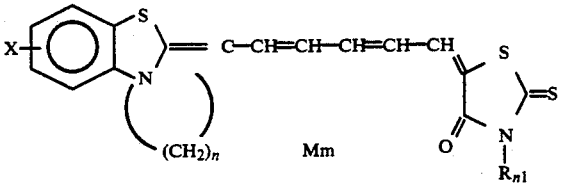
| Compound No. | $R_{n1}$ | X | n | M | m |
|---|---|---|---|---|---|
| (Q-61) | $C_2H_5$ | 6,7-Benzo | 2 | — | — |
| (Q-62) | $C_2H_5$ | 6,7-Benzo | 3 | — | — |
| (Q-63) | $C_2H_5$ | 6,7-Benzo | 4 | — | — |
| (Q-64) | $CH_2CO_2H$ | 4,5-Benzo | 3 | — | — |
| (Q-65) | $(CH_2)_4CH_3$ | $(CH_2)_2SO_3^{\ominus}$ | 3 | $HN^{\oplus}(C_2H_5)_3$ | 1 |
| (Q-66) | $(CH_2)_2OH$ | H | 2 | — | — |
| (Q-67) | $(CH_2)_3SO_3^{\ominus}$ | $CH_2CO_2H$ | 4 | $K^{\oplus}$ | 1 |
(Q-68)
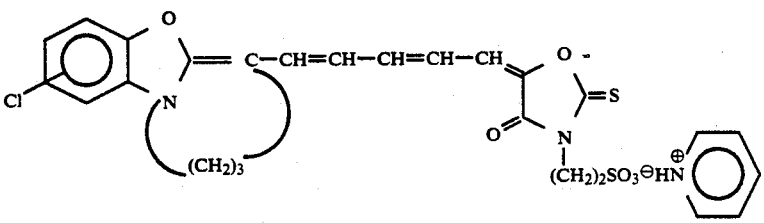

-continued
(Q-69)
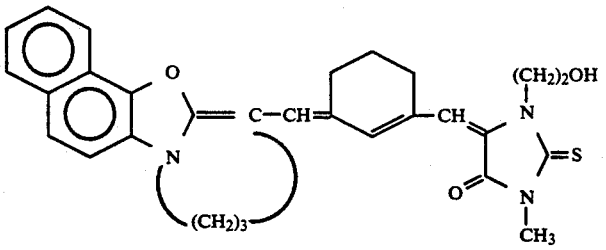
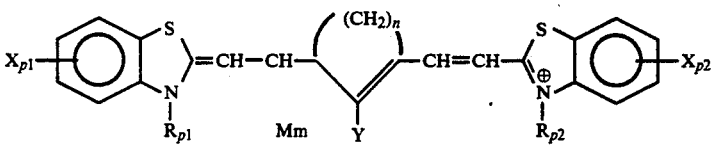
| Compound No. | $R_{p1}$ | $R_{p2}$ | $X_{p1}$ | $X_{p2}$ | | n | M | m |
|---|---|---|---|---|---|---|---|---|
| (Q-70) | $C_2H_5$ | $C_2H_5$ | H | H | H | 2 | $I^{\ominus}$ | 1 |
| (Q-71) | $C_2H_5$ | $C_2H_5$ | H | H | $N(CH_3)Ph$ | 2 | $I^{\ominus}$ | 1 |
| (Q-72) | $C_2H_5$ | $C_2H_5$ | H | H | Cl | 3 | $I^{\ominus}$ | 1 |
| (Q-73) | $CH_2CO_2H$ | $C_2H_5$ | H | H | $N-Ph_2$ | 2 | $Br^{\ominus}$ | 1 |
| (Q-74) | $(CH_2)_3SO_3^-$ | $C_2H_5$ | H | H | H | 2 | $Cl^{\ominus}$ | 1 |
| (Q-75) | $(CH_2)_4CH_3$ | $C_2H_5$ | 6-$CH_3$ | H | H | 3 | $H_3C-C_6H_4-SO_3^{\ominus}$ | 1 |
| (Q-76) | $(CH_2)_4SO_3^{\ominus}$ | $(CH_2)_4SO_3^{\ominus}$ | H | H | $OCH_3$ | 3 | $HN(C_2H_5)_3^{\oplus}$ | 1 |
| (Q-77) | $CH_3$ | $C_2H_5$ | 6,7-Benzo | 5-$CH_3$ | $CH_3$ | 4 | $I^{\ominus}$ | 1 |
(Q-78)
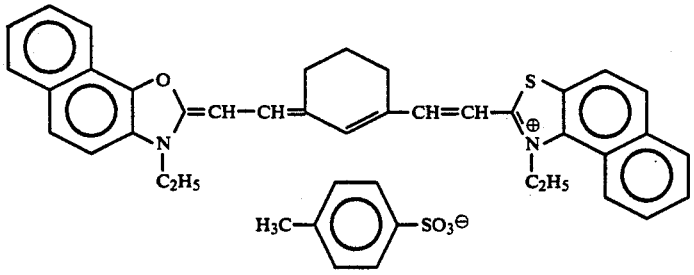
(Q-79)
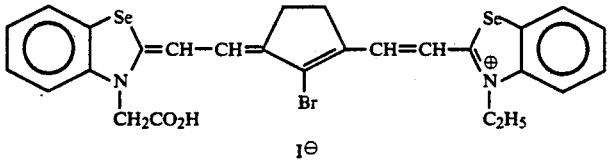

-continued
(Q-80)
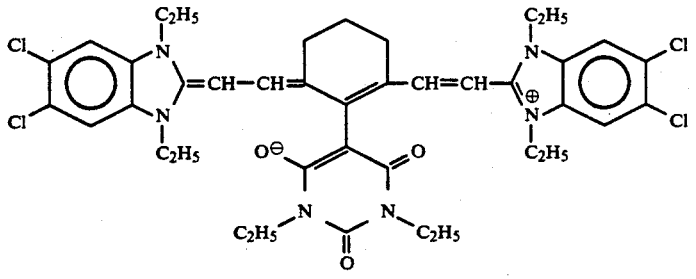
(Q-81)
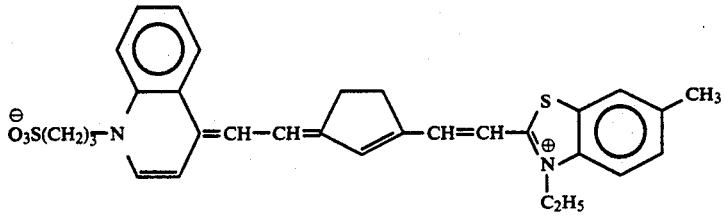
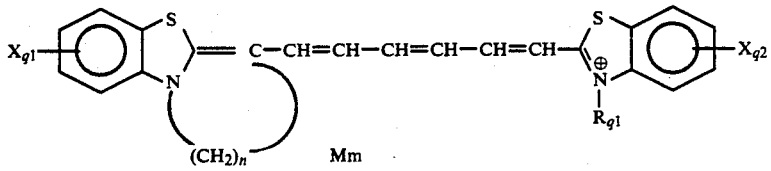
| Compound No. | $R_{q1}$ | $X_{q1}$ | $X_{q2}$ | n | M | m |
|---|---|---|---|---|---|---|
| (Q-82) | $C_2H_5$ | 6,7-Benzo | H | 2 | $I^{\ominus}$ | 1 |
| (Q-83) | $(CH_2)_3SO_3^{\ominus}$ | 4,5-Benzo | 4,5-Benzo | 3 | — | — |
| (Q-84) | $(CH_2)_2CO_2H$ | 6,7-Benzo | 5,6-$(OCH_3)_2$ | 4 | $I^{\ominus}$ | 1 |
| (Q-85) | $(CH_2)_4CH_3$ | 5,6-$(CH_3)_2$ | 5-Cl | 3 | $Br^{\ominus}$ | 1 |
| (Q-86) | $(CH_2)_2CN$ | H | H | 2 | 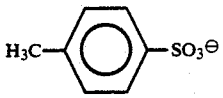 | 1 |
(Q-87)
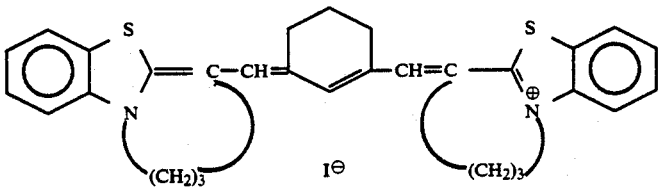
(Q-88)
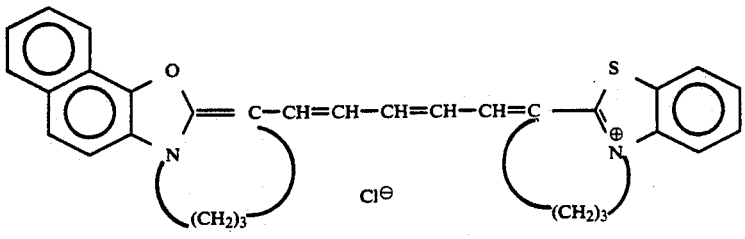

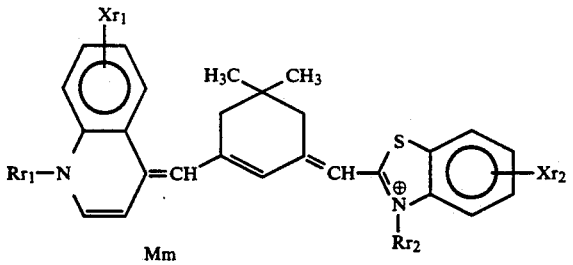
Mm
| Compound No. | $Rr_1$ | $Rr_2$ | $Xr_1$ | $Xr_2$ | M | m |
|---|---|---|---|---|---|---|
| (Q-89) | $C_2H_5$ | $C_2H_5$ | H | H | $I^{\ominus}$ | 1 |
| (Q-90) | $(CH_2)_4CH_3$ | $C_2H_5$ | 6-$CH_3$ | 4,5-Benzo | $Br^{\ominus}$ | 1 |
| (Q-91) | $(CH_2)_3SO_3^{\ominus}$ | $CH_3$ | 8-$OCH_3$ | 5,6-$(OCH_3)_2$ | — | — |
| (Q-92) | $(CH_2)_3SO_3^{\ominus}$ | $(CH_2)_3SO_3^{\ominus}$ | H | 6,7-Benzo | 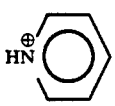 | 1 |
| (Q-93) | $CH_2CO_2H$ | $CH_2CO_2H$ | 6-Cl | 5,6-$(CH_3)_2$ | $I^{\ominus}$ | 1 |
| (Q-94) | $(CH_2)_2OCH_3$ | $(CH_2)_3CH_3$ | 6-Br | 5-Cl | $Cl^{\ominus}$ | 1 |
(Q-95)
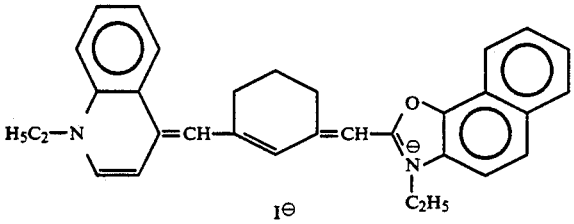
(Q-96)
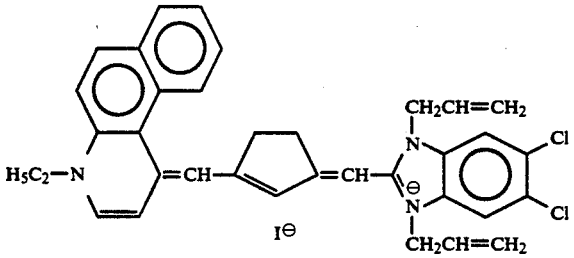
(Q-97)
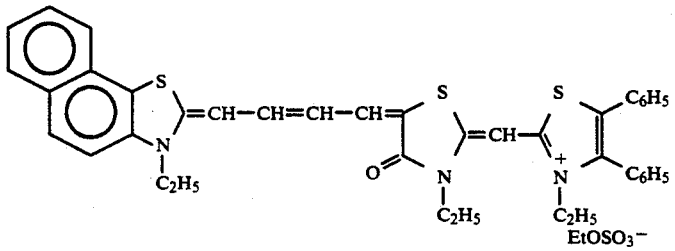

-continued
(Q-98)
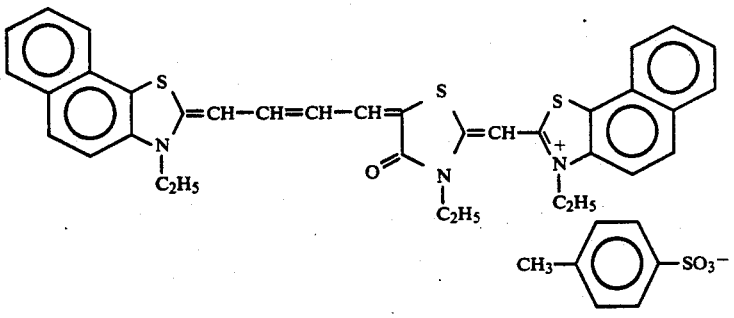
(Q-99)
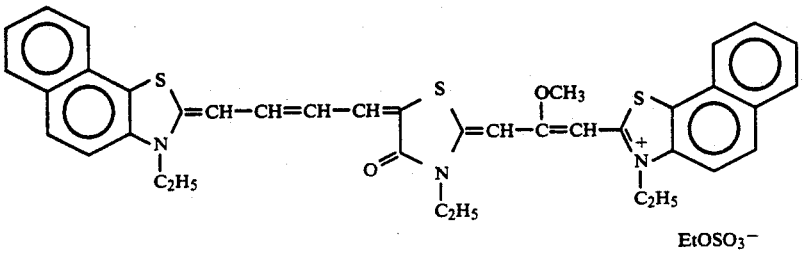
(Q-100)
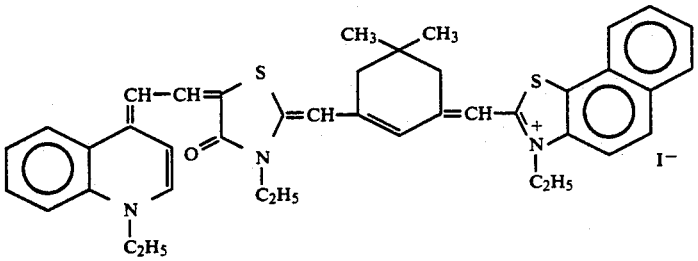
(Q-101)
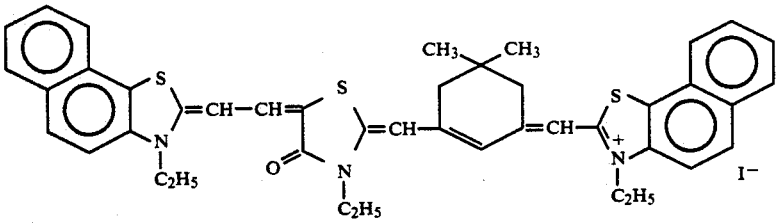
(Q-102)
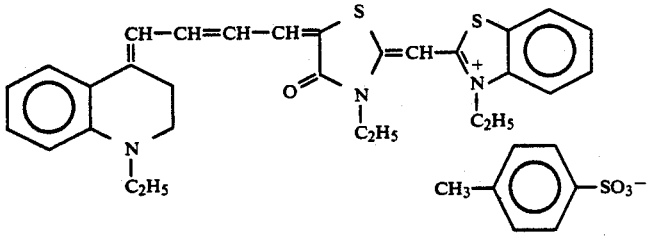
(Q-103)
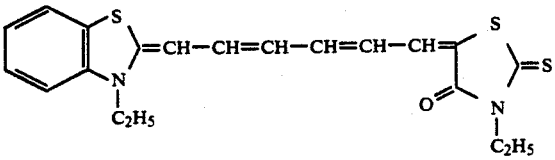

-continued
(Q-104)
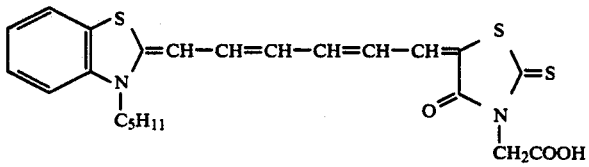
(Q-105)
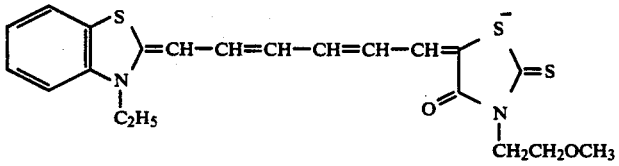
(Q-106)
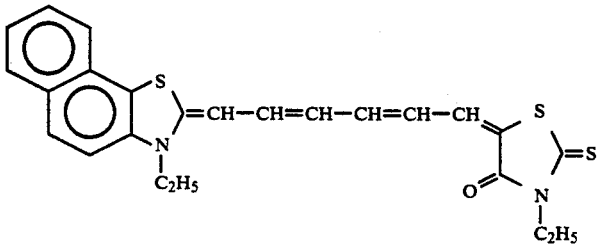
(Q-107)
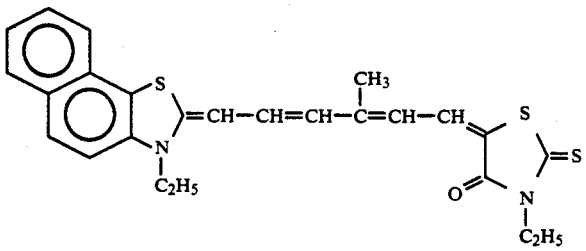
(Q-108)
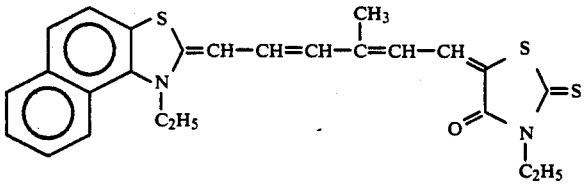
(Q-109)
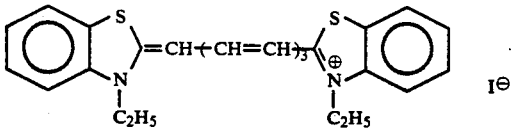
(Q-110)
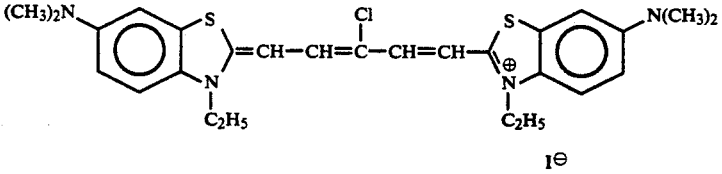
(Q-111)
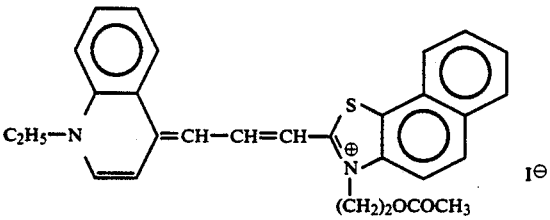

-continued (Q-112)

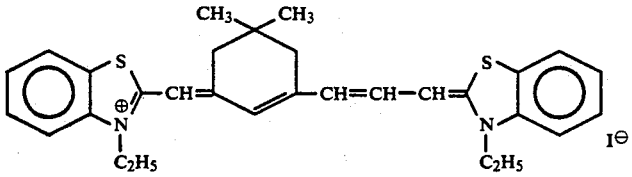

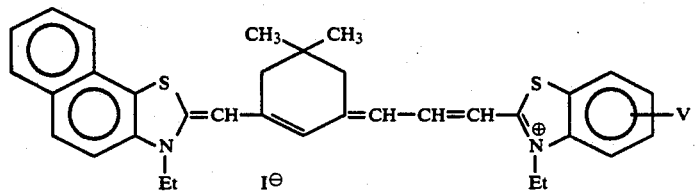

| | V |
|---|---|
| (Q-113) | H |
| (Q-114) | 6-$CH_3$ |
| (Q-115) | 5-$CH_3$ |
| (Q-116) | 6-$OCH_3$ |
| (Q-117) | 5-$OCH_3$ |
| (Q-118) | 5,6-$(CH_3)_2$ |
| (Q-119) | 5,6-$(OCH_3)_2$ |

These spectrally sensitizing dyes may be directly dispersed in the silver halide emulsion or may be dissolved in a solvent, such as water, methanol, ethanol, propanol, methylcellosolve or 2,2,3,3-tetrafluoropropanol, or a mixed solvent composed of such solvents, followed by addition of the solution to the emulsion. Aqueous solutions of such dyes may contain an acid or base, as described in JP-B-44-23389, JP-B-44-27555 and JP-B-57-22089 (the term "JP-B" as used herein means an "examined Japanese patent publication"), or the dyes may be added to the emulsion in the form of an aqueous solution or colloidal dispersion containing a surfactant, as described in U.S. Pat. Nos. 3,822,135 and 4,006,025. The dyes may be dissolved in a solvent substantially immiscible with water, such as phenoxyethanol, followed by adding the solution to water or a hydrophilic colloid for dispersion and further followed by addition of the dispersion to the emulsion. They may be directly dispered in a hydrophilic colloid for addition of the resulting dispersion to the emulsion, as described in JP-A-53-102733 and JP-A-58-105141. The time of addition to the emulsion may be at any step in the emulsion preparation process that is known to be adequate. Thus, this time can be selected from among the following: before or during silver halide emulsion grain formation, directly after grain formation to immediately before the washing step, before or during chemical sensitization, directly after chemical sensitization to emulsion cooling for solidification, and in coating solution preparation. While, most generally, the addition is performed during the period after completion of chemical sensitization but before coating, it is also possible to add them simultaneously with a chemical sensitizer for simultaneous spectral sensitization and chemical sensitization, as described in U.S. Pat. Nos. 3,628,969 and 4,225,666, or add them prior to chemical sensitization, as described in JP-A-58-113928, or add them before completion of silver halide grain precipitation, for initiating spectral sensitization. Furthermore, it is possible to add a spectrally sensitizing dye in portions, namely add a portion thereof before chemical sensitization and the remainder after chemical sensitization, as taught in U.S. Pat. No. 4,225,666, or follow the method taught in U.S. Pat. No. 4,183,756. Thus, any time in the process of silver halide grain formation may be employed. It is particularly preferable, among others, to add the sensitizing dyes before the step of emulsion washing with water or before chemical sensitization.

The level of addition of the spectrally sensitizing dyes may be selected within a wide range, but preferably within the range of $0.5\times10^{-6}$ to $1.0\times10^{-2}$ mol, more preferably $1.0\times10^{-6}$ to $5.0\times10^{-3}$ mol, per mol of silver halide.

In red or infrared sensitization in the practice of the invention, supersensitization with a compound of the general formula (A), (B), (Ea) (Eb) or (Ec) shown below is preferable for. M band sensitization.

The combined use of a supersensitizer of general formula (A) and a supersensitizer of general formula (B), (Ea), (Eb) or (Ec) can specifically increase the supersensitizing effect.

General Formula (A)

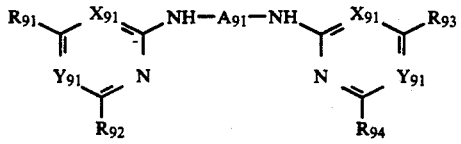

In formula (A), A91 is a divalent aromatic residue. $R_{91}$, $R_{92}$, $R_{93}$ and $R_{94}$ each is a hydrogen or halogen atom or a hydroxyl, alkyl, alkoxy, aryloxy, heterocyclic, alkylthio, heterocyclic thio, arylthio, amino, alkylamino, arylamino, heterocyclicamino, aralkylamino, aryl or mercapto group, which may optionally be substituted. It is necessary, however, that at least one of $A_{91}$, $R_{91}$, $R_{92}$, $R_{93}$ and $R_{94}$ should contain a sulfo group. One of $X_{91}$ and $Y_{91}$ is —N= and the Other is —CH= or —N=.

More specifically, —$A_{91}$— in general formula (A) is a divalent aromatic residue which optionally contains —$SO_3M$ (in which M is a hydrogen atom or a cation capable of providing water solubility, e.g. sodium or potassium).

Preferably, —$A_{91}$— is selected from among the residues —$A_{92}$— and —$A_{93}$— shown below. When neither of $R_{91}$, $R_{92}$, $R_{93}$ and $R_{94}$ contains a —$SO_3M_{91}$ group, however, —$A_{91}$— should be selected from the —$A_{92}$— group.

—$A_{92}$—:

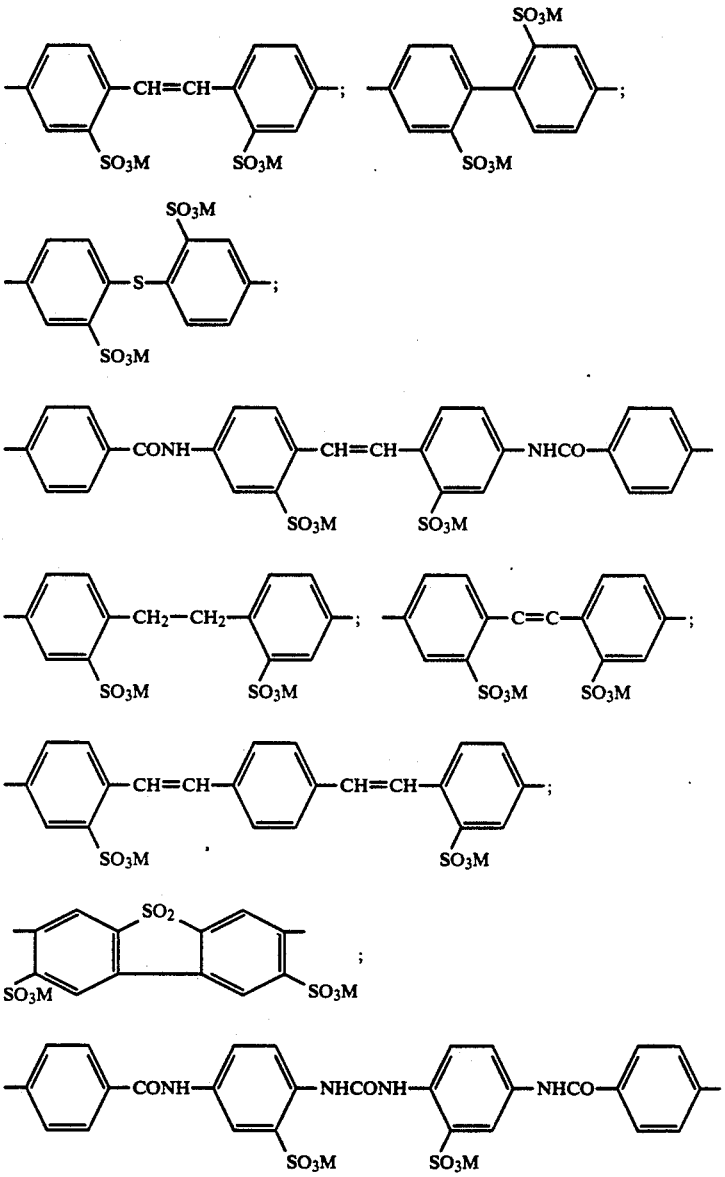

(in the above formulas M is a hydrogen atom or a cation capable of providing water solubility);

—$A_{93}$—:

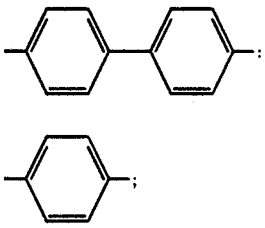

-continued

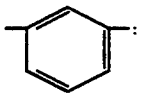

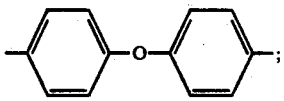

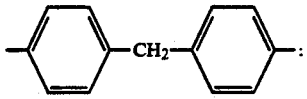

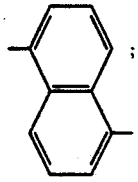

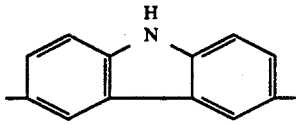

In more detail, $R_{91}$, $R_{92}$, $R_{93}$ and $R_{94}$ each is a hydrogen atom, a hydroxyl group, an alkyl group (preferably containing 1–8 carbon atoms; e.g. methyl, ethyl, n-propyl, n-butyl), an alkoxy group (preferably containing 1–8 carbon atoms; e.g. methoxy, ethoxy, propoxy, butoxy), an aryloxy group (e.g. phenoxy, naphthoxy, o-tolyloxy, p-sulfophenoxy), a halogen atom (e.g. chlorine atom, bromine atom), a heterocyclic nucleus (e.g. morpholinyl, piperidyl), an alkylthio group (e.g. methylthio, ethylthio), a heterocyclic thio group (e.g. benzothiazolylthio, benzimidazolylthio, phenyltetrazolylthio), an arylthio group (e.g. phenylthio, tolylthio), an amino group, an alkylamino or substituted alkylamino group (e.g. methylamino, ethylamino, propylamino, dimethylamino, diethylamino, dodecylamino, cyclohexylamino, β-hydroxyethylamino, di(8-hydroxyethyl)amino, β-sulfoethylamino), an arylamino or substituted arylamino group (e.g. anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g. 2-benzothiazolylamino, 2-pyridylamino), a substituted or unsubstituted aralkylamino group (e.g. benzylamino, o-anisylamino, m-anisylamino, p-anisylamino), an aryl group (e.g. phenyl) or a mercapto group.

$R_{91}$, $R_{92}$, $R_{93}$ and $R_{94}$ may be the same or different from one another.

When $—A_{91}—$ is selected from the class of groups represented by $—A_{93}—$, it is necessary that at least one of $R_{91}$, $R_{92}$, $R_{93}$ and $R_{94}$ should have a sulfo group (which may be in the free acid form or in a salt form). $X_{91}$ and $Y_{91}$ each is —CH= or —N=. It is preferable that $X_{91}$ is —CH= and $Y_{91}$ is —N=.

The following are typical examples of the compounds of general formula (A). It is to be noted, however, that they are by no means limitative of the scope of the present invention.

| | |
|---|---|
| (A-1) | 4,4'-Bis[2,6-di(2-naphthoxy)pyrimidin-4-ylamino]stilbene-2,2'-disulfonic acid disodium salt |
| (A-2) | 4,4'-Bis[2,6-di(2-naphthylamino)pyrimidin-4-ylamino]stilbene-2,2'-disulfonic acid disodium salt |
| (A-3) | 4,4'-Bis(2,6-dianilinopyrimidin-4-ylamino)-stilbene-2,2'-disulfonic acid disodium salt |
| (A-4) | 4,4'-Bis[2-(2-naphthylamino)-6-anilinopyrimidin-4-ylamino]stilbene-2,2'-disulfonic acid disodium salt |
| (A-5) | 4,4'-Bis(2,6-diphenoxypyrimidin-4-ylamino)-stilbene-2,2'-disulfonic acid triethylammonium salt |
| (A-6) | 4,4'-Bis[2,6-di(2-benzimidazolyl-2-thio)pyrimidin-4-ylamino]stilbene-2,2'-disulfonic acid disodium salt |
| (A-7) | 4,4'-Bis[4,6-di(benzothiazolyl-2-thio)pyrimidin-2-ylamino]stilbene-2,2'-disulfonic acid disodium salt |
| (A-8) | 4,4'-Bis[4,6-di(benzothiazolyl-2-amino)pyrimidin-2-ylamino]stilbene-2,2'-disulfonic acid disodium salt |
| (A-9) | 4,4'-Bis[4,6-di(naphthyl-2-oxy)pyrimidin-2-ylamino]stilbene-2,2'-disulfonic acid disodium salt |
| (A-10) | 4,4'-Bis(4,6-diphenoxypyrimidin-2-ylamino]-stilbene-2,2'-disulfonic acid disodium salt |
| (A-11) | 4,4'-Bis(4,6-diphenylthiopyrimidin-2-ylamino]-stilbene-2,2'-disulfonic acid disodium salt |
| (A-12) | 4,4'-Bis(4,6-dimercaptopyrimidin-2-ylamino]-biphenyl-2,2'-disulfonic acid disodium salt |
| (A-13) | 4,4'-Bis(4,6-dianilinotriazin-2-ylamino]-stilbene-2,2'-disulfonic acid disodium salt |
| (A-14) | 4,4'-Bis(4-anilino-6-hydroxytriazin-2-ylamino]-stilbene-2,2'-disulfonic acid disodium salt |
| (A-15) | 4,4'-Bis[4,6-di(naphthyl-2-oxy)pyrimidin-2-ylamino]dibenzyl-2,2'-disulfonic acid disodium salt |
| (A-16) | 4,4'-Bis(4,6-dianilinopyrimidin-2-ylamino]- |

-continued

| | |
|---|---|
| | stilbene-2,2'-disulfonic acid disodium salt |
| (A-17) | 4,4'-Bis[4-chloro-6-(2-naphthyloxy)pyrimidin-2-ylamino]diphenyl-2,2'-disulfonic acid disodium salt |
| (A-18) | 4,4'-Bis[4,6-di(1-phenyltetrazolyl-5-thio)-pyrimidin-2-ylamino]stilbene-2,2'-disulfonic acid disodium salt |
| (A-19) | 4,4'-Bis[4,6-di(benzimidazolyl-2-thio)pyrimidin-2-ylamino]stilbene-2,2'-disulfonic acid disodium salt |
| (A-20) | 4,4'-Bis(4-naphthylamino-6-anilinotriazin-2-yl-amino]stilbene-2,2'-disulfonic acid disodium salt |

Among the examples mentioned above, (A-1) to (A-6), (A-9), (A-15) and (A-20) are preferred and (A-1), (A-2), (A-4), (A-5), (A-9), (A-15) and (A-20) are particularly preferred.

The compound of general formula (A) is generally used in an amount of 0.01 to 5 grams per mol of silver halide, and preferably in an amount within the range of 5 to 2,000 parts, more preferably 20 to 1,500 parts per part of the sensitizing dye on a weight basis. It is preferable that this compound be used in combination with a compound of general formula (B).

Compounds of general formula (B) are described below.

General Formula [B]

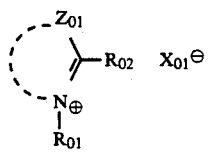

In the above formula, $Z_{01}$ is a group of nonmetal atoms necessary for completing a 5- or 6-membered nitrogen-containing heterocyclic ring. This heterocyclic ring may be condensed with a benzene or naphthalene ring. Thus, suitable examples include thiazoliums (e.g. thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), oxazoliums (e.g. oxazolium, 4-methyloxazolium, benzoxazolium, 5-chlorobenzoxazolium, 5-phenylbenzoxazolium, 5-methylbenzoxazolium, naphtho[1,2-d]oxazolium), imidazoliums (e.g. 1-methylbenzimidazolium, 1-propyl-5-chlorobenzimidazolium 1-ethyl-5,6-dichlorobenzimidazolium, 1-allyl-5-trifluoromethyl-6-chlorobenzimidazolium), and selenazoliums (e.g. benzoselenazolium, 5-chlorobenzoselenazolium, 5-methylbenzoselenazolium, 5-methoxybenzoselenazolium, naphtho[1,2-d]selenazolium), among others.

$R_{01}$ is a hydrogen atom, an alkyl group (preferably containing not more than 8 carbon atoms; e.g. methyl, ethyl, propyl, butyl, pentyl) or an alkenyl group (e.g. allyl).

$R_{02}$ is a hydrogen atom or a lower alkyl group (e.g. methyl, ethyl). $R_{01}$ and $R_{02}$ may be a substituted alkyl group.

$X_{01}$ is an acid anion (e.g. $Cl^-$, $Br^-$, $I^-$, $ClO_4^-$).

Among the groups mentioned for $Z_{01}$, thiazoliums are preferred and can be advantageously used. More preferred are substituted or unsubstituted benzothiazoliums and naphthothiazoliums. These and other $Z_{01}$ groups may be substituted even when specific mention thereof is not made above.

Typical examples of the compounds of general formula (B) are given below. It is to be noted that they are by no means limitative of the scope of the present invention.

(B-1)

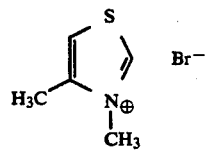

(B-2)

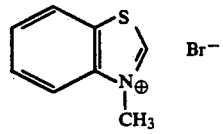

(B-3)

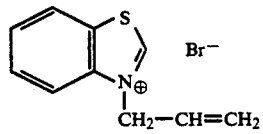

(B-4)

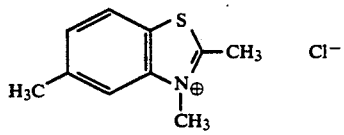

(B-5)

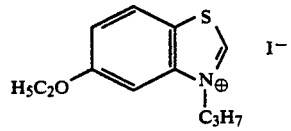

(B-6)

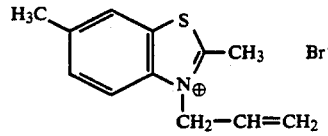

(B-7)

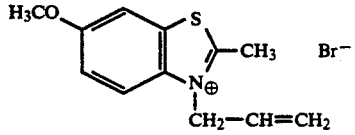

(B-8)

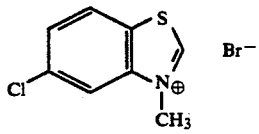

(B-9)

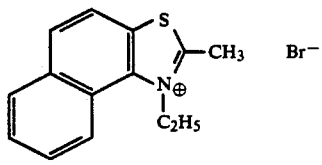

-continued (B-10)

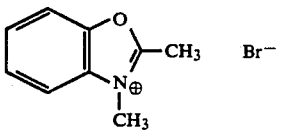

(B-11)

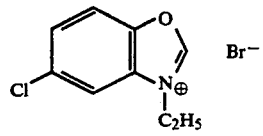

(B-12)

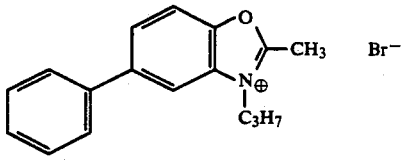

(B-13)

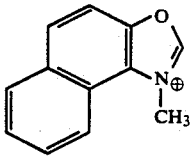

(B-14)

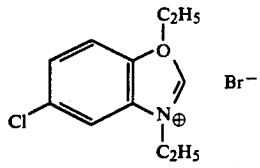

(B-15)

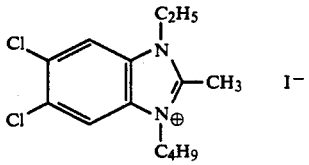

(B-16)

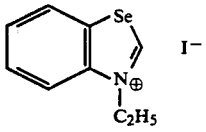

(B-17)

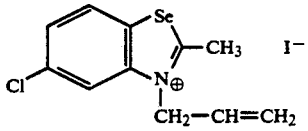

(B-18)

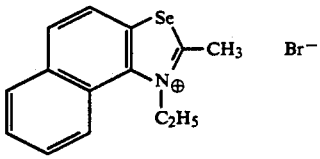

In the practice of the invention, the compound of general formula (B) is used preferably in an amount of about 0.01 to 5 grams per mol of silver halide in the emulsion.

The weight ratio between the infrared sensitizing dye and the compound of general formula (B) is preferably within the range of dye/compound (B)=1/1 to 1/300, more preferably within the range of ½ to 1/200.

In the practice of the invention, the compound of general formula (B) can be either dispersed directly in the emulsion or dissolved in an appropriate solvent (e.g. water, methyl alcohol, ethyl alcohol, propanol, methylcellosolve, acetone) or a mixed solvent composed of a plurality of such solvents for addition to the emulsion. It is further possible to add this compound to the emulsion in the form of a solution or a dispersion in a colloid as is often the case with sensitizing dyes.

The compound of general formula (B) may be added to the emulsion earlier or later than the addition of the sensitizing dye. Furthermore, it is also possible to dissolve the compound of general formula (B) and the sensitizing dye separately and add the respective solutions simultaneously to the emulsion or mix the solutions for addition of the resulting mixture to the emulsion.

It is preferable and advantageous to combine the combination of an infrared sensitizing dye and a compound of general formula (B) further with a compound of general formula (A).

In the infrared sensitized chloride-rich silver halide emulsion, the use of a mercapto-containing heterocyclic compound together with a supersensitizer of general formulas (A) or (B) can achieve not only high-level sensitization and fog restraint but also latent image stabilization and/or marked improvement in dependency of gradient linearity on development processing.

Suitable heterocyclic compounds include, among others, compounds having such a heterocyclic ring as a thiazole, oxazole, oxazine, thiazine, thiazoline, selenazole, imidazole, indoline, pyrrolidine, tetrazole, thiadiazole, quinoline or oxadiazole ring with a mercapto group as a substituent. The compounds derived from such compounds by substitution with one or more substituents each selected from among carboxyl, sulfo, carbamoyl, sulfamoyl and hydroxyl are particularly preferred. JP-B-43-22883 describes the use of mercaptoheterocyclic compounds as supersensitizers. In the practice of the present invention, such compounds are used in combination particularly with the compounds of general formula (B) to thereby produce significant antifogging and supersensitizing effects.

Furthermore, for red or infrared sensitization in the practice of the invention, formaldehyde condensates of a substituted or unsubstituted mono- or polyhydroxybenzene of the general formulas (Ea), (Eb) or (Ec) shown below with a condensation degree of 2 to 10 units are useful as supersensitizers. They are also effective in preventing latent image fading and gradient decrease.

General Formula (Ea)

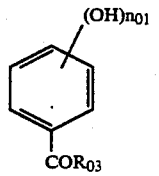

General Formula (Eb)

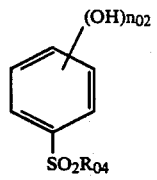

General Formula (Ec)

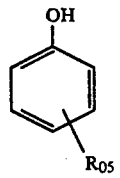

In the above formulas, $R_{03}$ and $R_{04}$ each is OH, $OM_{01}$, $OR_{06}$, $NH_2$, $NHR_{06}$, $—N(R_{06})_2$, $—NHNH_2$ or $—NHNHR_{06}$. $R_{06}$ is an alkyl group (consisting 1-8 carbon atoms), an aryl group or an aralkyl group. $M_{01}$ is an alkali metal or an alkaline earth metal. $R_{05}$ is OH or a halogen atom. $n_{01}$ and $n_{02}$ each is the integer 1, 2 or 3.

Typical examples of the substituted or unsubstituted mono- or polyhydroxybenzene component of the aldehyde condensate represented by formulas (Ea), (Eb) and (Ec) are given below. They are, however, by no means limitative of the scope of the present invention.

(E-1) β-Resorcyclic acid
(E-2) γ-Resorcyclic acid
(E-3) 4-Hydroxybenzoic acid hydrazide
(E-4) 3,5-dihydroxybenzoic acid hydrazide
(E-5) p-Chlorophenol
(E-6) Sodium hydroxybenzenesulfonate
(E-7) p-Hydroxybenzoic acid
(E-8) o-Hydroxybenzoic acid
(E-9) m-Hydroxybenzoic acid
(E-10) p-Dihydroxybenzene
(E-11) Gallic acid
(E-12) Methyl p-hydroxybenzoate
(E-13) o-Hydroxybenzenesulfonamide
(E-14) N-Ethyl-o-hydroxybenzamide

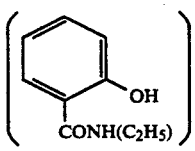

(E-15) N,N-Diethyl-o-hydroxybenzamide

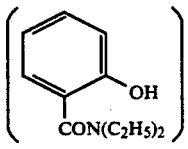

(E-16) o-Hydroxybenzoic acid 2-methylhydrazide

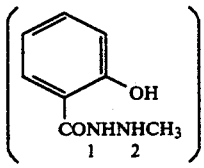

Further, suitable compounds falling within formulas (Ea), (Eb) and (Ec) can be selected from among derivatives of the compounds of general formulas (IIa), (IIb) and (IIc) described in JP-B-49-49504.

In applying the present invention to a color photosensitive material, as described above a yellow coupler, a magenta coupler and a cyan coupler are generally used in the color photosensitive material for forming a yellow dye, a magenta dye and a cyan dye, respectively, as a result of their coupling with the oxidized form of an aromatic amine color developing agent.

Cyan couplers, magenta couplers and yellow couplers that are represented by the general formula (C-I), (C-II), (M-I), (M-II), and (Y) shown below are preferably used in the practice of the invention.

General Formula (C-I)

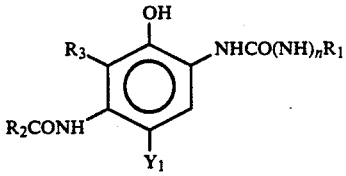

General Formula (C-II)

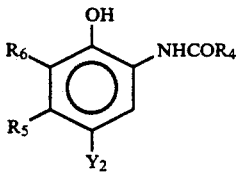

General Formula (M-I)

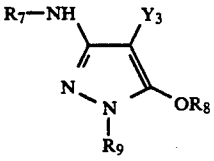

General Formula (M-II)

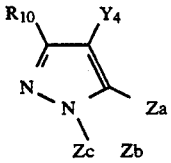

General Formula (Y)

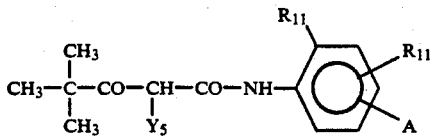

In general formulas (C-I) and (C-II), $R_1$, $R_2$ and $R_4$ each is an aliphatic, aromatic or heterocyclic group, any of which may be substituted or unsubstituted, and $R_3$, $R_5$ and $R_6$ each is a hydrogen or halogen atom, an aliphatic or aromatic group or an acylamino group. $R_3$ may also be a group of nonmetal atoms that can form a 5- or 6-membered nitrogen-containing heterocycle together with $R_2$. $Y_1$ and $Y_2$ each is a hydrogen atom or a leaving group which can be eliminated upon coupling with the oxidized developing agent. n represents 0 (zero) or 1.

In general formula (C-II), $R_5$ is preferably an aliphatic group. Examples include methyl, ethyl, propyl, butyl, pentadecyl, tert-butyl, cyclohexyl, cyclohexylmethyl, phenylthiomethyl, dodecyloxyphenylthiomethyl, butanamidomethyl and methoxymethyl.

Preferred examples of the cyan coupler of the general formulas (C-I) or (C-II) given above are as follows.

In general formula (C-I), $R_1$ is preferably an aryl or heterocyclic group, more preferably an aryl group substituted with one or more substituents each selected from among a halogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group and a cyano group.

When $R_3$ and $R_2$ in general formula (C-I) are not involved in ring formation, $R_2$ is preferably a substituted or unsubstituted alkyl or aryl group and, more preferably a substituted aryloxy-substituted alkyl group, and $R_3$ is preferably a hydrogen atom.

In general formula (C-II), $R_4$ is preferably a substituted or unsubstituted alkyl or aryl group, more preferably a subsituted aryloxy-substituted alkyl group.

In general formula (C-II), $R_5$ is preferably an alkyl group containing 2 to 15 carbon atoms or a methyl group having a substituent containing one or more carbon atoms. The substituent is preferably an arylthio, alkylthio, acylamino, aryloxy or alkyloxy group.

In general formula (C-II), $R_5$ is more preferably an alkyl group containing 2 to 15 carbon atoms, and most preferably an alkyl group containing 2 to 4 carbon atoms.

In general formula (C-II), $R_6$ is preferably a hydrogen or halogen atom, more preferably a chlorine or fluorine atom.

In general formulas (C-I) and (C-II), $Y_1$ and $Y_2$ each preferably is a hydrogen or halogen atom or an alkoxy, aryloxy, acyloxy or sulfonamido group.

In general formula (M-I), $R_7$ and $R_9$ each is an aryl group, $R_8$ is a hydrogen atom, an aliphatic or aromatic acyl group or an aliphatic or aromatic sulfonyl group, and $Y_3$ is a hydrogen atom or a leaving group. The aryl groups $R_7$ and $R_9$ (each preferably a phenyl group) may have one or more substituents selected from the same group of substituents as mentioned for $R_1$. When $R_7$ and/or $R_9$ has two or more substituents, the substituents may be the same or different. $R_8$ is preferably a hydrogen atom or an aliphatic acyl or sulfonyl group, more preferably a hydrogen atom. $Y_3$ is preferably capable of leaving at a sulfur, oxygen or nitrogen atom, most preferably capable of leaving at a sulfur atom, i.e., the group described in U.S. Pat. No. 4,351,897 or Laid-open International Patent WO 88/04795.

In general formula (M-II), $R_{10}$ is a hydrogen atom or a substituent. $Y_4$ is a hydrogen atom or a leaving group, preferably a halogen atom or an arylthio group. Za, Zb and Zc each is a methine or substituted methine group, =N— or —NH— and one of the Za—Zb and Zb—Zc bonds is a double bond and the other is a single bond. When the Zb—Zc bond is a carbon-carbon double bond, the bond may be included in an aromatic ring. Dimers and other polymers formed by the intermediary of $R_{10}$ or/and $Y_4$ as well as dimers and other polymers formed, when Za, Zb or Zc is a substituted methine, through said substituted methine are also included within the scope of general formula (M-II).

Among the pyrazoloazole couplers of general formula (M-II), imidazo[1,2-b]pyrazoles described in U.S. Pat. No. 4,500,630 are preferred and pyrazolo[1,5-b][1,2,4]triazole described in U.S. Pat. No. 4,540,654 is particularly preferred since the dyes formed show little or limited yellow side absorption and are resistant to light.

Other preferred species include pyrazolotriazole couplers with the pyrazolotriazole ring directly substituted with a branched alkyl group in position 2, 3 or 6, such as those described in JP-A-61-65245, pyrazoloazole couplers containing a sulfonamido group in their molecule, such as those described in JP-A-61-147254, and pyrazolotriazole couplers having an alkoxy or aryloxy group in position 6, such as those described in EP-A-226,849 and EP-A-294,785.

In general formula (Y), $R_{11}$ is a halogen atom or an alkoxy, trifluoromethyl or aryl group, and $R_{12}$ is a hydrogen or halogen atom or an alkoxy group. A is —NHCOR$_{13}$, —NHSO$_2$—R$_{13}$, —SO$_2$NHR$_{13}$, —COOR$_{13}$ or —SO$_2$N(R$_{14}$)—R$_{13}$, where $R_{13}$ and $R_{14}$ each is an alkyl, aryl or acyl group. $Y_5$ is a leaving group. $R_{12}$, $R_{13}$ and $R_{14}$ each may have one or more substituents each selected from among those substituents for $R_1$. The leaving group $Y_5$ is preferably capable of leaving at an oxygen or nitrogen atom, most preferably at a nitrogen atom.

Specific examples of the couplers of general formula (C-I), (C-II), (M-I), (M-II) and Y are given below.

(C-1)

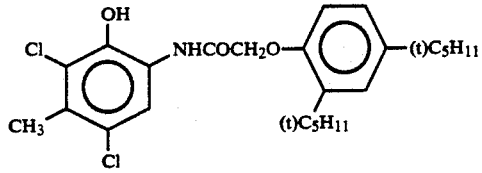

-continued
(C-2)
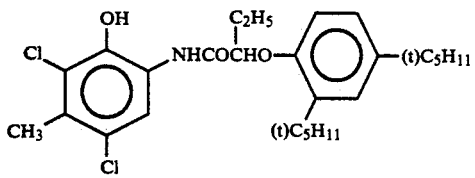
(C-3)
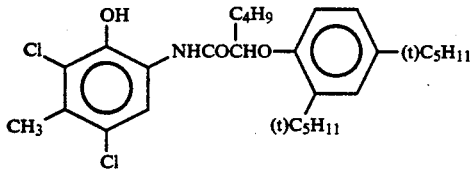
(C-4)
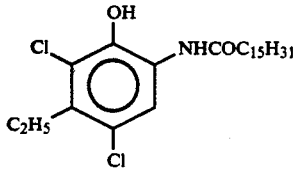
(C-5)
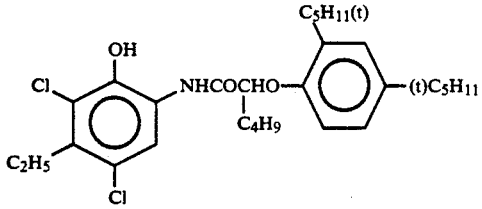
(C-6)
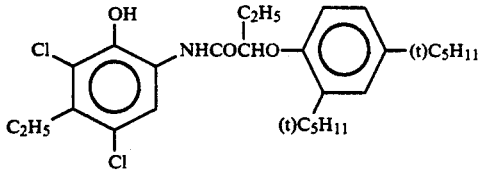
(C-7)
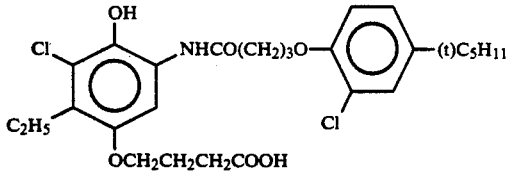
(C-8)
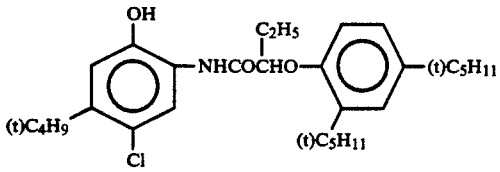
(C-9)
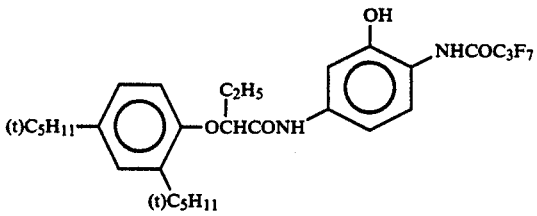

-continued
(C-10)
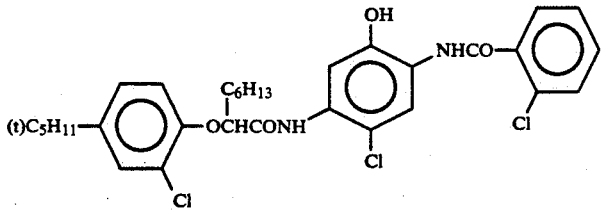
(C-11)
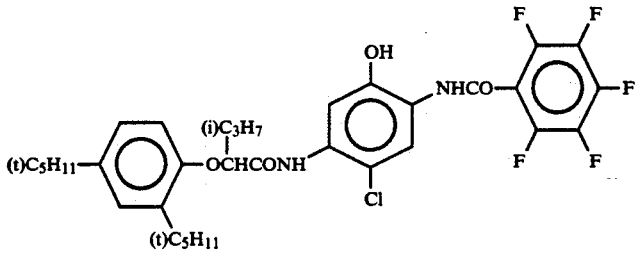
(C-12)
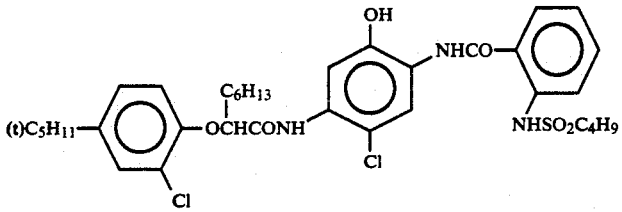
(C-13)
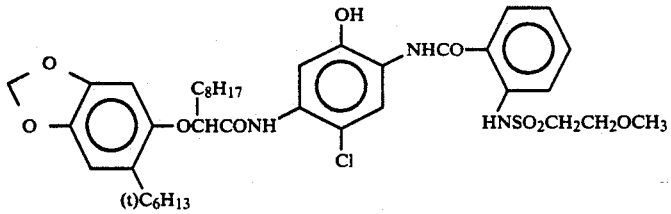
(C-14)
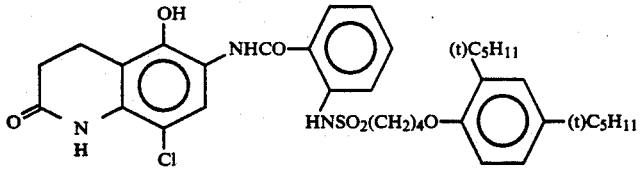
(C-15)
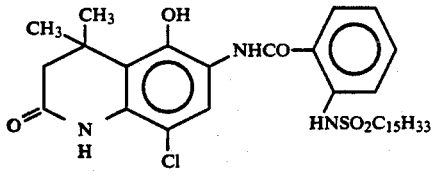
(C-16)
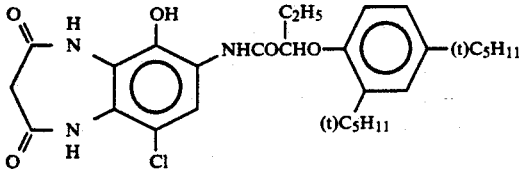

-continued
(C-17)
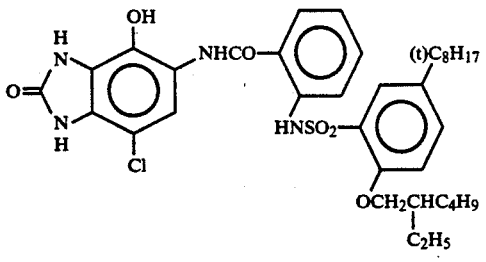
(C-18)
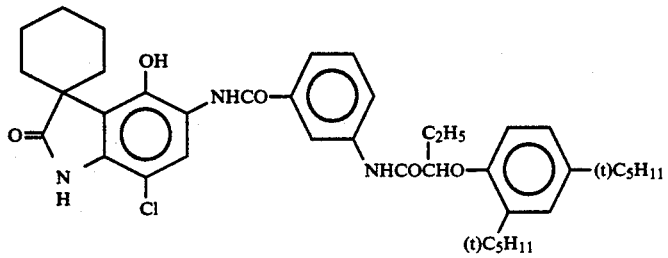
(C-19)
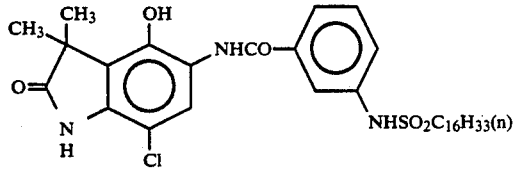
(M-1)
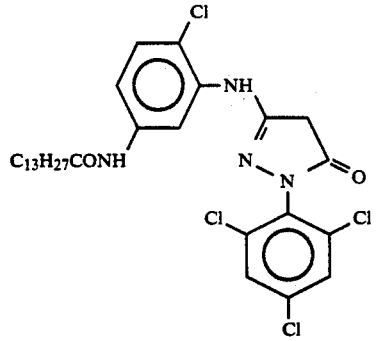
(M-2)
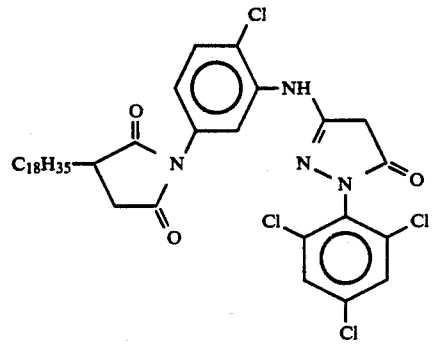

-continued
(M-3)
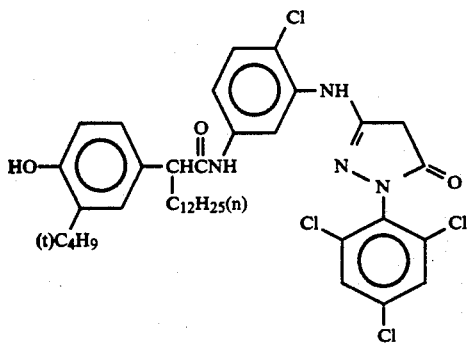
(C-20)
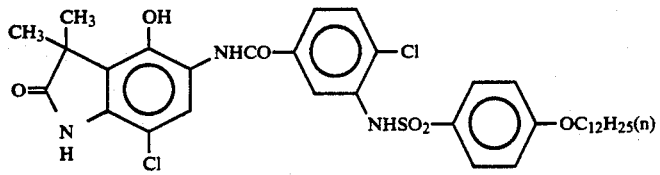
(C-21)
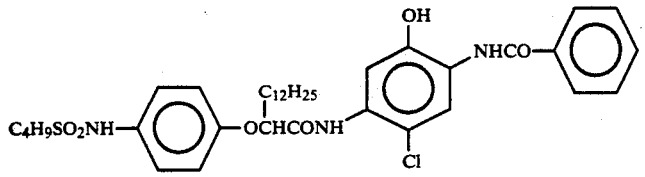
(C-22)
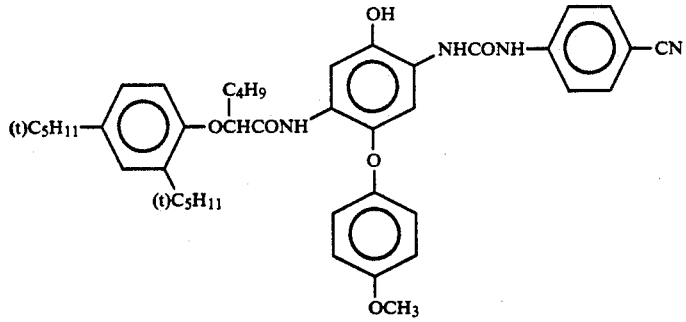
(M-1)
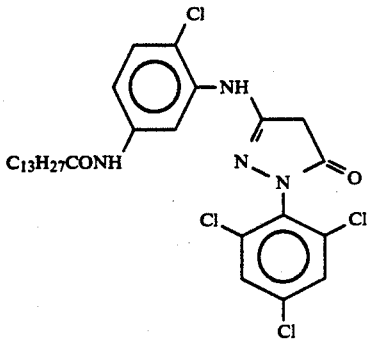

-continued
(M-2)
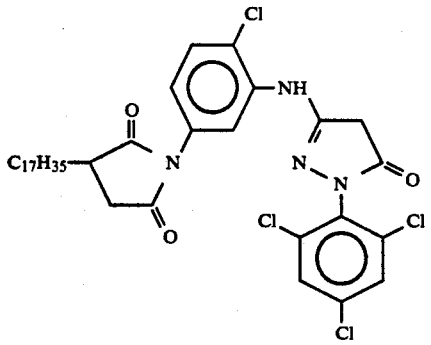
(M-3)
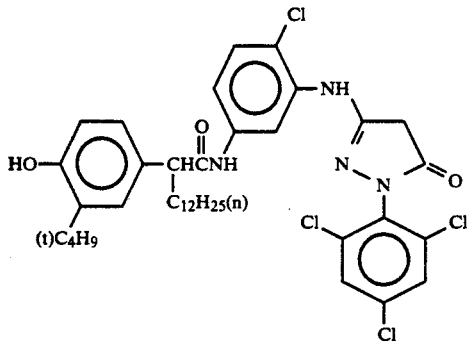
(M-4)
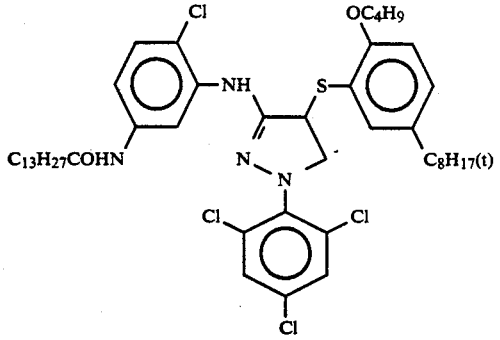
(M-5)
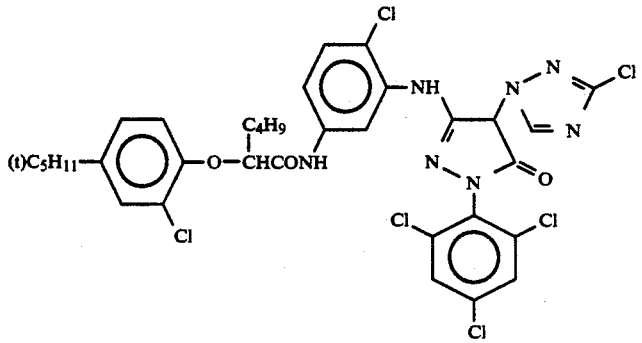

-continued
(M-6)
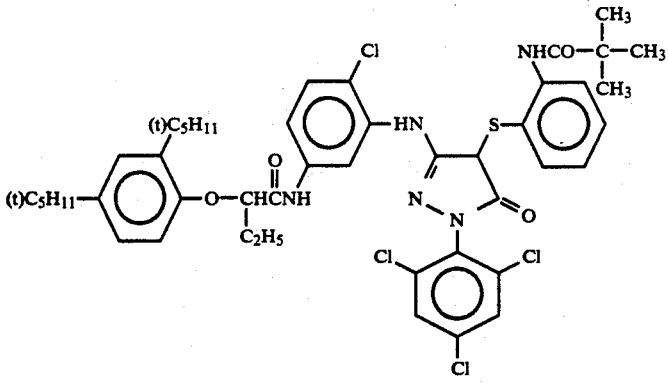
(M-7)
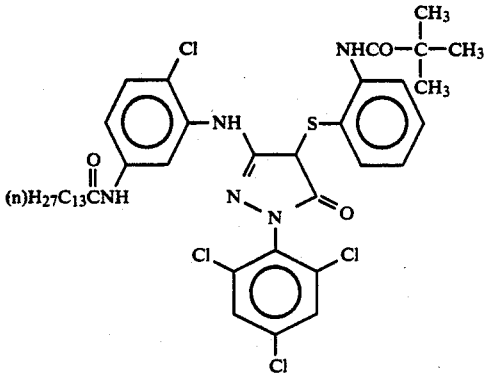
(M-8)
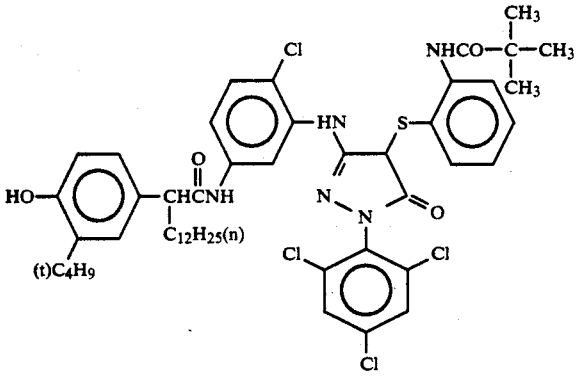
| Compound | $R_{10}$ | $R_{15}$ | $Y_4$ |
|---|---|---|---|
| | | 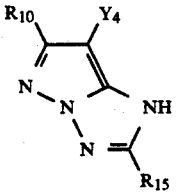 | |
| M-9 | $CH_3$— | 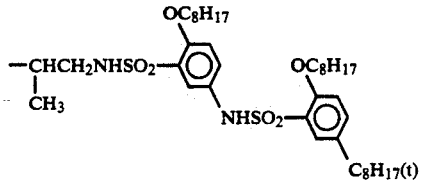 | Cl |

-continued
| Compound | $R_{10}$ | $R_{15}$ | $Y_4$ |
|---|---|---|---|
| M-10 | Same as above | 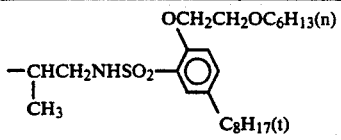 | Same as above |
| M-11 | $(CH_3)_3C-$ | 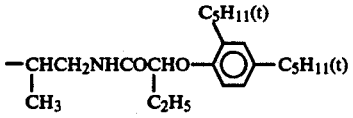 | 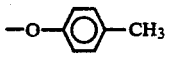 |
| M-12 | 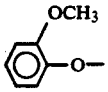 | 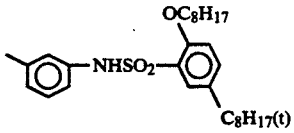 | 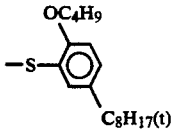 |
| M-13 | $CH_3-$ | 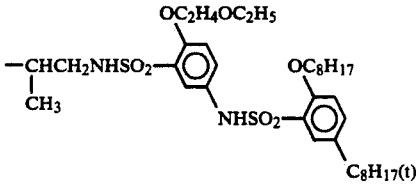 | Cl |
| M-14 | Same as above | 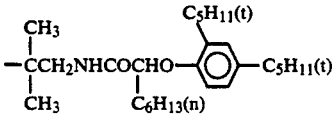 | Same as above |
| M-15 | $CH_3-$ | 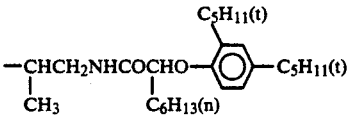 | Cl |
| M-16 | Same as above | 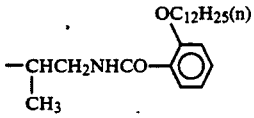 | Same as above |
| M-17 | Same as above | 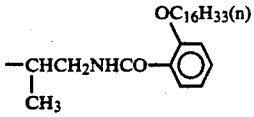 | Same as above |
| M-18 | 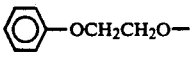 | 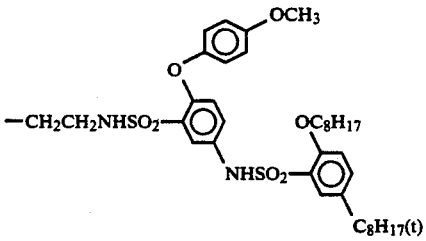 | 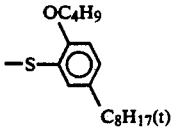 |
| M-19 | $CH_3CH_2O-$ | Same as above | Same as above |
| M-20 | 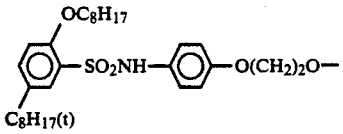 | 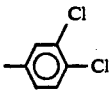 | 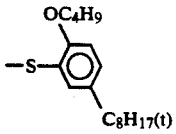 |

-continued
| Compound | $R_{10}$ | $R_{15}$ | $Y_4$ |
|---|---|---|---|
| M-21 | 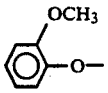 | 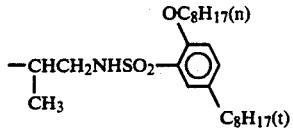 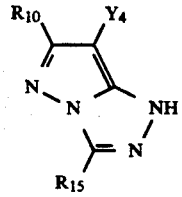 | Cl |
| M-22 | $CH_3$— | 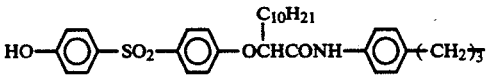 | Cl |
| M-23 | Same as above | 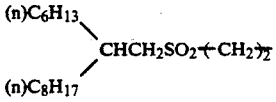 | Same as above |
| M-24 | 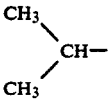 | 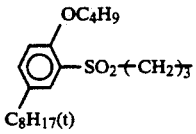 | Same as above |
| M-25 | 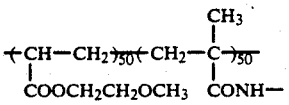 | 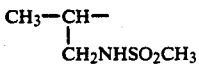 | Same as above |
| M-26 | 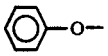 | 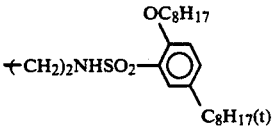 | Cl |
| M-27 | $CH_3$— | 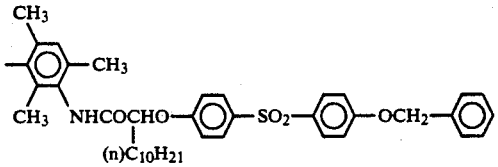 | Same as above |
| M-28 | $(CH_3)_3C$— | 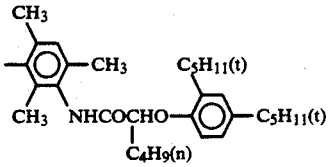 | Same as above |
| M-29 | 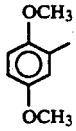 | 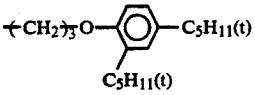 | Cl |
| M-30 | $CH_3$— | 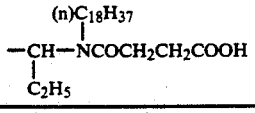 | Same as above |

(Y-1)
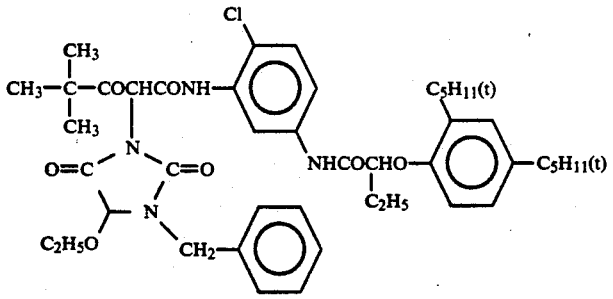
(Y-2)
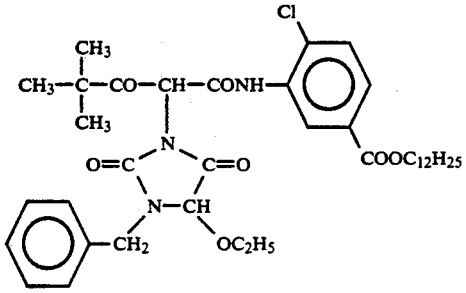
(Y-3)
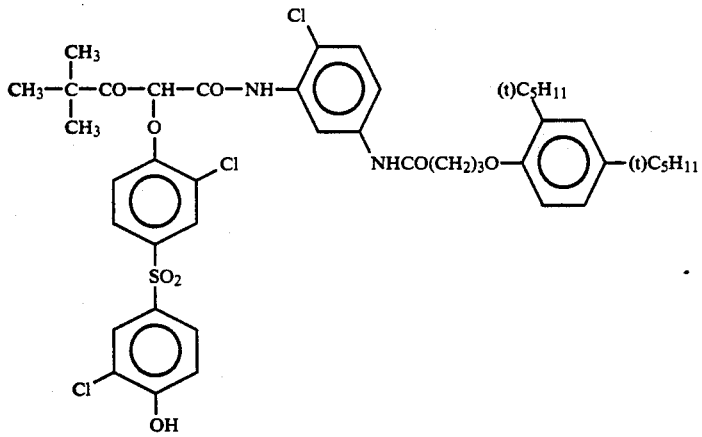
(Y-4)
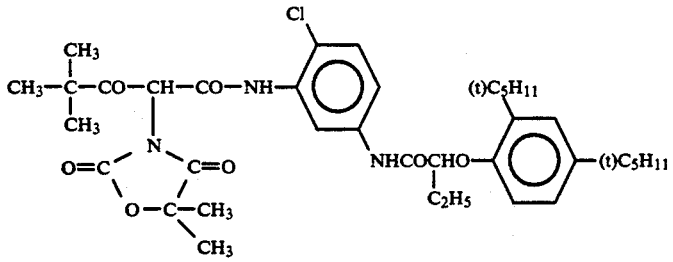
(Y-5)
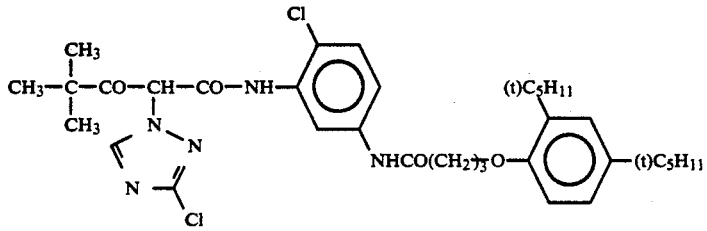

-continued (Y-6)

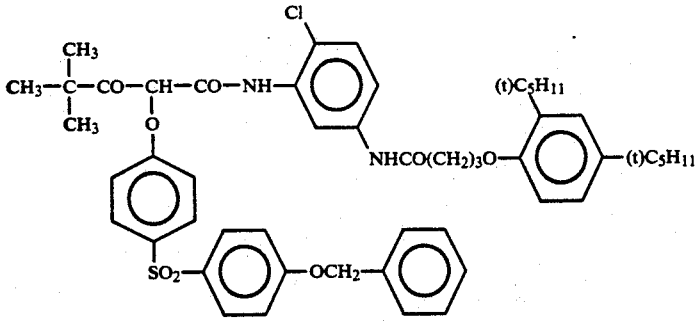

(Y-7)

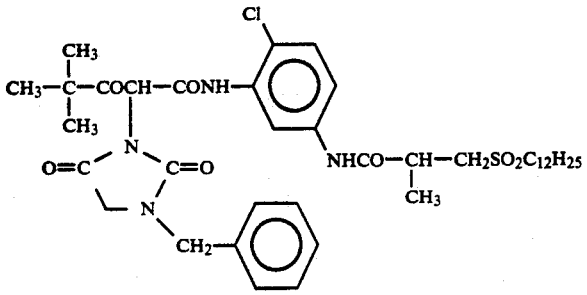

(Y-8)

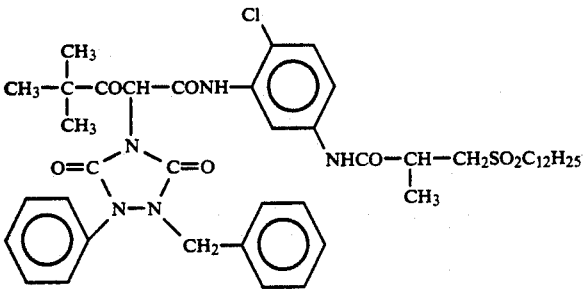

(Y-9)

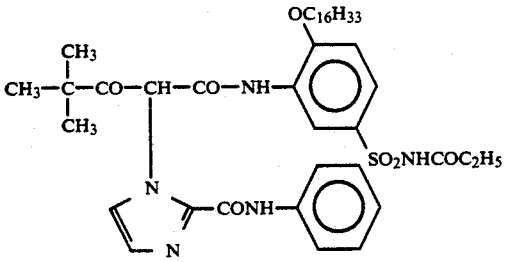

The couplers of the above general formulas (C-I) to (Y) are contained in the photosensitive silver halide emulsion layers generally in an amount of 0.1 to 1.0 mol, preferably 0.1 to 0.5 mol, per mol of silver halide.

For addition of the couplers to the photosensitive layers in the present invention, a variety of known techniques can be employed. Generally, they can be added by the oil-in-water dispersion technique which is known as the "oil-protect" method. Thus, each coupler is dissolved in a solvent and, then, dispersed and emulsified in an aqueous solution of gelatin containing a surfactant. As an alternative, water or an aqueous solution of gelatin is added to a coupler solution containing a surfactant so that an oil-in-water dispersion may form through phase transfer. The alkali-soluble coupler can be dispersed by the Fischer dispersion technique. It may be so arranged that the low-boiling organic solvent is first removed from the coupler dispersion by distillation, noodling or ultrafiltration and, then, the residue is mixed with the photographic emulsion.

Suitable dispersing medium for couplers preferably include a high-boiling organic solvent having a dielectric constant of 2–20 (25° C.) and a refractive index of 1.5–1.7 (25° C.) and/or a water-insoluble high molecular compound.

Suitable high-boiling organic solvents preferably include those represented by the following general formulas (A) through (E):

(A)

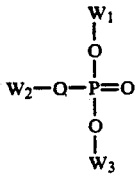

-continued $W_1—COO—W_2$ (B)

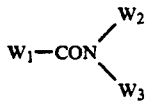

(C)

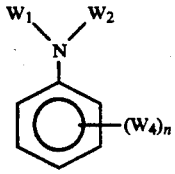

(D)

$W_1—O—W_2$ (E)

In the above formulas, $W_1$, $W_2$ and $W_3$ each is an alkyl, cycloalkyl, alkenyl, aryl or heterocyclic group, any of which may be subsituted or unsubstituted; $W_4$ means $W_1$, $OW_1$ or $S-W_1$; n means a whole number of 1 through 5 and when n is not less than 2, $W_4$'s may be the same or different. In general formula (E), $W_1$ and $W_2$ may form a fused ring.

The high-boiling organic solvent is not limited to the solvents of general formulas (A) through (E), but may be any water-immiscible compound that has a melting point of less than 100° C. and a boiling point of not less than 140° C. and is a good solvent for the coupler. The melting point of the high-boiling organic solvent is preferably not higher than 80° C. The boiling point of the high-boiling organic solvent is preferably not lower than 160° C. and more preferably not lower than 170° C.

Further information on such high-boiling organic solvent can be found on page 137, bottom right col. through page 144, top right col. of JP A-62-215272 which is incorporated herein by reference.

Moreover, these couplers can be used to impregnate a loadable polymer (see, e.g., U.S. Pat. No. 4,203,716) in the presence or absence of said high-boiling organic solvent or be dissolved in a polymer insoluble in water but soluble in an organic solvent and emulsified with an aqueous hydrophilic colloid solution.

Preferably, the homopolymers and copolymers described on pages 12–30 of the specification of Laid-open International Patent WO 80/00723 are employed, and the use of an acrylamide polymer is particularly beneficial for color image stablization.

The photosensitive material according to the invention may further comprise a hydroquinone derivative, an aminophenol derivative, a gallic acid derivative, an ascorbic acid derivative or the like as a color fog restrainer.

Various fading inhibitors can be used in the photosensitive material according to the invention. Thus, for instance, typical organic fading inhibitors for cyan, magenta and/or yellow images include: hydroquinones, 6-hydroxychromans, 5-hydroxycoumarans, spirochromans, p-alkoxyphenols, hindered phenols, particularly hindered bisphenols, gallic acid derivatives, methylenedioxybenzenes, aminophenols and hindered amines as well as ethers and esters derived from such compounds by silylation or alkylation, for instance, of the phenolic hydroxy group thereof. Furthermore, metal complexes, typically bis(salicylaldoximato)nickel complex and bis(N,N-dialkyldithiocarbamato)nickel complex, may also be used.

Specific examples of the organic fading inhibitors are described in the patent literature as follows.

Hydroquinones are described, for example, in U.S. Pat. Nos. 2,360,290, 2,418,613, 2,700,453, 2,701,197, 2,728,659, 2,732,300, 2,735,765, 3,982,944 and 4,430,425, British Patent No. 1,363,921 and U.S. Pat. Nos. 2,710,801 and 2,816,028. 6-hydroxychromans are described, for example, in U.S. Pat. Nos. 3,432,300, 3,573,050, 3,574,627, 3,698,909 and 3,764,337 and JP-A-52-152225. Spiroindanes are described in U.S. Pat. No. 4,360,589. p-alkoxyphenols are described, for example in U.S. Pat. No. 2,735,765, British Patent No. 2,066,975, JP-A-59-10539 and JP-B-57-19765. Hindered phenols are described, for example in U.S. Pat. No. 3,700,455, JP-A-52-72224, U.S. Pat. No. 4,228,235 and JP-B-52-6623. Gallic acid derivatives, methylenedioxybenzenes and aminophenols are described, for example, in U.S. Pat. Nos. 3,457,079 and 4,322,886 and JP-B-56-21144, respectively. Hindered amines are described, for example, in U.S. Pat. Nos. 3,336,135 and 4,268,593, British Patents Nos. 1,326,889, 1,354,313 and 1,410,846, JP-B-51-1420 and JP-A-58-114036, JP-A-59-53846 and JP-A-59-78344. Metal complexes are described, for example, in U.S. Pat. Nos. 4,050,938 and 4,241,155 and British Patent No. 2,026,631(A). These compounds, when co-emulsified with the color couplers generally in an amount of 5 to 100 weight percent based on the corresponding color couplers and added to the photosensitive layers, can produce the desired effects. In order to prevent cyan dye images from degrading upon exposure to heat and, in particular, light, an ultraviolet absorber can be incorporated into the cyan dye-forming layer and both the neighboring layers.

Ultraviolet absorbers that can be used include aryl-substituted benzotriazole compounds (e.g. described in U.S. Pat. No. 3,533,794), 4-thiazolidone compounds (e.g. described in U.S. Pat. Nos. 3,314,794 and 3,352,681), benzophenone compounds (e.g. described in JP-A-46-2784), cinnamate ester compounds (e.g. described in U.S. Pat. Nos. 3,705,805 and 3,707,395), butadiene compounds (e.g. described in U.S. Pat. No. 4,045,229) and benzoxidol compounds (e.g. described in U.S. Pat. Nos. 3,406,070, 3,677,672 and 4,271,307). Ultraviolet-absorbing couplers (e.g. cyan dye-forming couplers of the α-naphthol series) or ultraviolet-absorbing polymers may be used as well. These ultraviolet absorbers may be incorporated in a particular layer in the manner of mordanting.

Among the ultraviolet stabilizers mentioned above, the aryl-substituted benzotriazole compounds are preferred.

It is preferable that the above-mentioned couplers, preferably a pyrazoloazole coupler, be used in combination with compound (G), set forth below, which will be chemically bound to the oxidized aromatic amine developing agent remaining after color development to form a chemically inert and substantially colorless compound. The use thereof can contribute to inhibit staining and other adverse effects due to the production of color on reaction between the residual color developing agent or oxide form thereof during storage after processing.

Preferred examples of compound (G) can be represented by the following general formula (GI)

General Formula (GI)

R—Z

In the above formula, R is an aliphatic, aromatic or heterocyclic group and Z is a nucleophilic group or a group which is decomposed in the photosensitive material to release a nucleophilic group. Preferred species of compound (GI) are those compounds in which Z is a group with a Pearson's nucleophilicity value $^{n}CH_3I$ (R. G. Pearson et al., *J. Am. Chem. Soc.*, 90, 319 (1968)) of not less than 5 or a group derived from such a group.

Preferred examples of compound (GI) are described, for example, in EP-A-255722, JP-A-62-143048 and JP-A-62-229145, Japanese Patent Applications Nos. 63-136724 and 62-214681 and EP-A-298321 and EP-A-277589.

The photosensitive material processed in accordance with the invention may further contain a water-soluble dye or a dye capable of being rendered water-soluble upon photographic processing in the hydrophilic colloid layer either as a filter dye or for various purposes such as inhibiting irradiation and/or halation. Examples of such dye include oxonol dyes, hemioxonol dyes, styryl dyes, merocyanine dyes, cyanine dyes and azo dyes. Among them, oxonol dyes, hemioxonol dyes and merocyanine dyes are particularly useful.

Gelatin is advantageously used as a binder or protective colloid material in the emulsion layers of the photosensitive material. Other hydrophilic colloid materials may also be used either alone or in combination with gelatin.

The gelatin to be used in the photosensitive material may be lime-processed or acid-processed. Gelatin production processes are detailedly described in Arthur Veis: *The Macromolecular Chemistry of Gelatin*, Academic Press, 1964.

The base or support to be used in the photosensitive material may be one generally used in photosensitive materials for photography, for example a cellulose nitrate film, a polyethylene terephthalate film or some other transparent film, or a reflective support. For the purpose of this invention, the use of a reflective support is preferred.

The "reflective support" is a support making the dye image formed in the silver halide emulsion layer sharp and distinct through increased reflectivity. The reflective support includes supports coated with a hydrophobic resin composition containing a light-reflecting substance, such as titanium oxide, zinc oxide, calcium carbonate or calcium sulfate, dispersed therein and a support made of a hydrophobic resin composition containing such a light-reflecting substance dispersed therein. Specific examples are baryta paper, polyethylene-coated paper, polypropylene-based synthetic paper, and transparent supports, such as glass sheet, polyester films (e.g. polyethylene terephthalate film, cellulose triacetate film, cellulose nitrate film), polyamide films, polycarbonate films, polystyrene films, polyvinyl chloride films, provided with a reflective layer or containing a reflective substance.

Another type of reflective support that can be used has a metal surface having mirror reflectivity or class 2 diffuse reflectivity. The metal surface preferably has a spectral reflectance of at least 0.5 in the visible wavelength region and the metal surface is preferably rendered diffuse-reflective by surface roughening or by using a metal powder. Suitable metals include, for example, aluminum, tin, silver or magnesium, or an alloy of such metal, and the metal surface may be the surface of a metal sheet, metal foil or thin metal layer as obtained by rolling, vapor deposition or plating. It is particularly advantageous to vapor-deposit such a metal on a different substrate material. It is preferable to dispose a water-resistant resin layer, particularly a thermoplastic resin layer, on the metal surface. An antistatic layer is preferably disposed on the side of the support which is opposite to the metal surface. For detailed information on such supports, JP-A-61-210346, JP-A-63-24247, JP-A-63-24251 and JP-A-63-24255, for instance, can be consulted.

The support can be easily chosen by one of ordinary skill in the art according to the intended use.

With regard to the light-reflective substance, it is good practice to knead a white pigment thoroughly in the presence of a surfactant and to use pigment particles surface-treated with a di- to tetrahydric alcohol.

The percent coverage (%) of a finely divided white pigment can be determined most typically by dividing an observed area into 6 μm ×6 μm unit areas directly adjacent one another and determining the percent coverage, or percent projection area of the pigment particles, $R_i$. The coefficient of variation can be calculated as the ratio $s/\overline{R}$ where $\overline{R}$ is the mean of $R_i$ values and s is the standard deviation. The number of unit areas to be submitted to said measurement should preferably be not less than 6. The coefficient of variation s/R thus can be calculated by the formula $$\sqrt{\frac{\sum_{i=1}^{n}(R_i-\overline{R})^2}{n-1}} \Big/ \frac{\sum_{i=1}^{n} R_i}{n}$$

In the practice of the invention, the coefficient of variation for the percent pigment coverage determined in the above manner should preferably be 0.15 or less, more preferably 0.12 or less. When the coefficient is 0.08 or less, the pigment can be said to give a substantially "homogenous" dispersion.

After exposure, the photosensitive material of the invention for color photography is preferably subjected to color development, bleaching/fixing, and washing with water (or stabilization). The bleaching and fixation may be carried in one and the same bath or separately.

The color developer to be used in the practice of the invention contains an aromatic primary amine developing agent which is per se known. Preferred examples are p-phenylenediamine derivatives. Typical examples are shown below. They are, however, by no means limitative of the scope of the invention.

| | |
|---|---|
| D-1 | N,N-Diethyl-p-phenylenediamine |
| D-2 | 2-Amino-5-diethylaminotoluene |
| D-3 | 2-Amino-5-(N-ethyl-N-laurylamino)toluene |
| D-4 | 4-[N-ethyl-N-(β-hydroxyethyl)amino]aniline |
| D-5 | 2-Methyl-4-[N-ethyl-N-(β-hydroxyethyl)amino]-aniline |
| D-6 | 2-Methyl-4-[N-ethyl-N-(3-hydroxypropyl)amino]-aniline |
| D-7 | 4-Amino-3-methyl-N-ethyl-N-[β-(methanesulfonamido)ethyl]aniline |
| D-8 | N-(2-Amino-5-diethylaminophenylethyl)methanesulfonamide |
| D-9 | N,N-Dimethyl-p-phenylenediamine |
| D-10 | 4-Amino-3-methyl-N-ethyl-N-methoxyethylaniline |
| D-11 | 4-Amino-3-methyl-N-ethyl-N-β-ethoxyethylaniline |
| D-12 | 4-Amino-3-methyl-N-ethyl-N-β-butoxyethylaniline |

Among the above-mentioned p-phenylenediamine derivatives, D-4 and D-6 are particularly preferred. If necessary, or where appropriate, a plurality of developing agents may be used in admixture. The p-phenylenediamine derivatives may be in the form of salts, such as the sulfate, hydrochloride, sulfite or p-toluenesulfonate. The aromatic primary amine developing agent is used preferably in an amount of about 0.1 to about 20 g, more preferably about 0.5 g to about 12 g, per liter of developer.

In practicing the invention, the use of a developer substantially free of benzyl alcohol is preferred. The phrase "substantially free" means that the benzyl alcohol concentration should preferably be 2 ml/liter or less, more preferably 0.5 ml/liter or less and, most preferably, zero (benzyl alcohol being absent).

More preferably, the developer to be used in the practice of the invention should be substantially free of the sulfite ion. The sulfite ion functions as a preservative for the developing agent but at the same time solubilizes the silver halide and further reacts with the oxidized form of developing agent to reduce the dye formation efficiency. It is presumable that the latter effects should cause increased variations in photographic characteristics in continuous processing. The phrase "substantially free" is used to indicate that the sulfite ion concentration should preferably be $3.0\times10^{-3}$ mol/liter or less, most preferably zero (absolute absence of the sulfite ion). The above discussion does not apply to the sulfite ion contained in very small amounts in processing kits which contain a developing agent in a concentrated form before the preparation of a processing solution.

While the developer to be used in the practice of the invention should preferably be substantially free of the sulfite ion, the developer should more preferably be substantially free of hydroxylamine. This is because hydroxylamine, which can serve as a preservative for developers, by itself has silver developing activity, hence presumably exerting great influences on photographic characteristics when its concentration varies. The phrase "substantially free of hydroxylamine" is used to mean that the hydroxylamine concentration should preferably be $5.0\times10^{-3}$ mol/liter or less and, most preferably, zero (absolutely free).

More preferably, the developer to be used in the practice of the invention should contain an organic preservative in lieu of the above-mentioned hydroxylamine or sulfite ion.

The term "organic preservative" is used to include, within the meaning thereof, any and all organic compounds which, when added to a processing solution for color photographic light-sensitive materials, would reduce the rate of degradation of the aromatic primary amine color developing agent. Thus, an organic preservative is an organic compound which has the ability to inhibit atmospheric or other oxidation of color developing agents. Particularly useful organic preservatives (exclusive of hydroxylamine) are hydroxylamine derivatives, hydroxamic acids, hydrazines, hydrazides, phenols, α-hydroxyketones, α-aminoketones, carbohydrates, monoamines, diamines, polyamines, quaternary ammonium salts, nitroxy radicals, alcohols, oximes, diamide compounds and condensed cyclic amines, among others. These compounds are disclosed, for instance, in JP-A-63-4235, JP-A-63-30845, JP-A-63-21647, JP-A-63-44655, JP-A-63-53551, JP-A-64-43140, JP-A-63-56654, JP-A-63-58346, JP-A-63-43138, JP-A-63-146041, JP-A-63-44657 and JP-A-63-44656, U.S. Pat. Nos. 3,615,503 and 2,494,903, JP-A-52-143020 and JP-B-48-30496.

Other preservatives that may be contained in the developer where appropriate include various metals described in JP-A-57-44148 and JP-A-57-53749, salicylic acids described in JP-A-59-180588, alkanolamines described in JP-A-54-3532, polyethylenimines described in JP-A-56-94349 and aromatic polyhydroxy compounds described in U.S. Pat. No. 3,746,544. The addition of an alkanolamine such as triethanolamine, a dialkylhydroxylamine such as diethylhydroxylamine, a hydrazine derivative or an aromatic polyhydroxy compound is particularly preferred.

Among the organic preservatives mentioned above, hydroxylamine derivatives and hydrazine derivatives (hydrazines and hydrazides) are particularly preferred. These derivatives are detailedly discussed in JP-A-1-97953, JP-A-1-186939, JP-A-1-186940 and JP-A-1-187557, for instance.

In order to improve the stability of the color developer, specifically to improve the stability in continuous processing, the combined use of such a hydroxylamine derivative or hydrazine derivative as mentioned above and an amine is preferred.

Suitable amines include cyclic amines such as those described in JP-A-63-239447, amines such as those described in JP-A-63-128340, and amines such as those described in JP-A-1-186939 and JP-A-1-187557.

The color developer should preferably contain chloride ion in an amount of $3.5\times10^{-2}$ to $1.5\times10^{-1}$ mol/liter, more preferably $4\times10^{-2}$ to $1\times10^{-1}$ mol/liter. Chloride ion concentrations exceeding $1.5\times10^{-1}$ mol/liter may disadvantageously reduce the rate of development and are inadequate for rapid development with a high maximum density, which is an object of the invention. Chloride ion concentrations below $3.5\times10^{-2}$ mol/liter may be undesirable in terms of fog prevention.

The color developer should preferably contain bromide ion in a concentration of $3.0\times10^{-5}$ to $1.0\times10^{-3}$, more preferably $5.0\times10^{-5}$ to $5\times10^{-4}$ mol/liter. Bromide ion concentrations exceeding $1.0\times10^{-3}$ mol/liter may possibly retard development while concentrations below $3.0\times10^{-5}$ mol/liter may fail to prevent fogging satisfactorily.

The chloride ion and bromide ion may be added directly to the developer or may be caused to migrate from the photosensitive material into the developer during development.

Examples of the chloride ion source which are suited for direct addition to the color developer are sodium chloride, potassium chloride, ammonium chloride, lithium chloride, nickel chloride, magnesium chloride, manganese chloride, calcium chloride and cadmium chloride. Among them, sodium chloride and potassium chloride are preferred.

The chloride ion may be supplied from the fluorescent whitener contained in the developer.

The bromide ion source is, for example, sodium bromide, potassium bromide, ammonium bromide, lithium bromide, calcium bromide, magnesium bromide, manganese bromide, nickel bromide, cadmium bromide, cerium bromide or thallium bromide. Among these, potassium bromide and sodium bromide are preferred.

In cases where the chloride ion and bromide ion are to be eluted from the photosensitive material during processing for development, they both may be supplied from the emulsion or any other source than the emulsion.

The color developer preferably has a pH of 9 to 12, more preferably 9 to 11.0, and the color developer may further contain other known developer components.

The above-mentioned pH is preferably established with buffers. Among the buffers useful for this purpose are carbonate salts, phosphate salts, borate salts, tetraborate salts, hydroxybenzoate salts, glycine salts, N,N-dimethylgycine salts, leucine salts, norleucine salts, guanine salts, 3,4-dihydroxyphenylalanine salts, alanine salts, aminobutyrate salts, 2-amino-2-methyl-1,3-propanediol salts, valine salts, proline salts, trishydroxymethylaminomethane salts and lysine salts. Carbonate salts, phosphate salts, tetraborate salts and hdyroxybenzoate salts are particularly preferred since these buffers are inexpensive and show good solubility and good buffering characteristics but, when added to the color developer, will not produce any adverse influence (e.g. fog) on photographic characteristics.

Specific examples of these buffers are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sufo-2-hydroxybenzoate (sodium 5-sulfosalicylate) and potassium 5-sulfo-2-hydroxybenzoate (potassium 5-sulfosalicylate). However, these examples are by no means limitative of the scope of the present invention.

The level of addition of the above buffer or buffers to the color developer is preferably 0.1 mol/liter or more, more preferably within the range of 0.1 to 0.4 mol/liter.

Furthermore, various chelating agents can be used in the color developer as precipitation inhibitors for calcium and magnesium or for improving the stability of the color developer. Examples include nitrilotriacetic acid, diethylenetriaminepentaacetic acid, ethylenediaminetetraacetic acid, nitrilotrimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-ortho-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

These chelating agents may be used either alone or two or more of them in combination.

The level of addition of these chelating agents is sufficient if the metal ion or ions in the color developer can be sequestered to a satisfactory extent. For instance, an addition level of about 0.1 to 10 grams per liter will be sufficient.

The color developer may contain a development accelerator, if desired.

Suitable development accelerators include thioether compounds described, for instance, in JP-B-37-16088, JP-B-37-5987, JP-B-38-7826, JP-B-44-12380 and JP-B-45-9019 and in U.S. Pat. No. 3,813,247, p-phenylenediamine compounds described, for instance, in JP-A-52-49829 and JP-A-50-15554, quaternary ammonium salts described, for instance, in JP-B-44-30074 and JP-A-50-137726, JP-A-56-156826 and JP-A-52-43429, amine compounds described, for instance, in U.S. Pat. Nos. 2,494,903, 3,128,182, 4,230,796 and 3,253,919, JP-B-41-11431 and U.S. Pat. Nos. 2,482,546, 2,596,926, and 3,582,346, polyalkylene oxides described in JP-B-37-16088, JP-B-42-25201, JP-B-41-11431 and JP-B-42-23883 and U.S. Pat. Nos. 3,128,183 and 3,532,501, 1-phenyl-3-pyrazolidones, imidazoles and the like.

In the practice of the invention, an antifoggant may be used where appropriate, such as an alkali metal halide (e.g. sodium chloride, potassium bromide, potassium iodide) or an organic antifoggant. Typical examples of the organic antifoggant include nitrogen-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindoline and adenine.

The color developer preferably contains an optical or fluorescent whitener. A preferred optical whitener includes 4,4'-diamino-2,2'-disulfostilbene compounds. The addition level is 0 to 5 grams per liter, preferably 0.1 to 4 grams per liter.

If necessary, various surfactants, such as alkylsulfonic acid type, arylsulfonic acid type, aliphatic carboxylic acid type and aromatic carboxylic acid type surfactants, may be incorporated in the developer.

The processing temperature for the color developer is within the range of 20°–50° C., preferably 30°–45° C. The processing time is substantially within (defined below) 20 seconds. The replenishment volume should preferably be as small as possible, more preferably 20–600 ml, even more preferably 50–300 ml, even more preferably 60–200 ml, and most preferably 60–150 ml, per square meter of photosensitive material.

In the process of the present invention, it is preferable that the development time be substantially within 20 seconds. The time specified by the pharse "substantially within 20 seconds" as used herein covers the period between the entrance of the photosensitive material into the developer bath and the entrance of the same material into the next bath, inclusive of the time required for transfer in the air from the developer bath to the next bath.

The process for removal of silver that can be employed in the present invention, generally speaking, may be any of the processes comprising bleaching and fixation steps, or fixation and bleaching/fixation steps, or bleaching and bleaching/fixation steps, or bleaching-/fixation step, or the like.

Bleaching solutions, bleaching/fixing solutions and fixing solutions which are applicable in the practice of the invention are described below.

In the bleaching solutions or bleaching/fixing solutions, any bleaching agent may be employed. Preferred, however, are organic iron(III) complex salts (e.g. complexes with aminopolycarboxylic acids, such as ethylenediaminetetraacetic acid and diethylenetriaminepentaacetic acid, aminopolyphosphonic acids, phosphonocarboxylic acids, and organic phosphonic acids), organic acids, such as citric acid, tartaric acid and malic acid, presulfate salts, and hydrogen peroxide, among others.

Among the above-mentioned examples, organic iron(III) salts are particularly preferred in terms of rapid processing and prevention of environmental pollution. Specifically, the aminopolycarboxylic acids, aminopolyphosphonic acids and organic phosphonic acids, inclusive of salts thereof, include, among others, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraaetic acid, and sodium, potassium, lithium and ammonium salts of these acids. Among these compounds, preferred in terms of high bleaching power are iron(III) complexes with ethylenediaminetetraacetic acid, diethylenetriaminepentaacetic acid, cyclohexanediaminetetraacetic acid, 1,3-diaminopropanetetraacetic acid and methyliminodiacetic acid. The ferric ion complexes may be used either as such in the complex salt form or prepared in situ in the solution using a ferric salt, such as ferric sulfate, ferric chloride, ferric nitrate, ferric ammonium sulfate or ferric phosphoate, and a chelating agent, such as an aminopolycarboxylic acid, aminopolyphosphonic acid or phosphonocarboxylic acid. The chelating agent may be used in excess of the quantity required for ferric ion chelate formation. Among the iron complexes, aminopolycarboxylic acid-iron chelates are preferred. The addition level is 0.01 to 1.0 mol/liter, preferably 0.05 to 0.50 mol/liter.

The bleaching bath, bleach/fix bath and/or baths preceding thereto may contain various compounds as bleaching accelerators. Thus, for example, the following compounds, each excellent in bleaching power, may preferably be used: mercapto group or disulfide bond-containing compounds described in U.S. Pat. No. 3,893,858, German Patent No. 1,290,812, JP-A-53-95630 and *Research Disclosure* No. 17129 (July 1978), thiourea compounds described in JP-B-45-8506, JP-A-52-20832 and JP-A-53-32735 and U.S. Pat. No. 3,706,561, and halogen compounds, such as iodine and bromine ion.

The bleaching solutions or bleaching/fixing solutions which are applicable in the practice of the invention may further contain a rehalogenating agent, such as a bromide (e.g. potassium bromide, sodium bromide, ammonium bromide), a chloride (e.g. potassium chloride, sodium chloride, ammonium chloride) or an iodide (e.g. ammonium iodide). If desired or where appropriate, one or more inorganic acids, organic acids, or alkali metal or ammonium salts of these, which have pH buffering activity, for example borax, sodium metaborate, acetic acid, sodium acetate, sodium carbonate, potassium carbonate, phosphorous acid, phosphoric acid, sodium phosphate, citric acid, sodium citrate and tartaric acid, and/or one or more corrosion inhibitors, such as ammonium nitrate and guanidine, may be added to said solutions.

The fixing agents to be used in the bleaching/fixing solutions or fixing solutions are known ones, namely water-soluble, silver halide-solubilizing agents such as thiosulfates (e.g. sodium thiosulfate, ammonium thiosulfate), thiocyanates (e.g. sodium thiocyanate, ammonium thiocyanate), thioether compounds (e.g. ethylenebisthioglycolic acid, 3,6-dithia-1,8-octanediol) and thioureas. These may be used either alone or in combination.

Furthermore, special-purpose bleaching/fixing solutions such as described in JP-A-55-155354 and comprising the combination of a large amount of a fixing agent and a halide such as potassium iodide may also be used. In the practice of the invention, the use of a thiosulfate, particularly ammonium thiosulfate, is preferred. The level of addition of the fixing agent is preferably within the range of 0.3 to 2 mols per liter, more preferably 0.5 to 1.0 mol per liter. The bleaching/fixing or fixing solutions should preferably have a pH within the range of 3 to 10, more preferably 5 to 9.

Furthermore, the bleaching/fixing solutions may contain various fluorescent whiteners, antifoaming agents, surfactants, polyvinylpyrrolidone and/or organic solvents (e.g. methanol).

The bleaching/fixing or fixing solutions preferably contain, as a preservative, a sulfite ion-releasing compound such as a sulfite (e.g. sodium sulfite, potassium sulfite), a bisulfite (e.g. ammonium bisulfite, sodium bisulfite, potassium bisulfite) or a metabisulfite (e.g. potassium metabisulfite, sodium metabisulfite, ammonium metabisulfite). The addition level is, when expressed in terms of sulfite ion concentration, about 0.02 to 0.05 mol/liter, more preferably 0.04 to 0.40 mol./liter.

While sulfites are generally used as preservatives, ascorbic acid, carbonyl-bisulfite adducts and carbonyl compounds may also be used.

Furthermore, buffers, fluorescent whiteners, chelating agents, antifoaming agents, fungicides and other additives may be added to such solutions when desired or where appropriate.

The silver removal by fixing or bleaching/fixing is generally followed by washing with water and/or processing for stabilization.

The quantity of water to be used in the washing step can be selected within a broad range depending on the characteristics of the photosensitive material (e.g. depending on couplers and other materials used), the intended use thereof, the washing temperature, the number of washing tanks (number of stages) and other conditions. The relationship between the number of tanks and the quantity of water in a multistage countercurrent system can be determined by the method described in *Journal of the Society of Motion Picture and Television Engineers*, 64, 248–253 (May 1955). Generally, the number of stages in multistage countercurrent system is preferably 2 to 6, more preferably 2 to 5.

The multistage countercurrent system can markedly reduce the quantity of water to be used for washing, for instance to a level of 300 liters or less per square meter of the photosensitive material, thus leading to manifestation of the effects of the invention in a distinct manner. However, in such a system, increases in the residence time of water in tanks may produce the problems of bacterial growth and deposition of the resulting floating matter on the photosensitive material. To solve such problems, the method comprising reducing the calcium and magnesium concentrations, which is described in JP-A-62-288838, can be used very effectively. It is also possible to use biocides such as thiabendazoles and isothiazolone compounds described in JP-A-57-8542, chloride microbicides such as chlorinated sodium isocyanurate described in JP-A-61-120145, benzotriazole compounds described in JP-A-61-267761, copper ion, and those described in Hiroshi Horiguchi: "Bokin Bobai no Kagaku (Chemistry of Bacterium and Fungus Control)", Sankyo Shuppan, 1986; Eisei Gijutsu Kai (Sanitation Technology Association) (ed.): "Biseibutsu no Mekkin, Sakkin, Bobai Gijutsu (Techniques of Microbial Sterilization, Microbe Killing and Mold Control)", Kogyo Gijutsu Kai, 1982; and Research Society of Antibacterial and Antifungal Agents, Japan (ed.): "Bokin Bobaizai Jiten (Encyclopedia of Antibacterial and Antifungal Agents)", 1986.

Furthermore, the rinse water may contain a surfactant as a drainage promoter, and/or a chelating agent, typically EDTA, as a water softener.

The stabilization step may follow either the above washing step or directly the silver removal step omitting the washing step mentioned above. The stabilizing solution contains a compound or compounds capable of stabilizing images, for example aldehyde compounds, typically formalin, buffers for adjusting the pH to a level suited for dye stabilization, and ammonium compounds. Various bactericides and fungicides such as those mentioned above may be used for inhibiting bacterial growth in the stabilizing solution and rendering treated photosensitive materials resistant to fungi.

Furthermore, surfactants, fluorescent whiteners and/or hardeners may be incorporated. When, in the processing of the photosensitive material according to the invention, the stabilization step directly follows the silver removal step without the interposition of any washing step, any of the known methods described, for instance, in JP-A-57-8543, JP-A-58-14834 and JP-A-60-220345 can be employed.

Organic phosphonic acids and/or organic phosphonic acid salts can preferably be used as chelating agents for inhibiting staining, either alone or in combination.

The level of addition of these organic phosphonic acids and/or organic phosphonic acid salts to the washing or stabilizing solution can be determined depending on the content of ferric ethylenediaminetetraacetate contained in the photosensitive material. Generally, the level should preferably be 2.9 to 290 millimols per liter, more preferably 14.6 to 146 millimols per liter. At excessively high addition levels, the surface may become sticky while, at excessively low levels, the desired stain-inhibiting effect cannot be produced.

In a preferred embodiment, a magnesium compound and/or a bismuth compound is used.

It is also a preferred practice to use such chelating agents as 1-hydroxyethylidene-1,1-diphosphonic acid and ethylenediaminetetramethylenephosphonic acid, magnesium compounds and/or bismuth compounds.

The so-called rinse may also be used as the washing or stabilizing solution to be used following silver removal.

The pH to be employed in the washing or stabilization step is preferably in the range of 4 to 10, more preferably 5 to 8. The temperature to be employed may vary depending on the intended use and characteristics of the photosensitive material and on other factors. Generally, however, it is within the range of 30°–45° C., preferably 35°–42° C. Although the time to be spent for this step is not critical, a shorter time is desired from the processing time reduction viewpoint. Thus, a period of 10 to 45 seconds, in particular 10 to 40 seconds, is preferred. The replenishing quantity should preferably be as small as possible from the viewpoints of running cost, effluent reduction, ease of handling and so on.

A preferred replenishment quantity is 0.5 to 50 times, more preferably 2 to 15 times, the carry over from the preceding bath per unit surface area of the photosensitive material, or 300 ml or less, preferably 150 ml or less, per square meter of the photosensitive material. The replenishment may be continuous or intermittent.

The solution used in the washing and/or stabilization step may be used again in the preceding step. For example, the overflow of the washing water whose quantity is cut down by employing a multistage countercurrent system may be introduced into the preceding bleaching/fixing bath while supplementing a concentrated bleaching/fixing solution to said bath. In this way, the quantity of waste fluid can be reduced.

A drying step employable in the practice of the invention is described below.

The drying time should desirably be 20 to 40 seconds so that very rapid processing can be achieved for obtaining finished images in accordance with the present invention.

A measure for shortening the drying time that may be taken on the photosensitive material side comprises reducing the quantity of gelatin or the like hydrophilic binder to thereby reduce the quantity of water carried into the film. Drying can be expedited also by reducing this water uptake by submitting the photosensitive material to a squeeze roll or cloth for water absorption immediately after it comes out from the bath. It is of course possible to accelerate drying by raising the air temperature or intensifying the drying air flow. Furthermore, the speed of drying can be increased by adjusting the angle of incidence of drying air relative to the photosensitive material or improving the method of eliminating exhaust air.

EXAMPLE

Fabrication of Infrared-sensitive Photosensitive Materials

Emulsion Preparation

Sodium chloride (3.3 g) was added to a 3% aqueous solution of lime-processed gelatin, followed by addition of 3.2 ml of N,N'-dimethylimidazolidine-2-thione (1% aqueous solution). To this aqueous solution, with vigorous stirring, an aqueous solution containing 0.2 mol of silver nitrate and an aqueous solution containing 0.2 mol of sodium chloride and 15 μg of rhodium trichloride at 56° C. were added. Then, with vigorous stirring at 56° C., an aqueous solution containing 0.780 mol of silver nitrate and an aqueous solution containing 0.780 mol of sodium chloride and 4.2 mg of potassium ferrocyanide were added. Five minutes after completion of the addition of the aqueous silver nitrate solution and aqueous alkali halide solution, an aqueous solution containing 0.020 mol of silver nitrate and an aqueous solution containing 0.015 mol of potassium bromide, 0.005 mol of sodium chloride and 0.8 mg of potassium hexachloroiridate(IV) were further added at 40° C. with vigorous stirring. The resultant reaction mixture was then subjected to desalting and washing with water. Further, 90.0 g of lime-processed gelatin was added and triethylthiourea was added for optimal chemical sensitization.

The thus-obtained silver chlorobromide (A) was examined by electron microscopy and the grain shape, grain size and grain size distribution were determined from the electron micrograph obtained. The silver halide grains were invariably cubic, with a mean grain size of 0.52 μm and a coefficient of variation of 0.08. The grain size was expressed in terms of the mean diameter of circles equivalent in area to projected grain silhouettes. The grain size distribution was expressed in terms of the value obtained by dividing the standard deviation by the mean grain size.

The halogen composition of emulsion grains was then determined by X-ray diffraction of silver halide crystals. The monochromatized CuKo beam was used as the radiation source and the angles of diffraction from the (200) plane were examined in detail. In principle, diffracted rays from crystals homogeneous in halide composition give a single peak, while diffracted rays from crystals having localized phases differing in composition give a plurality of peaks corresponding to the different compositions. The halogen composition of a silver halide constructing the crystals can be determined by calculating lattice constances based on the angles of diffraction of the peaks observed. With the silver chlorobromide emulsion (A), a broad diffraction peak with a center at 70% silver chloride (30% silver bromide) and a tail down to 60% silver chloride (40% silver bromide) was observed in addition to the main peak for 100% silver chloride.

Fabrication of Photosensitive Materials

Using a paper support polyethylene-laminated on both sides, a multilayer color printing paper of the construction specified later herein was fabricated. The coating compositions were prepared in the following manner.

Preparation of the First Layer Coating Composition

First, 19.1 g of yellow coupler (ExY), 4.4 g of color image stabilizer (Cpd-1) and 0.7 g of color image stabilizer (Cpd-7) were dissolved by addition of 27.2 cc of ethyl acetate and 8.2 g of solvent (Solv-1) and the resulting solution was dispersed and emulsified in 185 cc of a 10% aqueous solution of gelatin containing 8 cc of 10% sodium dodecylbenzenesulfonate. Separately, the red-sensitive sensitizing dye (Dye-1) specifically shown below was added to silver chlorobromide emulsion (A) to give an emulsion. This emulsion was mixed with the emulsified dispersion prepared above to give the first layer coating composition having the composition given later herein.

The second to the seventh coating compositions were also prepared in the same manner as the first layer coating composition. As the gelation hardener for each layer, 1-hydroxy-3,5-dichloro-s-triazine sodium salt was used.

Cpd-10 and Cpd-11 were further added to each layer to the total addition levels of 25.0 mg/m$^2$ and 50.0 mg/m$^2$, respectively.

The following spectrally sensitizing dyes were used in the respective layers.

(First layer, i.e. red-sensitive yellow dye-forming layer):

(Dye-1)

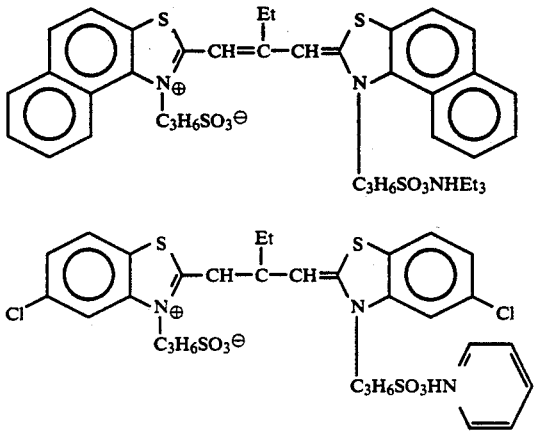

Addition levels: $1.0 \times 10^{-4}$ mol/mol silver halide and $1.0 \times 10^{-4}$ mol/mol silver halide, respectively.

(Third layer, i.e. red-senstive magenta dye-forming layer):

(Dye-2)

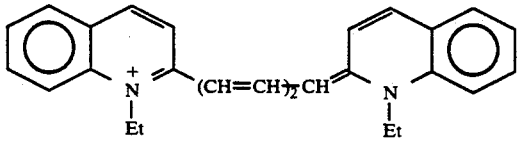

$4.5 \times 10^{-5}$ mol/mol silver halide (Fifth layer, i.e. red-sensitive cyan dye-forming layer):

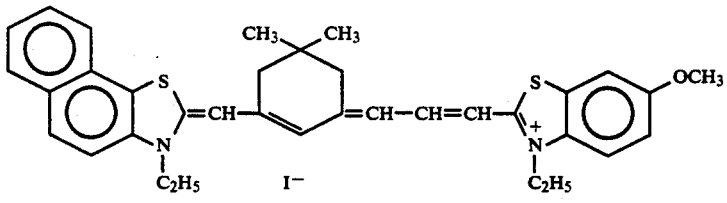

$0.5 \times 10^{-5}$ mol/mol silver halide

In using Dye-2 and Dye-3, the following compound was simultaneously added in an amount of $1.8 \times 10^{-3}$ mol/mol silver halide.

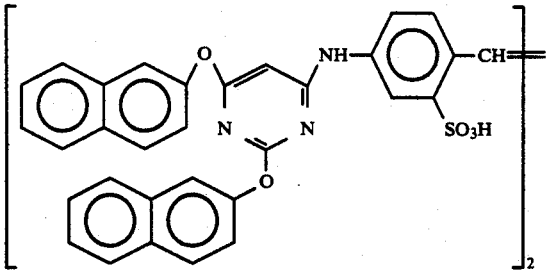

Furthermore, 1-(5-methylureidophenyl)-5-mercaptotetrazole was added to the yellow dye-forming layer, magenta dye-forming layer and cyan dye-forming layer at the level of $8.3\times10^{-4}$ mol/mol silver halide.

For preventing irradiation, the following dyes were added to the emulsions in an amount of 20 mg/m$^2$, 10 mg/m$^2$ and 30 mg/m$^2$, respectively.

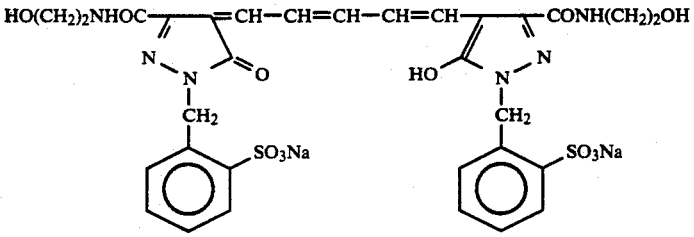

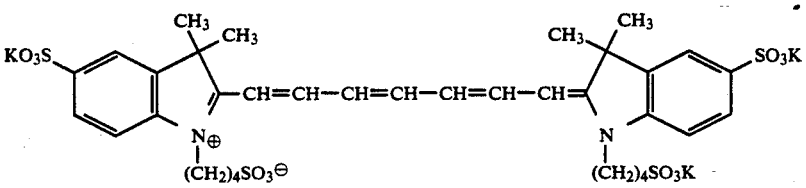

and

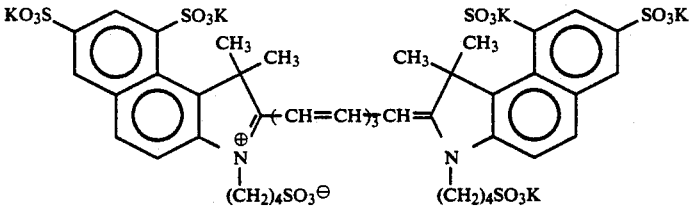

Layer Construction

The compositions of the respective layers are shown below. Each figure denotes the coating amount (g/m$^2$). As to the silver halide emulsion, the figure denotes the coating amount on an Ag basis.

Support

Polyethylene-laminated Paper

The polyethylene layer contacting the first layer contains a white pigment ($TiO_2$) and a bluing dye (ultramarine).

| | |
|---|---|
| First layer (red-sensitive yellow dye-forming layer) | |
| Silver chlorobromide emulsion (A) (described above) | 0.30 |
| Gelatin | 1.86 |

-continued

| | |
|---|---|
| Yellow coupler (ExY) | 0 82 |
| Color image stabilizer (Cpd-1) | 0.19 |
| Solvent (Solv-1) | 0.35 |
| Color image stabilizer (Cpd-7) | 0.06 |
| Second layer (color mixing inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (red-sensitive magenta dye-forming layer) | |
| Silver chlorobromide emulsion (A) | 0.12 |
| Gelatin | 1.24 |
| Magenta coupler (ExM) | 0.20 |
| Processing stabilizer (Cpd 2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv 2) | 0.40 |
| Fourth layer (ultraviolet absorption layer) | |
| Gelatin | 1.58 |
| Ultraviolet absorbe (UV-1) | 0.47 |
| Color mixing inhibitor (Cpd-5) | 0.05 |
| Solvent (Solv-5) | 0.24 |
| Fifth layer (red-sensitive cyan dye-forming layer) | |
| Silver chlorobromide emulsion (A) | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth layer (ultraviolet absorption layer) | |
| Gelatin | 0.53 |
| Ultraviolet absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified polyvinyl alcohol copolymer (degree of modification 17%) | 0.17 |
| Liquid paraffin | 0.03 |

Compounds identified above are as follows:

(ExY) Yellow Coupler

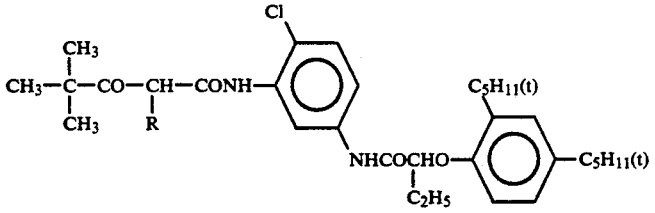
A 1:1 (mol ratio) mixture of the above compound, in two forms wherein
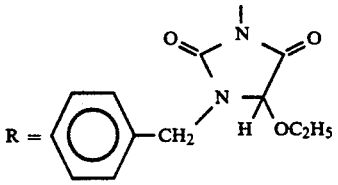
and
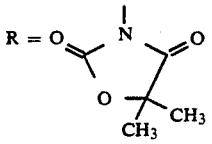
(ExM) Magenta Coupler
A 1:1 (mol ratio) mixture of
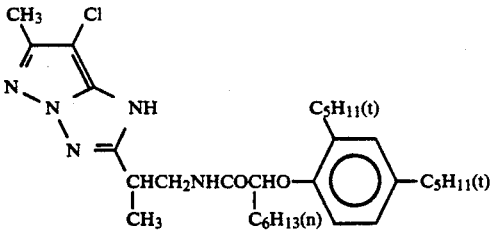
and
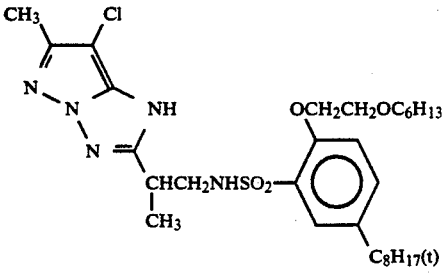
(ExC) Cyan Coupler
A 2:4:4 mixture (by weight) of
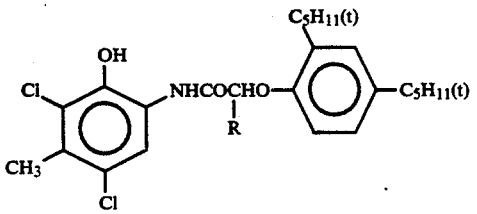
R = $C_2H_5$ and $C_4H_9$
and
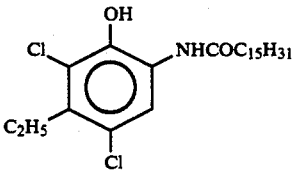
(Cpd-1) Color Image Stabilizer
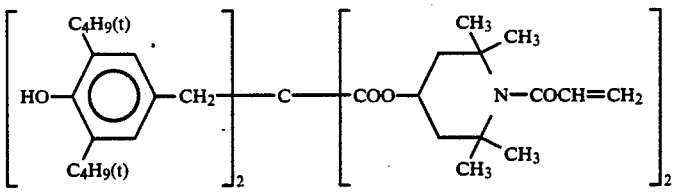
(Cpd-2) Color Image Stabilizer
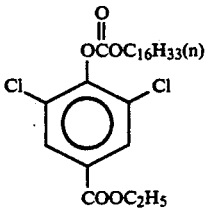

(Cpd-3) Color Image Stabilizer

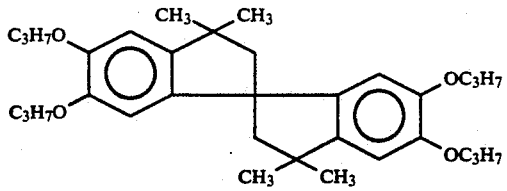

(Cpd-4) Color Image Stabilizer

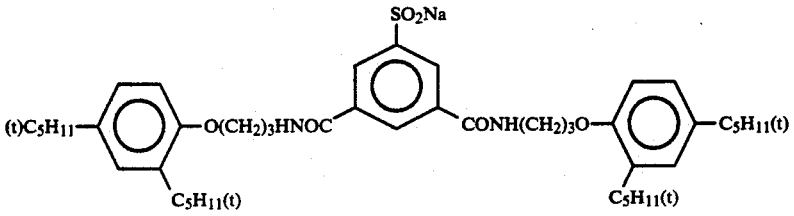

(Cpd-5) Color mixing inhibitor

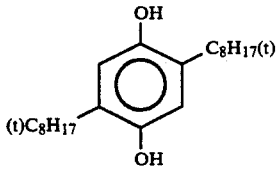

(Cpd-6) Color Image Stabilizer

A 2:4:4 (by weight) mixture of

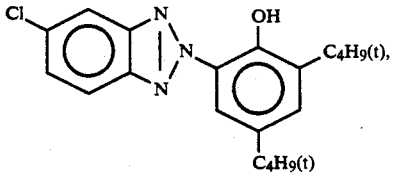

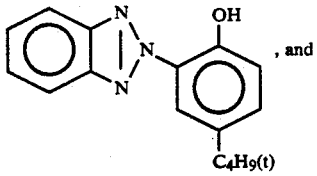

, and

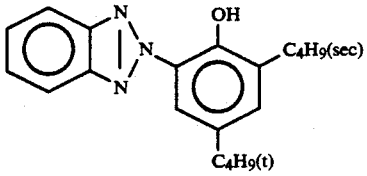

(Cpd-7) Color Image Stabilizer

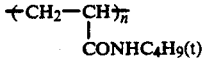

-continued (Average molecular weight 60,000)

(Cpd-8) Color Image Stabilizer

A 1:1 (by weight) mixture of

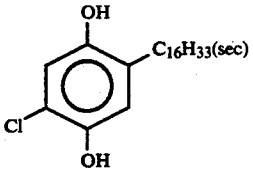

and

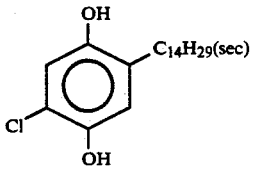

(Cpd-9) Color Image Stabilizer

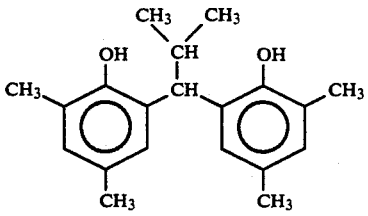

(Cpd-10) Preservative

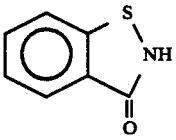

(Cpd-11) Preservative

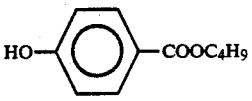

(UV-1) Ultraviolet Absorber

A 4:2:4 (by weight) mixture of

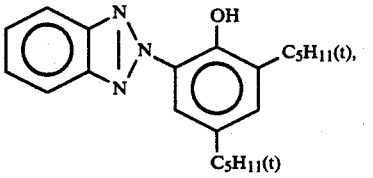
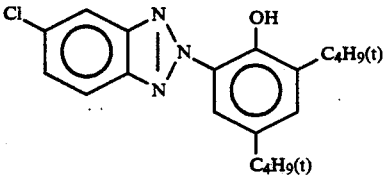
and
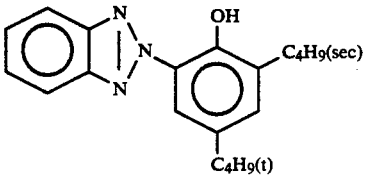
(Solv-1) Solvent
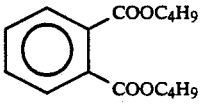
(Solv-2) Solvent
A 2:1 (by volume) mixture of
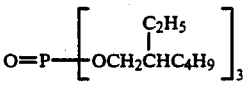
and
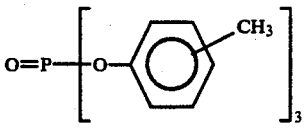
(Solv-4) Solvent
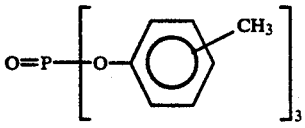
(Solv-5) Solvent
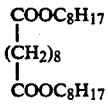
(Solv-6) Solvent
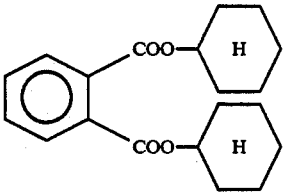
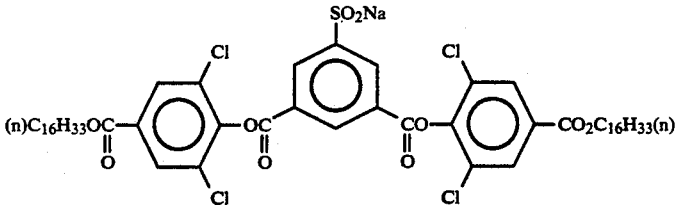
(Cpd-2a)
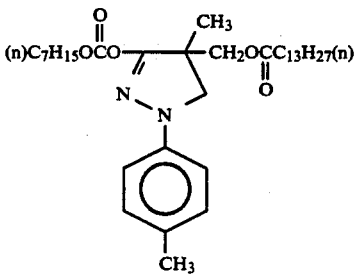
(Cpd-2b)
$CH_2{=}CH{-}SO_2{-}C_{18}H_{37}(n)$ (Cpd-2c)

-continued (Cpd-2d)

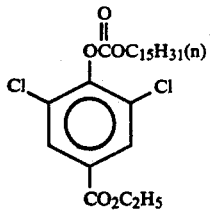

The above infrared-sensitive photosensitive material was designated as sample A. Samples B, C, D and E were produced by replacing the compound (Cpd-2) added to the third layer with (Cpd-2a) to (Cpd-2d), respectively. Sample F was produced by omitting the use of the compound (Cpd-2).

For exposure of the infrared-sensitive photosensitive materials, an AlGaInP semiconductor laser (emission wavelength about 670 nm), a GaAlAs semiconductor laser (emission wavelength about 750 nm) and a GaAlAs semiconductor laser (emission wavelength about 830 nm) were used. An apparatus was constructed so that the color printing paper moving in a direction perpendicular to the scanning direction could be subjected to successive scanning exposure to the respective laser beams through the use of a rotating polyhedron. Using this apparatus, the photosensitive materials were exposed. The picture element density was 400 dpi, and the time required for exposure to cover the major side of the A-3 size was about 20 seconds and the exposure time per picture element was about $2\times10^{-7}$ seconds. Stepwise exposure was performed through three-color sensitometric filters while controlling the exposure intensity by controlling the exposure time and emission intensity of the semiconductor lasers.

Using a paper processing machine, the exposed samples were processed in the following steps for color development. The total processing time was 210 seconds. Four color developers differing in developing agent concentration was used.

| Processing step | Temperature | Time |
|---|---|---|
| Color development | 35° C. | 45 sec. |
| Bleach-fix | 30–35° C. | 45 sec. |
| Rinse (1) | 30–35° C. | 20 sec. |
| Rinse (2) | 30–35° C. | 20 sec. |
| Rinse (3) | 30–35° C. | 20 sec. |
| Drying | 70–80° C. | 60 sec. |

(Rinse: A three-tank countercurrent system of (3) → (1))

The compositions of the respective processing baths were as follows.

| Color developer | |
|---|---|
| Water | 800 ml |
| Ethylenediamine-N,N,N,N-tetra-methylenephosphonic acid | 1.5 g |
| Potassium bromide | 0.015 g |
| Triethanolamine | 8.0 g |
| Sodium chloride | 1.4 g |
| Potasium carbonate | 25 g |
| N-Ethyl-N-(β-methanesulfon amidoethyl)-3-methyl-4-amino-aniline sulfate | 5.0 g . . . 3.0 g (variation about ±2σ) 4.5 . . . 3.5 g (variation about ±1σ) |
| N,N-Bis(carboxymethyl)hydrazine | 5.5 g |
| Fluorescent whitening agent (WHITEX 4B, Sumitomo Chemical) | 1.0 g |
| Water to make | 1,000 ml |

-continued

| Color developer | |
|---|---|
| pH (25° C.) | 10.05 |

Note: The symbol σ denotes the coefficent of variation, and the 2σ deviation corresponds to a fairly abnormal condition of the processing bath. The ±1σ ordinary laboratory processing.

| Bleach-fix bath (the same for tank and refill) | |
|---|---|
| Water | 400 ml |
| Ammonium thiosulfate (700 g/liter) | 100 ml |
| Sodium sulfite | 17 g |
| Ammonium Fe(III) ethylenediamine-tetracetate | 55 g |
| Disodium ethylenediaminetetracetate | 5 g |
| Ammonium bromide | 40 g |
| Water to make | 1,000 ml |
| pH (25° C.) | 6.0 |

Rinse Bath (The Same For Tank And Refill)

Deionized Water (Ca And Mg Not More Than 3 ppm Each)

For assessing the sensitivity difference in the case in which the range of variation in developing agent concentration correspond to 2σ, the sensitivity, which was defined as the logarithm of the reciprocal of the light quantity required to give a density of fog+1.0, was determined with each of the photosensitive materials developed respectively at the developing agent concentrations 5.0 g and 3.0 g. The sensitivity difference between the two processing conditions, namely S(5.0 g)−S(3.0 g), was taken as an index of the variation of processing performance and used for evaluation of the photosensitive materials. (The greater the difference is, the greater the fluctuation in photographic characteristics (due to changes in developing agent concentration in processing) are.) In the 1σ variation range case as well, the sensitivity difference was determined in the same manner as above with each of the photosensitive materials after development processing at the two developing agent concentrations 4.5 g and 3.5 g per liter.

Samples fabricated and exposed in the same manner as in the previous Example were processed for development in the following manner while varying the developing agent concentration as in the previous Example. The total processing time was 150 seconds and 90 seconds.

| Processing step | Temperature | Time | Temperature | Time |
|---|---|---|---|---|
| Color development | 32° C. | 30 sec. | 35° C. | 20 sec. |
| Bleach/fix | 30–35° C. | 30 sec. | 30–35° C. | 20 sec. |
| Rinse (1) | 30–35° C. | 20 sec. | 30–35° C. | 10 sec. |
| Rinse (2) | 30–35° C. | 20 sec. | 30–35° C. | 10 sec. |
| Rinse (3) | 30–35° C. | 20 sec. | 30–35° C. | 10 sec. |
| Drying | 70–80° C. | 30 sec. | 70–80° C. | 20 sec. |

-continued

| Processing step | Temperature | Time | Temperature | Time |
|---|---|---|---|---|
| Total | | 150 sec. | | 90 sec. |

(Rinse: Three-tank countercurrent system, (3) → (1))

The processing solutions respectively had the following compositions.

| Color developer | Tank solution |
|---|---|
| Water | 800 ml |
| Ethylenediamine-N,N,N',N'-tetramethylenephosphonic acid | 1.5 g |
| Potassium bromide | 0.015 g |
| Triethanolamine | 8.0 g |
| Sodium chloride | 4.9 g |
| Potassium carbonate | 25 g |
| 4-Amino-3-methyl-N-ethyl-N-(3-hydroxypropyl)aniline p-toluenesulfonate | 13.0 g . . . 10.0 g (variation about ±2σ) 12.2 g . . . 10.7 g (variation about ±1σ) |
| N,N-Bis(carboxymethyl)hyrazine | 5.5 g |
| Fluorescent whitener (WHITEX 4B, Sumitomo Chemical) | 1.0 g |
| Add water to make 1,000 ml | 1,000 ml |
| pH | 10.05 |

Bleach/fix And Rinse Solution (Same For Tank And Refill)

Same as in the previous Example. The results are shown in the following Table.

| Photo-sensitive material | Compound used in magenta layer | Sensitivity difference (2 × 10⁻⁷" exp) Range of variation of developing agent concentration (2σ) 3'30" | 150" | 90" | Range of variation of developing agent concentration (1σ) 3'30" | 150" | 90" |
|---|---|---|---|---|---|---|---|
| A | CPd-2 | 0.14 | 0.14 | 0.13 | 0.04 | 0.04 | 0.04 |
| B | 2a | 0.13 | 0.12 | 0.12 | 0.04 | 0.04 | 0.04 |
| C | 2b | 0.14 | 0.14 | 0.14 | 0.05 | 0.04 | 0.04 |
| D | 2c | 0.15 | 0.15 | 0.15 | 0.03 | 0.05 | 0.05 |
| E | 2d | 0.15 | 0.15 | 0.16 | 0.04 | 0.05 | 0.06 |
| F | — | 0.21 | 0.21 | 0.22 | 0.05 | 0.07 | 0.12 |

Notes: Material F, for comparison;

When the range of variation of the developing agent concentration was wide (±2σ), the constitution of the invention produced almost the same effect for all the total processing times of 90 seconds to 3 minutes 30 seconds. When, however, said range of variation was small (±1σ), the constitution of the invention produced little improving effect in the longer processing time cases (3'30" and 150") as evaluated from the viewpoint of dependency on processing time. Thus, it is apparent that the constitution of the invention can produce a significantly higher improving effect when it is combined with the shorter total processing time (90").

While the invention has been described in detail and with reference to specific embodiments thereof, it will be apparent to one skilled in the art that various changes and modifications can be made therein without departing from the spirit and scope thereof.

What is claimed is:

1. A method of forming a color image in a silver halide color photosensitive material comprising exposing said photosensitive material in a scanning exposure system for a time period shorter than about $10^{-6}$ seconds per picture element, and thereafter subjecting the exposed material to development processing for a total processing time of about 90 seconds or less, inclusive of drying time, said photosensitive material comprising a support having thereon at least three silver halide emulsion layers differing in color sensitivity, at least two of which have a spectral sensitivity maximum in the wavelength region of 670 nm or longer, wherein at least one of the silver halide emulsion layers comprises (a) at least one coupler capable of developing color upon coupling reaction with the oxidized form of an aromatic amine compound and (b) at least one compound of general formula (I) or (II):

$$R_1-(A)_n-X \quad (I)$$

$$R_2-\underset{\underset{B}{|}}{C}=Y \quad (II)$$

wherein $R_1$ and $R_2$ each is an aliphatic group, an aromatic group or a heterocyclic group; X is a leaving group which leaves upon reaction with an aromatic amine developing agent; A is a group capable of forming a chemical bond upon reaction with the aromatic amine developing agent; n is 1 or 0; B is a hydrogen atom, an aliphatic group, an aromatic group, a heterocyclic group, an acyl group, or a sulfonyl group; Y is a group capable of accelerating the addition of an aromatic amine developing agent to the compound of general formula (II); wherein $R_1$ and X, and/or Y and $R_2$, or Y and B, may combine with each other to form a ring structure; and wherein when X is a halogen, n equals 0 and when n equals 0, X is a halogen.

2. The method as claimed in claim 1, wherein of said total processing time, color developing time is substantially within 20 seconds.

3. The method as claimed in claim 1, wherein said at least one compound of general formula (I) or (II) is present in an amount of $1\times10^{-2}$ to 10 mols per mol of said coupler.

4. The method as claimed in claim 3, wherein said amount is $3\times10^{-2}$ to 5 mols per mol of said coupler.

5. The method as claimed in claim 1, wherein said leaving group X in general formula (I) is a halogen atom or a group bonding to A via an oxygen, sulfur or nitrogen atom.

6. The method as claimed in claim 5, wherein said group bonding to A is 2-pyridyloxy, 2-pyrimidiloxy, 4-pyrimidiloxy, 2-(1,2,3-triazinyl)oxy, 2-benzimidazolyl, 2-imidazolyl, 2-thiazolyl, 2-benzothiazolyl, 2-furyloxy, 2-thiophenyloxy, 4-pyridyloxy, 3-isoxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazoline-5-oxy-, aryloxy, alkoxy, alkylthio, arylthio, or substituted N-oxy.

7. The method as claimed in claim 1, wherein A is a group which contains a low electron density atom-containing group.

8. The method as claimed in claim 7, wherein the low electron density atom-containing group is selected from the group consisting of $$-L-\overset{\overset{Y}{\|}}{C}-,\ -L-\overset{\overset{Y}{\|}}{S}-,\ -L-\underset{\underset{Y'}{\|}}{\overset{\overset{Y}{\|}}{S}}-,\ -L-\underset{\underset{Y'}{|}}{\overset{\overset{Y}{\|}}{P}}-,\ \text{and}\ -L-\underset{\underset{R''}{|}}{\overset{\overset{R'}{\|}}{Si}}-,$$

wherein L is a single bond, an alkylene group,

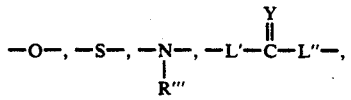

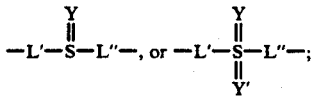

Y is a group capable of accelerating the addition of an aromatic amine developing agent to the compound of general formula (II); Y' has the same meaning as Y; R' and R'' may be the same or different and each represents —L'''—$R_1$, and wherein $R_1$ is an aliphatic group, an aromatic group or a heterocyclic group; L', L'' and L'' each represents —O—, —S— or

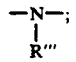

R''' is a hydrogen atom, an aliphatic group, an aromatic group; a heterocyclic group; an acyl group; or a sulfonyl group; and L''' can be a single bond.

9. The method as claimed in claim 1, wherein Y of general formula (II) is an oxygen or sulfur atom, or =N—$R_{24}$ or =C($R_{25}$)($R_{26}$) wherein $R_{24}$, $R_{25}$ and $R_{26}$ each represents a hydrogen atom, an aliphatic group, an aromatic group, a heterocyclic group, an acyl group or a sulfonyl group, and $R_{25}$ and $R_{26}$ may be bonded to each other to form a ring structure.

10. The method as claimed in claim 1, wherein exposing said photosensitive material in a scanning exposure system comprises moving a high-density light beam from a laser or LED relative to the photosensitive material thus forming an image.

11. The method as claimed in claim 10, wherein said exposing step employs a semiconductor laser.

* * * * *